US009005022B2

(12) United States Patent
Saunders

(10) Patent No.: US 9,005,022 B2
(45) Date of Patent: Apr. 14, 2015

(54) GAMING SYSTEM, GAMING DEVICE, AND METHOD FOR PROVIDING A CASCADING SYMBOLS GAME WHICH BUILDS LAYERS OF MULTIPLE DIMENSION SYMBOLS

(75) Inventor: Brian F. Saunders, Sunnyvale, CA (US)

(73) Assignee: IGT, Las Vegas, NV (US)

( * ) Notice: Subject to any disclaimer, the term of this patent is extended or adjusted under 35 U.S.C. 154(b) by 21 days.

(21) Appl. No.: 13/353,920

(22) Filed: Jan. 19, 2012

(65) Prior Publication Data

US 2013/0190067 A1 Jul. 25, 2013

(51) Int. Cl.
*A63F 9/24* (2006.01)
*G07F 17/32* (2006.01)

(52) U.S. Cl.
CPC ..... *G07F 17/3211* (2013.01); *G07F 17/326* (2013.01)

(58) Field of Classification Search
CPC ..... G07F 17/3211; G07F 17/3267; G07F 17/3213; G07F 17/326; G07F 17/3265; A63F 13/00
USPC ..... 463/16–20, 32
See application file for complete search history.

(56) References Cited

U.S. PATENT DOCUMENTS

| | | | |
|---|---|---|---|
| 1,978,395 | A | 10/1934 | Groetchen |
| 3,420,525 | A | 1/1969 | Waders |
| 3,642,287 | A | 2/1972 | Lally et al. |
| 3,735,987 | A | 5/1973 | Ohki |
| 4,099,722 | A | 7/1978 | Rodesch et al. |
| 4,198,052 | A | 4/1980 | Gauselmann |
| 4,200,291 | A | 4/1980 | Hooker |
| 4,326,351 | A | 4/1982 | Heywood et al. |
| 4,357,567 | A | 11/1982 | Rock |
| 4,636,951 | A | 1/1987 | Harlick |
| 4,695,053 | A | 9/1987 | Vazquez, Jr. et al. |
| 4,711,451 | A | 12/1987 | Pajak et al. |
| 4,722,527 | A | 2/1988 | Gauselmann |
| 4,790,537 | A | 12/1988 | Smyth et al. |
| 4,826,169 | A | 5/1989 | Bessho et al. |
| 4,874,173 | A | 10/1989 | Kishishita |
| 5,092,598 | A | 3/1992 | Kamille |
| 5,152,529 | A | 10/1992 | Okada |
| 5,205,555 | A | 4/1993 | Hamano |
| RE34,244 | E | 5/1993 | Hagiwara |

(Continued)

FOREIGN PATENT DOCUMENTS

| | | |
|---|---|---|
| AU | 198774936 | 6/1987 |
| AU | 710015 | 9/1997 |

(Continued)

OTHER PUBLICATIONS

Cubis Article at http://help.skybet.com/display/4/kb/article.aspx?aid=2460 dated Dec. 20, 2011on two pages.

*Primary Examiner* — Steve Rowland
(74) *Attorney, Agent, or Firm* — Neal, Gerber & Eisenberg LLP

(57) ABSTRACT

In various embodiments, the gaming system disclosed herein includes a cascading symbol or tumbling reel game which retains, saves or stores zero, one or more of any symbols removed during the play of a primary cascading symbols game. In various embodiments, the gaming system disclosed herein includes a cascading symbol or tumbling reel game which sequentially layers a plurality of adjacent symbol display position grids at different depths.

36 Claims, 24 Drawing Sheets

(56) References Cited

U.S. PATENT DOCUMENTS 5,224,706 A 7/1993 Bridgeman et al.
5,308,062 A 5/1994 Hogan
5,308,065 A 5/1994 Bridgeman et al.
5,332,219 A 7/1994 Marnell, II et al.
5,332,228 A 7/1994 Schultz
5,364,100 A 11/1994 Ludlow et al.
5,393,057 A 2/1995 Marnell, II
5,395,111 A 3/1995 Inoue
5,423,539 A 6/1995 Nagao
5,431,408 A 7/1995 Adams
5,449,173 A 9/1995 Thomas et al.
5,531,440 A 7/1996 Dabrowski et al.
5,564,700 A 10/1996 Celona
5,584,764 A 12/1996 Inoue
5,609,524 A 3/1997 Inoue
5,624,119 A 4/1997 Leake
5,664,998 A 9/1997 Seelig et al.
5,704,835 A 1/1998 Dietz
5,720,662 A 2/1998 Holmes et al.
5,722,891 A 3/1998 Inoue
5,752,881 A 5/1998 Inoue
5,769,716 A 6/1998 Saffari et al.
5,772,506 A 6/1998 Marks et al.
5,807,172 A 9/1998 Piechowiak
5,813,911 A 9/1998 Margolin
5,823,873 A 10/1998 Moody
5,833,536 A 11/1998 Davids et al.
5,833,537 A 11/1998 Barrie
5,863,249 A 1/1999 Inoue
5,882,260 A 3/1999 Marks et al.
5,951,397 A 9/1999 Dickinson
5,980,384 A 11/1999 Barrie
5,984,782 A 11/1999 Inoue
5,997,400 A 12/1999 Seelig et al.
5,997,401 A 12/1999 Crawford
6,033,307 A 3/2000 Vancura
6,056,642 A 5/2000 Bennett
6,059,289 A 5/2000 Vancura
6,059,658 A 5/2000 Mangano et al.
6,086,066 A 7/2000 Takeuchi et al.
6,089,976 A 7/2000 Schneider et al.
6,089,977 A 7/2000 Bennett
6,093,102 A 7/2000 Bennett
6,095,921 A 8/2000 Walker et al.
6,117,013 A 9/2000 Eiba
6,120,031 A 9/2000 Adams
6,120,376 A 9/2000 Cherry
6,120,377 A 9/2000 McGinnis et al.
6,139,124 A 10/2000 Kling
6,142,872 A 11/2000 Walker et al.
6,142,875 A 11/2000 Kodachi et al.
6,149,521 A 11/2000 Sanduski
6,159,095 A 12/2000 Frohm et al.
6,159,096 A 12/2000 Yoseloff
6,159,098 A 12/2000 Slomiany et al.
6,174,235 B1 1/2001 Walker et al.
6,190,254 B1 2/2001 Bennett
6,203,009 B1 3/2001 Sines et al.
6,220,959 B1 4/2001 Holmes, Jr. et al.
6,224,484 B1 5/2001 Okuda et al.
6,227,971 B1 5/2001 Weiss
6,241,607 B1 6/2001 Payne et al.
6,251,013 B1 6/2001 Bennett
6,254,481 B1 7/2001 Jaffe
6,261,177 B1 7/2001 Bennett
6,270,411 B1 8/2001 Gura et al.
6,270,412 B1 8/2001 Crawford et al.
6,290,600 B1 9/2001 Glasson
6,299,165 B1 10/2001 Nagano
6,299,170 B1 10/2001 Yoseloff
6,302,398 B1 10/2001 Vecchio
6,302,429 B1 10/2001 Friedrich
6,305,686 B1 10/2001 Perrie et al.
6,311,976 B1 11/2001 Yoseloff et al.
6,312,334 B1 11/2001 Yoseloff
6,315,660 B1 11/2001 DeMar et al.
6,315,663 B1 11/2001 Sakamoto
6,318,721 B1 11/2001 Randall et al.
6,319,124 B1 11/2001 Baerlocher et al.
6,322,078 B1 11/2001 Adams
6,334,814 B1 1/2002 Adams
6,336,860 B1 1/2002 Webb
6,346,043 B1 2/2002 Colin et al.
6,347,996 B1 2/2002 Gilmore et al.
6,358,144 B1 3/2002 Kaddlic et al.
6,394,902 B1 5/2002 Glavich et al.
6,398,644 B1 6/2002 Perrie et al.
6,409,602 B1 6/2002 Wilshire et al.
6,413,161 B1 7/2002 Baerlocher et al.
6,413,162 B1 7/2002 Baerlocher et al.
6,416,408 B2 7/2002 Tracy et al.
6,419,579 B1 7/2002 Bennett
6,428,412 B1 8/2002 Anderson et al.
6,439,993 B1 8/2002 O'Halloran
6,454,266 B1 9/2002 Breeding et al.
6,464,581 B1 10/2002 Yoseloff et al.
6,481,713 B2 11/2002 Perrie et al.
6,494,454 B2 12/2002 Adams
6,517,432 B1 2/2003 Jaffe
6,517,433 B2 2/2003 Loose et al.
6,554,703 B1 4/2003 Bussick et al.
6,554,704 B2 4/2003 Nicastro et al.
6,561,904 B2 5/2003 Locke et al.
6,565,433 B1 5/2003 Baerlocher et al.
6,575,830 B2 6/2003 Baerlocher et al.
6,585,591 B1 7/2003 Baerlocher et al.
6,589,114 B2 7/2003 Rose
6,604,740 B1 8/2003 Singer et al.
6,616,142 B2 9/2003 Adams
6,632,139 B1 10/2003 Baerlocher
6,632,140 B2 10/2003 Berman et al.
6,634,945 B2 10/2003 Glavich et al.
6,641,477 B1 11/2003 Dietz
6,643,943 B2 11/2003 Dall'Aglio et al.
6,644,663 B2 11/2003 Seelig et al.
6,659,864 B2 12/2003 McGahn et al.
6,666,767 B1 12/2003 Dayan
6,676,511 B2 1/2004 Payne et al.
6,676,512 B2 1/2004 Fong et al.
6,695,696 B1 2/2004 Kaminkow
6,702,671 B2 3/2004 Tarantino
6,712,693 B1 3/2004 Hettinger
6,715,756 B2 4/2004 Inoue
6,719,630 B1 4/2004 Seelig et al.
6,733,386 B2 5/2004 Cuddy et al.
6,746,328 B2 6/2004 Cannon et al.
6,749,502 B2 6/2004 Baerlocher
6,780,109 B2 8/2004 Kaminkow
6,786,818 B1 9/2004 Rothschild et al.
6,802,775 B2 10/2004 Baerlocher et al.
6,805,349 B2 10/2004 Baerlocher et al.
6,805,632 B2 10/2004 Suda
6,808,454 B2 10/2004 Gerrard et al.
6,832,957 B2 12/2004 Falconer
6,837,788 B2 1/2005 Cannon
6,855,054 B2 2/2005 White et al.
6,866,583 B2 3/2005 Glavich et al.
6,875,106 B2 4/2005 Weiss et al.
6,878,061 B2 4/2005 Baerlocher et al.
6,887,157 B2 5/2005 LeMay et al.
6,896,617 B2 5/2005 Daly
6,905,406 B2 6/2005 Kaminkow et al.
6,910,962 B2 6/2005 Marks et al.
6,913,533 B2 7/2005 Cuddy et al.
6,921,335 B2 7/2005 Rodgers et al.
6,929,952 B2 8/2005 Baerlocher
6,935,947 B1 8/2005 Singer et al.
6,935,950 B2 8/2005 Tarantino
6,939,229 B2 9/2005 McClintic
6,942,571 B1 9/2005 McAllister et al.
6,960,133 B1 11/2005 Marks et al.
6,960,134 B2 11/2005 Hartl et al.
6,964,416 B2 11/2005 McClintic et al.
6,971,955 B2 12/2005 Baerlocher et al.

(56) References Cited

U.S. PATENT DOCUMENTS 6,979,263 B2 12/2005 Baerlocher et al.
6,981,635 B1 1/2006 Hughs-Baird et al.
6,986,710 B2 1/2006 Baerlocher et al.
6,991,538 B2 1/2006 Cannon
6,997,804 B2 2/2006 Berman
7,001,274 B2 2/2006 Baerlocher et al.
7,014,560 B2 3/2006 Glavich et al.
7,022,016 B2 4/2006 Wood et al.
7,040,983 B2 5/2006 Dolloff et al.
7,048,275 B2 5/2006 Adams
7,052,395 B2 5/2006 Glavich et al.
7,056,209 B2 6/2006 Baerlocher et al.
7,056,213 B2 6/2006 Ching et al.
7,059,967 B2 6/2006 Baerlocher
7,070,502 B1 7/2006 Bussick et al.
7,074,127 B2 7/2006 Cuddy et al.
7,077,745 B2 7/2006 Gomez et al.
7,090,580 B2 8/2006 Rodgers et al.
7,094,148 B2 8/2006 Baerlocher et al.
7,104,886 B2 9/2006 Baerlocher et al.
7,108,602 B2 9/2006 Daly
7,128,646 B2 10/2006 Baerlocher et al.
7,137,888 B2 11/2006 Glavich et al.
7,144,322 B2 12/2006 Gomez et al.
7,153,205 B2 12/2006 Baerlocher
7,160,186 B2 1/2007 Cuddy et al.
7,169,042 B2 1/2007 Muir et al.
7,195,559 B2 3/2007 Gilmore et al.
7,222,858 B2 5/2007 Moody
7,226,359 B2 6/2007 Bussick et al.
7,236,113 B1 6/2007 Wang
7,252,591 B2 8/2007 Van Asdale
7,252,592 B2 8/2007 Rodgers et al.
7,294,055 B2 11/2007 Baerlocher et al.
7,294,058 B1 11/2007 Slomiany et al.
7,309,281 B2 12/2007 Baerlocher et al.
7,309,282 B2 12/2007 Baerlocher et al.
7,331,862 B2 2/2008 Rodgers et al.
7,331,866 B2 2/2008 Rodgers et al.
7,341,512 B2 3/2008 Dolloff et al.
7,357,713 B2 4/2008 Marks et al.
7,371,169 B2 5/2008 Baerlocher
7,371,170 B2 5/2008 Cregan et al.
7,371,172 B2 5/2008 Inoue
7,396,279 B2 7/2008 Berman et al.
7,399,225 B2 7/2008 Kaminkow
7,399,226 B2 7/2008 Mishra
7,402,102 B2 7/2008 Marks et al.
7,442,123 B2 10/2008 Brill et al.
7,448,948 B2 11/2008 Hughs-Baird et al.
7,473,173 B2 1/2009 Peterson et al.
7,494,412 B2 2/2009 Baerlocher
7,494,413 B2 2/2009 Singer et al.
7,510,473 B2 3/2009 Thomas
7,553,231 B2 6/2009 Rodgers et al.
7,611,406 B2 11/2009 Fuller
7,666,085 B2 2/2010 Vorias et al.
8,113,941 B2 2/2012 Gomez et al.
8,371,930 B1 * 2/2013 Saunders et al. ..... 463/20
2001/0016513 A1 8/2001 Muir et al.
2002/0010017 A1 1/2002 Bennett
2002/0025849 A1 2/2002 Olive
2002/0068623 A1 6/2002 Gauselmann
2002/0077165 A1 6/2002 Bansemer et al.
2003/0045345 A1 3/2003 Berman
2003/0045354 A1 3/2003 Giobbi
2003/0054874 A1 3/2003 Kaminkow
2003/0057645 A1 3/2003 Baerlocher et al.
2003/0060267 A1 3/2003 Glavich et al.
2003/0064768 A1 4/2003 Fier
2003/0100356 A1 5/2003 Brown et al.
2003/0157981 A1 8/2003 Marks et al.
2003/0190945 A1 10/2003 Bussick et al.
2003/0203753 A1 10/2003 Muir et al.
2003/0207710 A1 11/2003 Rodgers et al.
2004/0012145 A1 1/2004 Inoue
2004/0014516 A1 1/2004 Inoue
2004/0014517 A1 1/2004 Inoue
2004/0018866 A1 1/2004 Inoue
2004/0023714 A1 * 2/2004 Asdale ..... 463/22
2004/0026854 A1 2/2004 Inoue
2004/0033827 A1 2/2004 Gilmore et al.
2004/0033829 A1 2/2004 Pacey et al.
2004/0036218 A1 2/2004 Inoue
2004/0038726 A1 2/2004 Inoue
2004/0043809 A1 3/2004 Gomez et al.
2004/0048651 A1 3/2004 Vorias et al.
2004/0053669 A1 3/2004 Gerrard et al.
2004/0053672 A1 3/2004 Baerlocher
2004/0053676 A1 3/2004 Rodgers
2004/0067790 A1 4/2004 Peterson et al.
2004/0072612 A1 4/2004 Rodgers et al.
2004/0097280 A1 5/2004 Gauselmann
2004/0102236 A1 5/2004 Suda et al.
2004/0102244 A1 5/2004 Kryuchkov et al.
2004/0102245 A1 5/2004 Escalera et al.
2004/0137982 A1 7/2004 Cuddy et al.
2004/0147306 A1 7/2004 Randall et al.
2005/0020344 A1 1/2005 Kaminkow
2005/0049035 A1 3/2005 Baerlocher et al.
2005/0054429 A1 3/2005 Baerlocher et al.
2005/0059446 A1 3/2005 Kaminkow
2005/0064924 A1 3/2005 Glavich et al.
2005/0070354 A1 3/2005 Baerlocher et al.
2005/0101380 A1 5/2005 Glavich et al.
2005/0119403 A1 6/2005 St. Clair
2005/0148381 A1 7/2005 Marks et al.
2005/0148384 A1 7/2005 Marks et al.
2005/0227754 A1 10/2005 Kaminkow et al.
2005/0245307 A1 11/2005 Gatto et al.
2005/0282620 A1 12/2005 Marks et al.
2005/0288094 A1 12/2005 Marks et al.
2006/0030392 A1 2/2006 Rodgers et al.
2006/0046830 A1 3/2006 Webb
2006/0058097 A1 3/2006 Berman et al.
2006/0068875 A1 3/2006 Cregan et al.
2006/0068882 A1 3/2006 Baerlocher et al.
2006/0068884 A1 3/2006 Baerlocher et al.
2006/0068885 A1 3/2006 Cregan et al.
2006/0068893 A1 3/2006 Jaffe et al.
2006/0073876 A1 4/2006 Cuddy
2006/0073879 A1 4/2006 Baerlocher
2006/0084492 A1 4/2006 Baerlocher et al.
2006/0084494 A1 4/2006 Belger et al.
2006/0084498 A1 4/2006 Baerlocher et al.
2006/0089191 A1 4/2006 Singer et al.
2006/0116195 A1 6/2006 Baerlocher et al.
2006/0172795 A1 8/2006 Bussick et al.
2006/0199636 A1 9/2006 Ching et al.
2006/0199637 A1 9/2006 Ching et al.
2006/0217189 A1 9/2006 Walker et al.
2006/0264254 A1 11/2006 Aoki
2007/0010316 A1 1/2007 Baerlocher et al.
2007/0021176 A1 1/2007 Jackson
2007/0021188 A1 1/2007 Rodgers et al.
2007/0060246 A1 3/2007 Baerlocher et al.
2007/0060248 A1 3/2007 Rodgers et al.
2007/0060294 A1 3/2007 Cuddy et al.
2007/0087812 A1 4/2007 Glavich et al.
2007/0287523 A1 12/2007 Esses et al.
2008/0051174 A1 2/2008 Fiden
2008/0090655 A1 4/2008 Marks et al.
2008/0096670 A1 4/2008 Baerlocher et al.
2008/0102931 A1 5/2008 Marks et al.
2008/0108411 A1 5/2008 Jensen et al.
2008/0113765 A1 5/2008 DeWaal
2008/0132320 A1 6/2008 Rodgers
2008/0139298 A1 6/2008 Rodgers et al.
2008/0200232 A1 8/2008 Baerlocher et al.
2008/0200238 A1 8/2008 Mishra
2008/0214282 A1 9/2008 Inoue
2008/0234023 A1 9/2008 Mullahkhel et al.
2009/0075722 A1 3/2009 Louie et al.
2009/0118004 A1 5/2009 Hoffman

(56) References Cited

U.S. PATENT DOCUMENTS

| | | | | |
|---|---|---|---|---|
| 2009/0124325 | A1 | 5/2009 | Wadleigh et al. | |
| 2009/0124347 | A1 | 5/2009 | Rodgers et al. | |
| 2009/0137309 | A1* | 5/2009 | Thomas | 463/20 |
| 2009/0239631 | A1 | 9/2009 | Aoki et al. | |
| 2010/0004050 | A1* | 1/2010 | Caputo et al. | 463/21 |
| 2010/0004056 | A1 | 1/2010 | Walker et al. | |
| 2010/0022297 | A1 | 1/2010 | Saunders | |
| 2010/0029364 | A1 | 2/2010 | Zielinski | |
| 2010/0120507 | A1 | 5/2010 | Rodgers et al. | |
| 2010/0124972 | A1 | 5/2010 | Rodgers et al. | |
| 2010/0130280 | A1 | 5/2010 | Arezina et al. | |
| 2010/0240436 | A1 | 9/2010 | Wilson et al. | |
| 2011/0045906 | A1* | 2/2011 | Berman et al. | 463/32 |
| 2011/0053675 | A1* | 3/2011 | Aoki et al. | 463/20 |
| 2011/0086695 | A1 | 4/2011 | Evans | |
| 2011/0111825 | A1 | 5/2011 | Caputo | |
| 2011/0117989 | A1 | 5/2011 | Kennedy et al. | |
| 2012/0115606 | A1 | 5/2012 | Seelig | |

FOREIGN PATENT DOCUMENTS

| | | |
|---|---|---|
| AU | 722969 | 6/1998 |
| AU | 199917318 | 9/1999 |
| AU | 200069612 | 2/2001 |
| AU | 200139027 | 10/2001 |
| AU | 2001256012 | 12/2001 |
| AU | 2001256014 | 12/2001 |
| EP | 0058488 | 8/1982 |
| EP | 0060019 | 9/1982 |
| EP | 0410789 | 1/1991 |
| EP | 0874337 | 10/1998 |
| EP | 0981119 | 2/2000 |
| EP | 0984408 | 3/2000 |
| EP | 1039424 | 9/2000 |
| EP | 1063622 | 12/2000 |
| EP | 1150261 | 10/2001 |
| EP | 1184822 | 3/2002 |
| EP | 1197932 | 4/2002 |
| EP | 1205894 | 5/2002 |
| EP | 1422673 | 5/2004 |
| EP | 1513117 | 3/2005 |
| GB | 1454046 | 10/1976 |
| GB | 2062922 | 5/1981 |
| GB | 2106293 | 9/1981 |
| GB | 2081952 | 2/1982 |
| GB | 2090690 | 7/1982 |
| GB | 2096376 | 10/1982 |
| GB | 2097160 | 10/1982 |
| GB | 2100905 | 1/1983 |
| GB | 2105891 | 3/1983 |
| GB | 2106295 | 4/1983 |
| GB | 2113881 | 8/1983 |
| GB | 2117155 | 10/1983 |
| GB | 2137392 | 10/1984 |
| GB | 2161008 | 1/1986 |
| GB | 2165385 | 4/1986 |
| GB | 2170643 | 8/1986 |
| GB | 2180087 | 3/1987 |
| GB | 2181589 | 4/1987 |
| GB | 2183882 | 6/1987 |
| GB | 2191030 | 12/1987 |
| GB | 2222712 | 3/1990 |
| GB | 2225889 | 6/1990 |
| GB | 2226436 | 6/1990 |
| GB | 2242300 | 9/1991 |
| GB | 2262642 | 6/1993 |
| GB | 2322217 | 8/1998 |
| GB | 2335524 | 9/1999 |
| GB | 2372132 | 2/2001 |
| GB | 2393555 | 3/2004 |
| WO | WO9732285 | 9/1997 |
| WO | WO9820949 | 5/1998 |
| WO | WO0030727 | 6/2000 |
| WO | WO0032286 | 6/2000 |
| WO | WO0066235 | 11/2000 |
| WO | WO0076606 | 12/2000 |
| WO | WO0126019 | 4/2001 |
| WO | WO03026756 | 4/2003 |
| WO | WO2004025584 | 3/2004 |
| WO | WO2005028043 | 3/2005 |
| WO | WO2006076294 | 7/2006 |
| WO | WO2007002935 | 1/2007 |
| WO | WO2007084766 | 7/2007 |
| WO | WO2007130443 | 11/2007 |
| WO | WO2007130444 | 11/2007 |

* cited by examiner

GAMING SYSTEM, GAMING DEVICE, AND METHOD FOR PROVIDING A CASCADING SYMBOLS GAME WHICH BUILDS LAYERS OF MULTIPLE DIMENSION SYMBOLS

CROSS REFERENCE TO RELATED APPLICATIONS

This application relates to the following co-pending commonly owned patent applications: "GAMING SYSTEM, GAMING DEVICE, AND METHOD FOR PROVIDING A MULTIPLE DIMENSION CASCADING SYMBOLS GAME," Ser. No. 13/187,648; "GAMING SYSTEM, GAMING DEVICE, AND METHOD FOR PROVIDING A MULTIPLE DIMENSION CASCADING SYMBOLS GAME WITH A TIME ELEMENT," Ser. No. 13/187,642; "GAMING SYSTEM, GAMING DEVICE, AND METHOD FOR PROVIDING A MULTIPLE DIMENSION CASCADING SYMBOLS GAME WITH THREE DIMENSIONAL SYMBOLS," Ser. No. 13/187,629; "GAMING SYSTEM, GAMING DEVICE, AND METHOD FOR PROVIDING A CASCADING SYMBOLS GAME WHICH REUSES DISCARDED SYMBOLS," Ser. No. 13/353,775; and "GAMING SYSTEM, GAMING DEVICE, AND METHOD FOR PROVIDING A CASCADING SYMBOLS GAME WHICH REUSES DISCARDED SYMBOLS," Ser. No. 13/353,860.

COPYRIGHT NOTICE

A portion of the disclosure of this patent document contains material which is subject to copyright protection. The copyright owner has no objection to the photocopy reproduction of the patent document or the patent disclosure in exactly the form it appears in the Patent and Trademark Office patent file or records, but otherwise reserves all copyright rights whatsoever.

BACKGROUND

Gaming machines which provide players awards in primary or base games are well known. Gaming machines generally require the player to place or make a wager to activate the primary or base game. In many of these gaming machines, the award is based on the player obtaining a winning symbol or symbol combination and on the amount of the wager (e.g., the higher the wager, the higher the award). Generally, symbols or symbol combinations which are less likely to occur provide higher awards. In such known gaming machines, the amount of the wager made on the base game by the player can vary.

Gaming machines which provide cascading symbol or tumbling reel games are also known. In one such cascading symbol or tumbling reel game, a gaming machine generates and displays a plurality of symbols in a symbol display matrix or grid. This symbol display matrix includes a plurality of two-dimensional symbol display positions. Each symbol display position is associated with a specific row and a specific column of the symbol display matrix. In such a cascading symbol game, the gaming machine evaluates the displayed symbols and provides an award for each winning symbol combination formed. The gaming machine then removes and discards the displayed symbols that form the winning combination(s) of symbols to create one or more empty symbol display positions. The gaming machine shifts zero, one, or more of the remaining displayed symbols downward into zero, one, or more of the created empty symbol display positions. If any empty symbol display positions remain, the gaming machine generates and displays a symbol for each remaining empty symbol display position. The gaming machine then reevaluates the displayed symbols and provides an award for any winning symbol combinations formed. If winning symbol combinations continue to be formed, the gaming machine repeats the steps of removing generated symbols of the winning symbol combinations, shifting generated symbols, generating new symbols, and evaluating generated symbols.

There is a continuing need to increase the level of excitement and entertainment for people playing gaming machines. There is also need for new ways of providing better gaming experiences and environments at gaming machines. There is a further need for increasing the number of winning symbol combinations generated and awards provided to a player for a single wager on a play of a game.

SUMMARY

The present disclosure relates generally to gaming systems, gaming devices, and methods for providing a cascading symbol game.

In various embodiments, the gaming system disclosed herein includes a cascading symbol or tumbling reel game which retains, saves or stores zero, one or more of any symbols which are removed during the play of a primary cascading symbols game. In one such embodiment, the gaming system utilizes such removed and retained symbols in one or more plays of one or more secondary games. In this embodiment, the gaming system first generates one or more symbols in a play of the primary cascading symbol game and then further uses such generated (and subsequently removed) symbols in a play of a secondary game to determine one or more awards for the player. In another such embodiment, the gaming system utilizes such removed and retained symbols in a current or subsequent play of the primary cascading symbols game. In this embodiment, the gaming system first generates one or more symbols in a play of the primary cascading symbols game and then further uses such generated (and subsequently removed) symbols in the same play (or another play) of the primary cascading symbols game to determine one or more awards for the player. In these embodiments, rather than discarding any symbols that are removed from any winning symbol combinations (as in certain known cascading symbol games), the gaming system of the present disclosure employs such removed symbols to provide the player one or more additional award opportunities in association with the single generation of such symbols. Accordingly, the gaming system disclosed herein is configured to increase a level of excitement and enjoyment for players by introducing an aspect of reusing one or more symbols into a cascading symbol or tumbling reel game.

In one such embodiment, the gaming system disclosed herein includes reusing any removed symbols to form one or more additional paylines. In another such embodiment, the gaming system disclosed herein includes reusing any removed symbols in a second cascading symbols game. In another such embodiment, the gaming system disclosed herein includes reusing any removed symbols to form one or more target patterns. In another such embodiment, the gaming system disclosed herein includes reusing any removed symbols back into the same symbol display position matrix. In another such embodiment, rather than each generated symbol including a length component and a width component (i.e., a two dimensional tile with a symbol on the face of the tile), each generated symbol also includes a depth component (i.e., a three dimensional shape with individually symbols on each side or face of the three dimensional shape). In this embodiment, one or more retained and reused multiple dimension symbols are potentially evaluated a plurality of times (in association with the single generation of such symbols) to determine any awards to be provided to the player.

The present disclosure further relates generally to gaming systems, gaming devices, and methods for providing a multiple dimension cascading symbol game.

In various embodiments, the gaming system disclosed herein includes a cascading symbol or tumbling reel game which sequentially layers a plurality of adjacent symbol display position grids at different depths. Each symbol display position grid at each depth includes a plurality of columns of symbol display positions and a plurality of rows of symbol display positions. Such a configuration provides that when a plurality of multiple dimension symbols (i.e., a three dimensional shape with individually symbols on each side or face of the three dimensional shape) are generated in the symbol display positions of each of one or more symbol display position grids, one or more of the multiple dimension symbols from the symbol display position grids form one or more multiple dimension symbol display position planes or surfaces. These multiple dimension symbol display position planes or surfaces each include one or more symbol display positions from one or more of the symbol display position grids at one or more depths. For example, if a plurality of symbol display position grids form a cube, from an isometric view, the displayed faces or sides of the multiple dimension symbols (from a plurality of the symbol display position grids at different depths) on the left side of the cube would form one multiple dimension symbol display position plane and the displayed faces or sides of the multiple dimension symbols (from a plurality of the symbol display position grids at different depths) on the top side of the cube would form another multiple dimension symbol display position plane.

In operation of the cascading symbol game of this embodiment, the gaming system generates and displays a plurality of multiple dimension symbols at the plurality of symbol display positions of a first symbol display position grid at a first depth. Following this generation, for each plane or surface of the multiple dimension symbol display position grid displayed to the player that includes at least a designated quantity of displayed or exposed symbols, the gaming system evaluates the symbols displayed on the faces of the multiple dimension symbols associated with that plane or surface. For each of these displayed planes or surfaces of the multiple dimension symbol display position grid, the gaming system removes one or more multiple dimension symbols from any winning symbol combinations and replaces such removed symbols with newly generated multiple dimension symbols.

Following any subsequent removal and replacement of any of the generated multiple dimension symbols of the first symbol display position grid, the gaming system of this embodiment adds a second symbol display position grid of a second depth (having a plurality of generated multiple dimension symbols at a plurality of symbol display positions) to the first symbol display position grid at the first depth. Put differently, the gaming system layers the second symbol display position grid upon the first symbol display position grid. In this embodiment, the layering of a plurality of symbol display position grids causes one or more multiple dimension symbol display position planes or surfaces to include at least one multiple dimension symbol from a plurality of symbol display position grids After adding another symbol display position grid and generating a plurality of multiple dimension symbols in the added symbol display position grid, for each multiple dimension symbol display position plane or surface displayed to the player that includes at least the designated quantity of displayed or exposed symbols, the gaming system evaluates the symbols displayed on the faces of the multiple dimension symbols associated with that plane or surface. Following any removal and replacement of any of the generated multiple dimension symbols which form part of any winning symbol combinations as described above, the gaming system continues sequentially adding or layering each of any remaining symbol display position grids until each of the symbol display position grids have been added together.

Such an arrangement of multiple symbol display position grids at different depths provides that after a plurality of multiple dimension symbols of at least a second symbol display position grid of a second depth has been added to or layered upon the plurality of multiple dimension symbols of at least a first symbol display position grid of a first depth, one or more of the sides or faces of one or more of the generated multiple dimension symbols of at least the second symbol display position grid at a second depth are displayed to a player while one or more of the sides or faces of one or more of the generated multiple dimension symbols of at least the first symbol display position grid at the first depth are no longer displayed to the player (i.e., are blocked by one or more of the generated multiple dimension symbols of the second symbol display position grid at the second depth). This configuration increases the level of excitement and enjoyment for players because at different times during the play of the game, certain symbols will be displayed to the player and certain symbols will be hidden from the player.

Such an arrangement of multiple symbol display position grids at different depths further provides that as additional symbol display grids are added or layered together, one or more additional multiple dimension symbol display position planes or surfaces will include the designated quantity of symbols to cause an evaluation of the symbols exposed on one or more faces or sides of a plurality of multiple dimension symbols which form that multiple dimension symbol display position plane. Such additional multiple dimension symbol display position planes provides an increased quantity of award opportunities for the player. This configuration thus increases the level of excitement and enjoyment for players because as the play of the game progresses, additional award opportunities become available for the player.

Additional features and advantages are described in, and will be apparent from, the following Detailed Description and the figures.

DETAILED DESCRIPTION

The present disclosure may be implemented in various configurations for gaming machines, gaming devices, or gaming systems, including but not limited to: (1) a dedicated gaming machine, gaming device, or gaming system wherein the computerized instructions for controlling any games (which are provided by the gaming machine or gaming device) are provided with the gaming machine or gaming device prior to delivery to a gaming establishment; and (2) a changeable gaming machine, gaming device, or gaming system wherein the computerized instructions for controlling any games (which are provided by the gaming machine or gaming device) are downloadable to the gaming machine or gaming device through a data network after the gaming machine or gaming device is in a gaming establishment. In one embodiment, the computerized instructions for controlling any games are executed by at least one central server, central controller, or remote host. In such a "thin client" embodiment, the central server remotely controls any games (or other suitable interfaces) and the gaming device is utilized to display such games (or suitable interfaces) and receive one or more inputs or commands from a player. In another embodiment, the computerized instructions for controlling any games are communicated from the central server, central controller, or remote host to a gaming device local processor and memory devices. In such a "thick client" embodiment, the gaming device local processor executes the communicated computerized instructions to control any games (or other suitable interfaces) provided to a player.

In one embodiment, one or more gaming devices in a gaming system may be thin client gaming devices and one or more gaming devices in the gaming system may be thick client gaming devices. In another embodiment, certain functions of the gaming device are implemented in a thin client environment and certain other functions of the gaming device are implemented in a thick client environment. In one such embodiment, computerized instructions for controlling any primary games are communicated from the central server to the gaming device in a thick client configuration and computerized instructions for controlling any secondary games or bonus functions are executed by a central server in a thin client configuration.

Figure 1A:
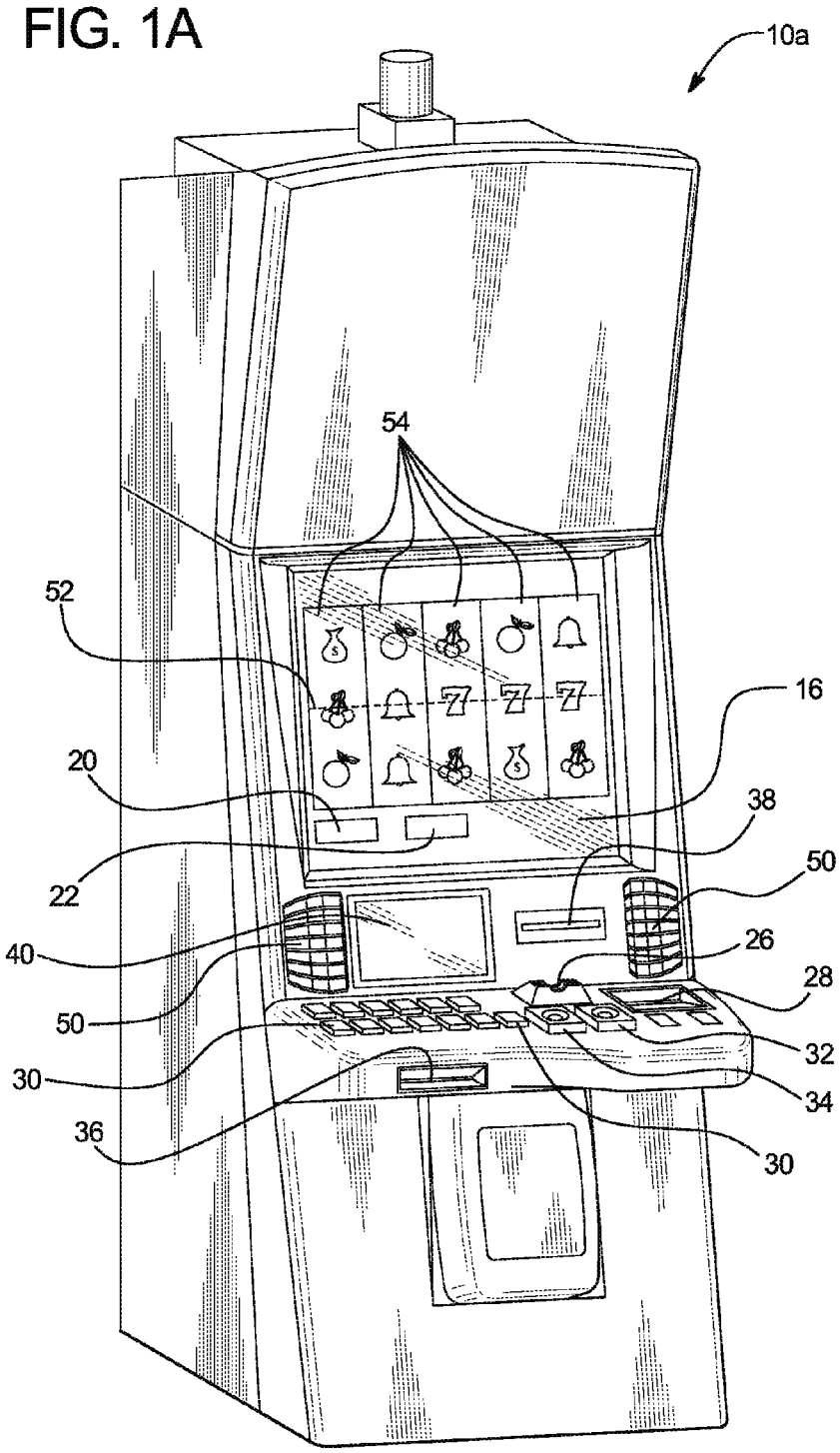
FIGS. 1A and 1B are perspective views of example alternative embodiments of the gaming device of the present disclosure.
Figure 1B:
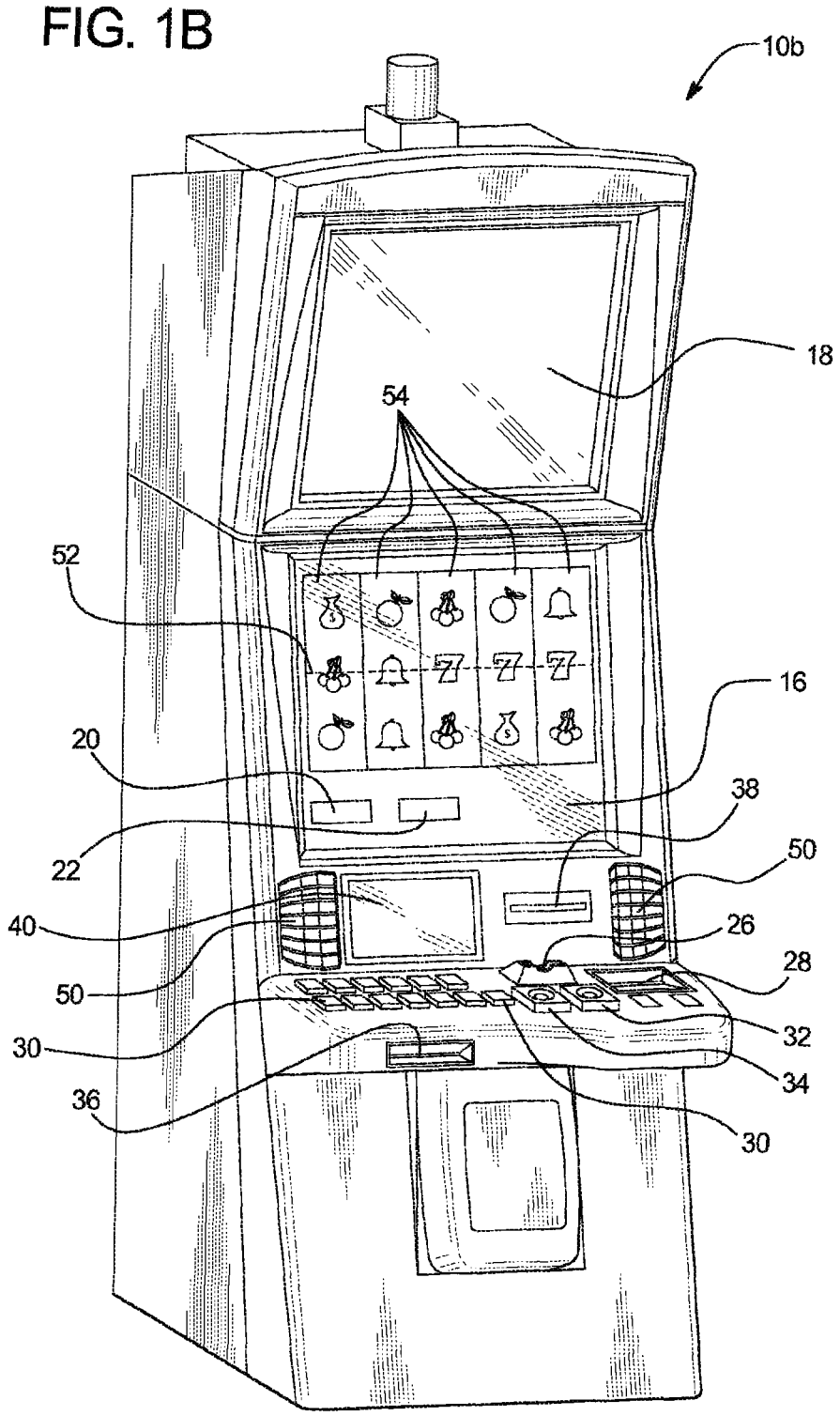

Referring now to the drawings, two example alternative embodiments of a gaming device disclosed herein are illustrated in FIGS. 1A and 1B as gaming device 10*a* and gaming device 10*b*, respectively. Gaming device 10*a* and/or gaming device 10*b* are generally referred to herein as gaming device 10.

In the embodiments illustrated in FIGS. 1A and 1B, gaming device 10 has a support structure, housing, or cabinet which provides support for a plurality of displays, inputs, controls, and other features of a conventional gaming machine. It is configured so that a player can operate it while standing or sitting. The gaming device can be positioned on a base or stand or can be configured as a pub-style table-top game (not shown) which a player can operate preferably while sitting. As illustrated by the different configurations shown in FIGS. 1A and 1B, the gaming device may have varying cabinet and display configurations.

Figure 2A:
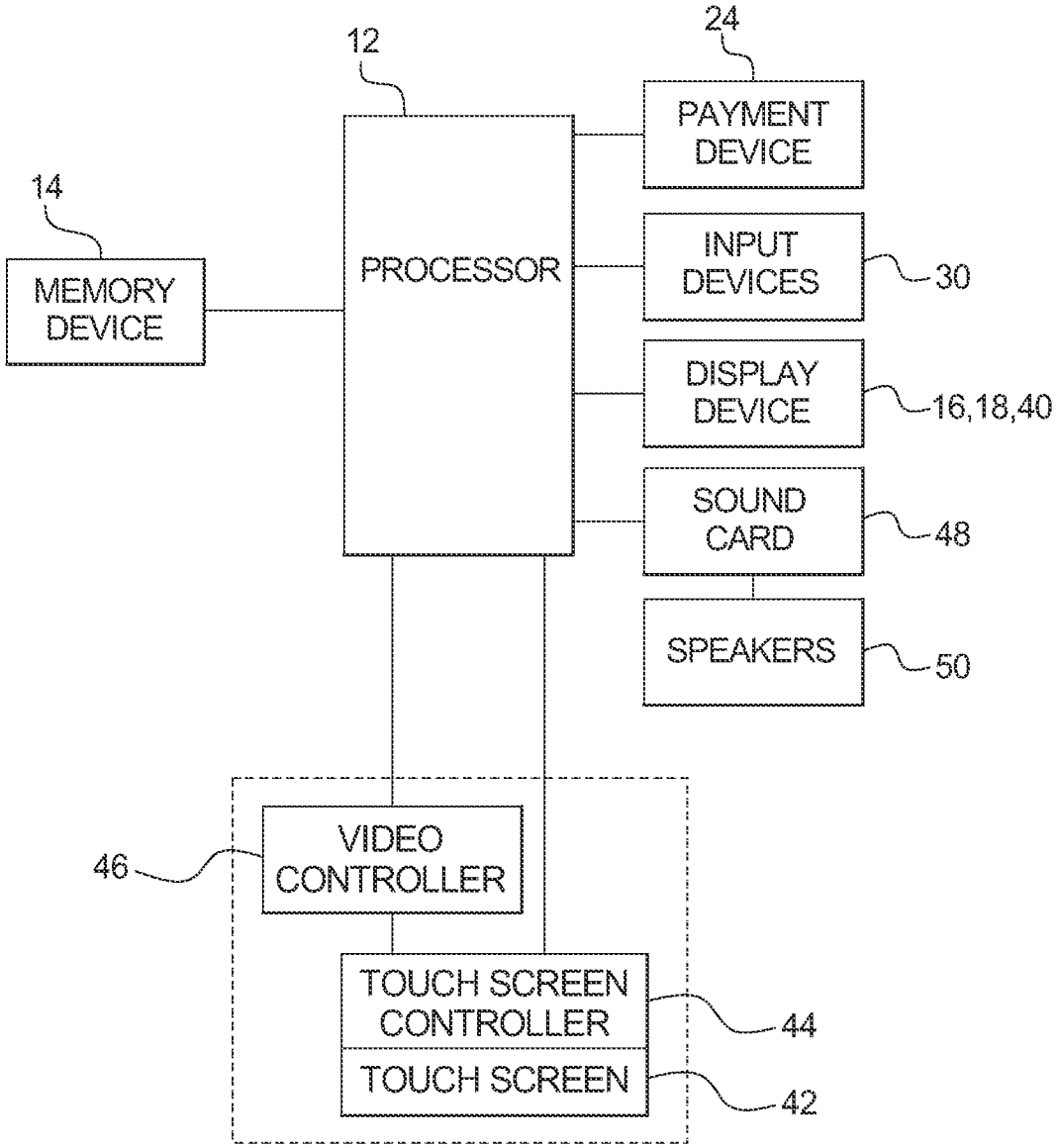
FIG. 2A is a schematic block diagram of one embodiment of an electronic configuration for one of the gaming devices disclosed herein.

In one embodiment, as illustrated in FIG. 2A, the gaming device preferably includes at least one processor 12, such as a microprocessor, a microcontroller-based platform, a suitable integrated circuit or one or more application-specific integrated circuits (ASIC's). The processor is in communication with or operable to access or to exchange signals with at least one data storage or memory device 14. In one embodiment, the processor and the memory device reside within the cabinet of the gaming device. The memory device stores program code and instructions, executable by the processor, to control the gaming device. The memory device also stores other data such as image data, event data, player input data, random or pseudo-random number generators, pay-table data or information, and applicable game rules that relate to the play of the gaming device. In one embodiment, the memory device includes random access memory (RAM), which can include non-volatile RAM (NVRAM), magnetic RAM (MRAM), ferroelectric RAM (FeRAM), and other forms as commonly understood in the gaming industry. In one embodiment, the memory device includes read only memory (ROM). In one embodiment, the memory device includes flash memory and/or EEPROM (electrically erasable programmable read only memory). Any other suitable magnetic, optical, and/or semiconductor memory may operate in conjunction with the gaming device disclosed herein.

In one embodiment, part or all of the program code and/or operating data described above can be stored in a detachable or removable memory device, including, but not limited to, a suitable cartridge, disk, CD ROM, DVD, or USB memory device. In other embodiments, part or all of the program code and/or operating data described above can be downloaded to the memory device through a suitable network.

In one embodiment, an operator or a player can use such a removable memory device in a desktop computer, a laptop computer, a hand-held device, such as a personal digital assistant (PDA), a portable computing or mobile device, or another computerized platform to implement the present disclosure. In one embodiment, the gaming device or gaming machine disclosed herein is operable over a wireless network, for example as part of a wireless gaming system. In one such embodiment, the gaming machine may be a hand-held device, a mobile device, or any other suitable wireless device that enables a player to play any suitable game at a variety of different locations. In various embodiments in which the gaming device or gaming machine is a hand-held device, a mobile device, or any other suitable wireless device, at least one memory device and at least one processor which control the game or other operations of the hand-held device, mobile device, or other suitable wireless device may be located: (a) at the hand-held device, mobile device or other suitable wireless device; (b) at a central server or central controller; or (c) any suitable combination of the central server or central controller and the hand-held device, mobile device or other suitable wireless device. It should be appreciated that a gaming device or gaming machine as disclosed herein may be a device that has obtained approval from a regulatory gaming commission or a device that has not obtained approval from a regulatory gaming commission. It should be appreciated that the processor and memory device may be collectively referred to herein as a "computer" or "controller."

In one embodiment, as discussed in more detail below, the gaming device randomly generates awards and/or other game outcomes based on probability data. In one such embodiment, this random determination is provided through utilization of a random number generator (RNG), such as a true random number generator, a pseudo random number generator, or other suitable randomization process. In one embodiment, each award or other game outcome is associated with a probability and the gaming device generates the award or other game outcome to be provided to the player based on the associated probabilities. In this embodiment, since the gaming device generates outcomes randomly or based upon one or more probability calculations, there is no certainty that the gaming device will ever provide the player with any specific award or other game outcome.

In another embodiment, as discussed in more detail below, the gaming device employs a predetermined or finite set or pool of awards or other game outcomes. In this embodiment, as each award or other game outcome is provided to the player, the gaming device flags or removes the provided award or other game outcome from the predetermined set or pool. Once flagged or removed from the set or pool, the specific provided award or other game outcome from that specific pool cannot be provided to the player again. This type of gaming device provides players with all of the available awards or other game outcomes over the course of the play cycle and guarantees the amount of actual wins and losses.

In another embodiment, as discussed below, upon a player initiating game play at the gaming device, the gaming device enrolls in a bingo game. In this embodiment, a bingo server calls the bingo balls that result in a specific bingo game outcome. The resultant game outcome is communicated to the individual gaming device to be provided to a player. In one embodiment, this bingo outcome is displayed to the player as a bingo game and/or in any form in accordance with the present disclosure.

In one embodiment, as illustrated in FIG. 2A, the gaming device includes one or more display devices controlled by the processor. The display devices are preferably connected to or mounted on the cabinet of the gaming device. The embodiment shown in FIG. 1A includes a central display device 16 which displays a primary game. This display device may also display any suitable secondary game associated with the primary game as well as information relating to the primary or secondary game. The alternative embodiment shown in FIG. 1B includes a central display device 16 and an upper display device 18. The upper display device may display the primary game, any suitable secondary game associated or not associated with the primary game and/or information relating to the primary or secondary game. These display devices may also serve as digital glass operable to advertise games or other aspects of the gaming establishment. As seen in FIGS. 1A and 1B, in one embodiment, the gaming device includes a credit display 20 which displays a player's current number of credits, cash, account balance, or the equivalent. In one embodiment, the gaming device includes a bet display 22 which displays a player's amount wagered. In one embodiment, as described in more detail below, the gaming device includes a player tracking display 40 which displays information regarding a player's play tracking status.

In another embodiment, at least one display device may be a mobile display device, such as a PDA or tablet PC, that enables play of at least a portion of the primary or secondary game at a location remote from the gaming device.

The display devices may include, without limitation, a monitor, a television display, a plasma display, a liquid crystal display (LCD) a display based on light emitting diodes (LEDs), a display based on a plurality of organic light-emitting diodes (OLEDs), a display based on polymer light-emitting diodes (PLEDs), a display based on a plurality of surface-conduction electron-emitters (SEDs), a display including a projected and/or reflected image, or any other suitable electronic device or display mechanism. In one embodiment, as described in more detail below, the display device includes a touch-screen with an associated touch-screen controller. The display devices may be of any suitable size and configuration, such as a square, a rectangle or an elongated rectangle.

The display devices of the gaming device are configured to display at least one and preferably a plurality of game or other suitable images, symbols and indicia such as any visual representation or exhibition of the movement of objects such as mechanical, virtual, or video reels and wheels, dynamic lighting, video images, images of people, characters, places, things, faces of cards, and the like.

In one alternative embodiment, the symbols, images and indicia displayed on or of the display device may be in mechanical form. That is, the display device may include any electromechanical device, such as one or more mechanical objects, such as one or more rotatable wheels, reels, or dice, configured to display at least one or a plurality of game or other suitable images, symbols or indicia.

As illustrated in FIG. 2A, in one embodiment, the gaming device includes at least one payment device 24 in communication with the processor. As seen in FIGS. 1A and 1B, a payment device such as a payment acceptor includes a note, ticket or bill acceptor 28 wherein the player inserts paper money, a ticket, or voucher and a coin slot 26 where the player inserts money, coins, or tokens. In other embodiments, payment devices such as readers or validators for credit cards, debit cards or credit slips may accept payment. In one embodiment, a player may insert an identification card into a card reader of the gaming device. In one embodiment, the identification card is a smart card having a programmed microchip, a coded magnetic strip or coded rewritable magnetic strip, wherein the programmed microchip or magnetic strips are coded with a player's identification, credit totals (or related data), and/or other relevant information. In another embodiment, a player may carry a portable device, such as a cell phone, a radio frequency identification tag, or any other suitable wireless device, which communicates a player's identification, credit totals (or related data), and other relevant information to the gaming device. In one embodiment, money may be transferred to a gaming device through electronic funds transfer. When a player funds the gaming device, the processor determines the amount of funds entered and displays the corresponding amount on the credit or other suitable display as described above.

As seen in FIGS. 1A, 1B, and 2A, in one embodiment the gaming device includes at least one and preferably a plurality of input devices 30 in communication with the processor. The input devices can include any suitable device which enables the player to produce an input signal which is received by the processor. In one embodiment, after appropriate funding of the gaming device, the input device is a game activation device, such as a play button 32 or a pull arm (not shown) which is used by the player to start any primary game or sequence of events in the gaming device. The play button can be any suitable play activator such as a bet one button, a max bet button, or a repeat the bet button. In one embodiment, upon appropriate funding, the gaming device begins the game play automatically. In another embodiment, upon the player engaging one of the play buttons, the gaming device automatically activates game play.

In one embodiment, one input device is a bet one button. The player places a bet by pushing the bet one button. The player can increase the bet by one credit each time the player pushes the bet one button. When the player pushes the bet one button, the number of credits shown in the credit display preferably decreases by one, and the number of credits shown in the bet display preferably increases by one. In another embodiment, one input device is a bet max button (not shown) which enables the player to bet the maximum wager permitted for a game of the gaming device.

In one embodiment, one input device is a cash out button 34. The player may push the cash out button and cash out to receive a cash payment or other suitable form of payment corresponding to the number of remaining credits. In one embodiment, when the player cashes out, a payment device, such as a ticket, payment, or note generator 36 prints or otherwise generates a ticket or credit slip to provide to the player. The player receives the ticket or credit slip and may redeem the value associated with the ticket or credit slip via a cashier (or other suitable redemption system). In another embodiment, when the player cashes out, the player receives the coins or tokens in a coin payout tray. It should be appreciated that any suitable payout mechanisms, such as funding to the player's electronically recordable identification card or smart card, may be implemented in accordance with the gaming device disclosed herein.

In one embodiment, as mentioned above and as seen in FIG. 2A, one input device is a touch-screen 42 coupled with a touch-screen controller 44 or some other touch-sensitive display overlay to allow for player interaction with the images on the display. The touch-screen and the touch-screen controller are connected to a video controller 46. A player can make decisions and input signals into the gaming device by touching the touch-screen at the appropriate locations. One such input device is a conventional touch-screen button panel.

The gaming device may further include a plurality of communication ports for enabling communication of the processor with external peripherals, such as external video sources, expansion buses, game or other displays, a SCSI port, or a keypad.

In one embodiment, as seen in FIG. 2A, the gaming device includes a sound generating device controlled by one or more sounds cards 48 which function in conjunction with the processor. In one embodiment, the sound generating device includes at least one and preferably a plurality of speakers 50 or other sound generating hardware and/or software for generating sounds, such as by playing music for the primary and/or secondary game or by playing music for other modes of the gaming device, such as an attract mode. In one embodiment, the gaming device provides dynamic sounds coupled with attractive multimedia images displayed on one or more of the display devices to provide an audio-visual representation or to otherwise display full-motion video with sound to attract players to the gaming device. During idle periods, the gaming device may display a sequence of audio and/or visual attraction messages to attract potential players to the gaming device. The videos may also be customized to provide any appropriate information.

In one embodiment, the gaming machine may include a sensor, such as a camera, in communication with the processor (and possibly controlled by the processor), that is selectively positioned to acquire an image of a player actively using the gaming device and/or the surrounding area of the gaming device. In one embodiment, the camera may be configured to selectively acquire still or moving (e.g., video) images and may be configured to acquire the images in an analog, digital, or other suitable format. The display devices may be configured to display the image acquired by the camera as well as to display the visible manifestation of the game in split screen or picture-in-picture fashion. For example, the camera may acquire an image of the player and the processor may incorporate that image into the primary and/or secondary game as a game image, symbol or indicia.

Gaming device 10 can incorporate any suitable wagering game as the primary or base game. The gaming machine or device may include some or all of the features of conventional gaming machines or devices. The primary or base game may comprise any suitable reel-type game, card game, cascading or falling symbol game, number game, or other game of chance susceptible to representation in an electronic or electromechanical form, which in one embodiment produces a random outcome based on probability data at the time of or after placement of a wager. That is, different primary wagering games, such as video poker games, video blackjack games, video keno, video bingo or any other suitable primary or base game may be implemented. In one embodiment, the disclosed multi-dimensional cascading symbol game is implemented as a base or primary game.

In one embodiment, as illustrated in FIGS. 1A and 1B, a base or primary game may be a slot game with one or more paylines 52. In this embodiment, the gaming device includes at least one and preferably a plurality of reels 54, such as three to five reels 54, in either electromechanical form with mechanical rotating reels or video form with simulated reels and movement thereof. Each reel includes one or more symbol display positions. In one embodiment, an electromechanical slot machine includes a plurality of adjacent, rotatable reels which may be combined and operably coupled with an electronic display of any suitable type. In another embodiment, if the reels 54 are in video form, one or more of the display devices, as described above, displays the plurality of simulated video reels 54. Each reel 54 displays a plurality of indicia or symbols, such as bells, hearts, fruits, numbers, letters, bars, or other images which preferably correspond to a theme associated with the gaming device. In another embodiment, one or more of the reels are independent reels or unisymbol reels. In this embodiment, each independent or unisymbol reel generates and displays one symbol to the player.

In one embodiment, one or more of the paylines may be horizontal, vertical, circular, diagonal, angled or any combination thereof. In another embodiment, one or more of the paylines each include a plurality of adjacent symbol display positions on a requisite number of adjacent reels. In one such embodiment, one or more paylines are formed between at least two symbol display positions which are adjacent to each other by either sharing a common side or sharing a common corner (i.e., such paylines are connected paylines). In these embodiments, the gaming device enables a player to wager on one or more of such paylines to activate such wagered on paylines.

In another embodiment wherein one or more paylines are formed between at least two symbol display positions which are adjacent to each other, the gaming device enables a player to wager on and thus activate a plurality of symbol display positions. In this embodiment, one or more paylines which are formed from a plurality of adjacent active symbol display positions on a requisite number of adjacent reels are activated.

In one embodiment, the gaming device awards prizes after the reels of the primary game stop spinning if specified types and/or configurations of indicia or symbols occur on an active payline or otherwise occur in a winning pattern, occur on the requisite number of adjacent reels and/or occur in a scatter pay arrangement.

In an alternative embodiment, rather than determining any outcome to provide to the player by analyzing the symbols generated on any wagered upon paylines as described above, the gaming device determines any outcome to provide to the player based on the number of associated symbols which are generated in active symbol display positions on the requisite number of adjacent reels (i.e., not on paylines passing through any displayed winning symbol combinations). In this embodiment, if a winning symbol combination is generated on the reels, the gaming device provides the player one award for that occurrence of the generated winning symbol combination. For example, if one winning symbol combination is generated on the reels, the gaming device will provide a single award to the player for that winning symbol combination (i.e., not based on the number of paylines that would have passed through that winning symbol combination). It should be appreciated that because a gaming device that enables wagering on ways to win provides the player one award for a single occurrence of a winning symbol combination and a gaming device with paylines may provide the player more than one award for the same occurrence of a single winning symbol combination (i.e., if a plurality of paylines each pass through the same winning symbol combination), it is possible to provide a player at a ways to win gaming device with more ways to win for an equivalent bet or wager on a traditional slot gaming device with paylines.

In one embodiment, the total number of ways to win is determined by multiplying the number of symbols generated in active symbol display positions on a first reel by the number of symbols generated in active symbol display positions on a second reel by the number of symbols generated in active symbol display positions on a third reel and so on for each reel of the gaming device with at least one symbol generated in an active symbol display position. For example, a three reel gaming device with three symbols generated in active symbol display positions on each reel includes 27 ways to win (i.e., 3 symbols on the first reel×3 symbols on the second reel×3 symbols on the third reel). A four reel gaming device with three symbols generated in active symbol display positions on each reel includes 81 ways to win (i.e., 3 symbols on the first reel×3 symbols on the second reel×3 symbols on the third reel×3 symbols on the fourth reel). A five reel gaming device with three symbols generated in active symbol display positions on each reel includes 243 ways to win (i.e., 3 symbols on the first reel×3 symbols on the second reel×3 symbols on the third reel×3 symbols on the fourth reel×3 symbols on the fifth reel). It should be appreciated that modifying the number of generated symbols by either modifying the number of reels or modifying the number of symbols generated in active symbol display positions by one or more of the reels modifies the number of ways to win.

In another embodiment, the gaming device enables a player to wager on and thus activate symbol display positions. In one such embodiment, the symbol display positions are on the reels. In this embodiment, if based on the player's wager, a reel is activated, then each of the symbol display positions of that reel will be activated and each of the active symbol display positions will be part of one or more of the ways to win. In one embodiment, if based on the player's wager, a reel is not activated, then a designated number of default symbol display positions, such as a single symbol display position of the middle row of the reel, will be activated and the default symbol display position(s) will be part of one or more of the ways to win. This type of gaming machine enables a player to wager on one, more than one or all of the reels and the processor of the gaming device uses the number of wagered on reels to determine the active symbol display positions and the number of possible ways to win. In alternative embodiments, (1) no symbols are displayed as generated at any of the inactive symbol display positions, or (2) any symbols generated at any inactive symbol display positions may be displayed to the player but suitably shaded or otherwise designated as inactive.

In one embodiment wherein a player wagers on one or more reels, a player's wager of one credit may activate each of the three symbol display positions on a first reel, wherein one default symbol display position is activated on each of the remaining four reels. In this example, as described above, the gaming device provides the player three ways to win (i.e., 3 symbols on the first reel×1 symbol on the second reel×1 symbol on the third reel×1 symbol on the fourth reel×1 symbol on the fifth reel). In another example, a player's wager of nine credits may activate each of the three symbol display positions on a first reel, each of the three symbol display positions on a second reel and each of the three symbol display positions on a third reel wherein one default symbol display position is activated on each of the remaining two reels. In this example, as described above, the gaming device provides the player twenty-seven ways to win (i.e., 3 symbols on the first reel×3 symbols on the second reel×3 symbols on the third reel×1 symbol on the fourth reel×1 symbol on the fifth reel).

In one embodiment, to determine any award(s) to provide to the player based on the generated symbols, the gaming device individually determines if a symbol generated in an active symbol display position on a first reel forms part of a winning symbol combination with or is otherwise suitably related to a symbol generated in an active symbol display position on a second reel. In this embodiment, the gaming device classifies each pair of symbols which form part of a winning symbol combination (i.e., each pair of related symbols) as a string of related symbols. For example, if active symbol display positions include a first cherry symbol generated in the top row of a first reel and a second cherry symbol generated in the bottom row of a second reel, the gaming device classifies the two cherry symbols as a string of related symbols because the two cherry symbols form part of a winning symbol combination.

After determining if any strings of related symbols are formed between the symbols on the first reel and the symbols on the second reel, the gaming device determines if any of the symbols from the next adjacent reel should be added to any of the formed strings of related symbols. In this embodiment, for a first of the classified strings of related symbols, the gaming device determines if any of the symbols generated by the next adjacent reel form part of a winning symbol combination or are otherwise related to the symbols of the first string of related symbols. If the gaming device determines that a symbol generated on the next adjacent reel is related to the symbols of the first string of related symbols, that symbol is subsequently added to the first string of related symbols. For example, if the first string of related symbols is the string of related cherry symbols and a related cherry symbol is generated in the middle row of the third reel, the gaming device adds the related cherry symbol generated on the third reel to the previously classified string of cherry symbols.

On the other hand, if the gaming device determines that no symbols generated on the next adjacent reel are related to the symbols of the first string of related symbols, the gaming device marks or flags such string of related symbols as complete. For example, if the first string of related symbols is the string of related cherry symbols and none of the symbols of the third reel are related to the cherry symbols of the previously classified string of cherry symbols, the gaming device marks or flags the string of two cherry symbols as complete.

After either adding a related symbol to the first string of related symbols or marking the first string of related symbols as complete, the gaming device proceeds as described above for each of the remaining classified strings of related symbols which were previously classified or formed from related symbols on the first and second reels.

After analyzing each of the remaining strings of related symbols, the gaming device determines, for each remaining pending or incomplete string of related symbols, if any of the symbols from the next adjacent reel, if any, should be added to any of the previously classified strings of related symbols. This process continues until either each string of related symbols is complete or there are no more adjacent reels of symbols to analyze. In this embodiment, where there are no more adjacent reels of symbols to analyze, the gaming device marks each of the remaining pending strings of related symbols as complete.

When each of the strings of related symbols is marked complete, the gaming device compares each of the strings of related symbols to an appropriate paytable and provides the player any award associated with each of the completed strings of symbols. It should be appreciated that the player is provided one award, if any, for each string of related symbols generated in active symbol display positions (i.e., as opposed to a quantity of awards being based on how many paylines that would have passed through each of the strings of related symbols in active symbol display positions).

In one embodiment, a base or primary game may be a poker game wherein the gaming device enables the player to play a conventional game of video draw poker and initially deals five cards all face up from a virtual deck of fifty-two cards. Cards may be dealt as in a traditional game of cards or in the case of the gaming device, the cards may be randomly selected from a predetermined number of cards. If the player wishes to draw, the player selects the cards to hold via one or more input devices, such as by pressing related hold buttons or via the touch screen. The player then presses the deal button and the unwanted or discarded cards are removed from the display and the gaming machine deals the replacement cards from the remaining cards in the deck. This results in a final five-card hand. The gaming device compares the final five-card hand to a payout table which utilizes conventional poker hand rankings to determine the winning hands. The gaming device provides the player with an award based on a winning hand and the number of credits the player wagered.

In another embodiment, the base or primary game may be a multi-hand version of video poker. In this embodiment, the gaming device deals the player at least two hands of cards. In one such embodiment, the cards are the same cards. In one embodiment each hand of cards is associated with its own deck of cards. The player chooses the cards to hold in a primary hand. The held cards in the primary hand are also held in the other hands of cards. The remaining non-held cards are removed from each hand displayed and for each hand replacement cards are randomly dealt into that hand. Since the replacement cards are randomly dealt independently for each hand, the replacement cards for each hand will usually be different. The poker hand rankings are then determined hand by hand against a payout table and awards are provided to the player.

In one embodiment, a base or primary game may be a keno game wherein the gaming device displays a plurality of selectable indicia or numbers on at least one of the display devices. In this embodiment, the player selects at least one bit potentially a plurality of the selectable indicia or numbers via an input device such as a touch screen. The gaming device then displays a series of drawn numbers and determine an amount of matches, if any, between the player's selected numbers and the gaming device's drawn numbers. The player is provided an award based on the amount of matches, if any, based on the amount of determined matches and the number of numbers drawn.

In one embodiment, in addition to winning credits or other awards in a base or primary game, the gaming device may also give players the opportunity to win credits in a bonus or secondary game or in a bonus or secondary round. In one embodiment, the disclosed multi-dimensional cascading symbol game is implemented as a bonus or secondary game. The bonus or secondary game enables the player to obtain a prize or payout in addition to the prize or payout, if any, obtained from the base or primary game. In general, a bonus or secondary game produces a significantly higher level of player excitement than the base or primary game because it provides a greater expectation of winning than the base or primary game, and is accompanied with more attractive or unusual features than the base or primary game. In one embodiment, the bonus or secondary game may be any type of suitable game, either similar to or completely different from the base or primary game.

In one embodiment, the triggering event or qualifying condition may be a selected outcome in the primary game or a particular arrangement of one or more indicia on a display device in the primary game, such as the number seven appearing on three adjacent reels along a payline in the primary slot game embodiment seen in FIGS. 1A and 1B. In other embodiments, the triggering event or qualifying condition occurs based on exceeding a certain amount of game play (such as number of games, number of credits, amount of time), or reaching a specified number of points earned during game play.

In another embodiment, the gaming device processor 12 or central controller 56 randomly provides the player one or more plays of one or more secondary games. In one such embodiment, the gaming device does not provide any apparent reason to the player for qualifying to play a secondary or bonus game. In this embodiment, qualifying for a bonus game is not triggered by an event in or based specifically on any of the plays of any primary game. That is, the gaming device may simply qualify a player to play a secondary game without any explanation or alternatively with simple explanations. In another embodiment, the gaming device (or central server) qualifies a player for a secondary game at least partially based on a game triggered or symbol triggered event, such as at least partially based on the play of a primary game.

In one embodiment, the gaming device includes a program which will automatically begin a bonus round after the player has achieved a triggering event or qualifying condition in the base or primary game. In another embodiment, after a player has qualified for a bonus game, the player may subsequently enhance his/her bonus game participation through continued play on the base or primary game. Thus, for each bonus qualifying event, such as a bonus symbol, that the player obtains, a given number of bonus game wagering points or credits may be accumulated in a "bonus meter" programmed to accrue the bonus wagering credits or entries toward eventual participation in a bonus game. The occurrence of multiple such bonus qualifying events in the primary game may result in an arithmetic or exponential increase in the number of bonus wagering credits awarded. In one embodiment, the player may redeem extra bonus wagering credits during the bonus game to extend play of the bonus game.

In one embodiment, no separate entry fee or buy-in for a bonus game is needed. That is, a player may not purchase entry into a bonus game; rather they must win or earn entry through play of the primary game, thus encouraging play of the primary game. In another embodiment, qualification of the bonus or secondary game is accomplished through a simple "buy-in" by the player—for example, if the player has been unsuccessful at qualifying through other specified activities. In another embodiment, the player must make a separate side-wager on the bonus game or wager a designated amount in the primary game to qualify for the secondary game. In this embodiment, the secondary game triggering event must occur and the side-wager (or designated primary game wager amount) must have been placed to trigger the secondary game.

Figure 2B:
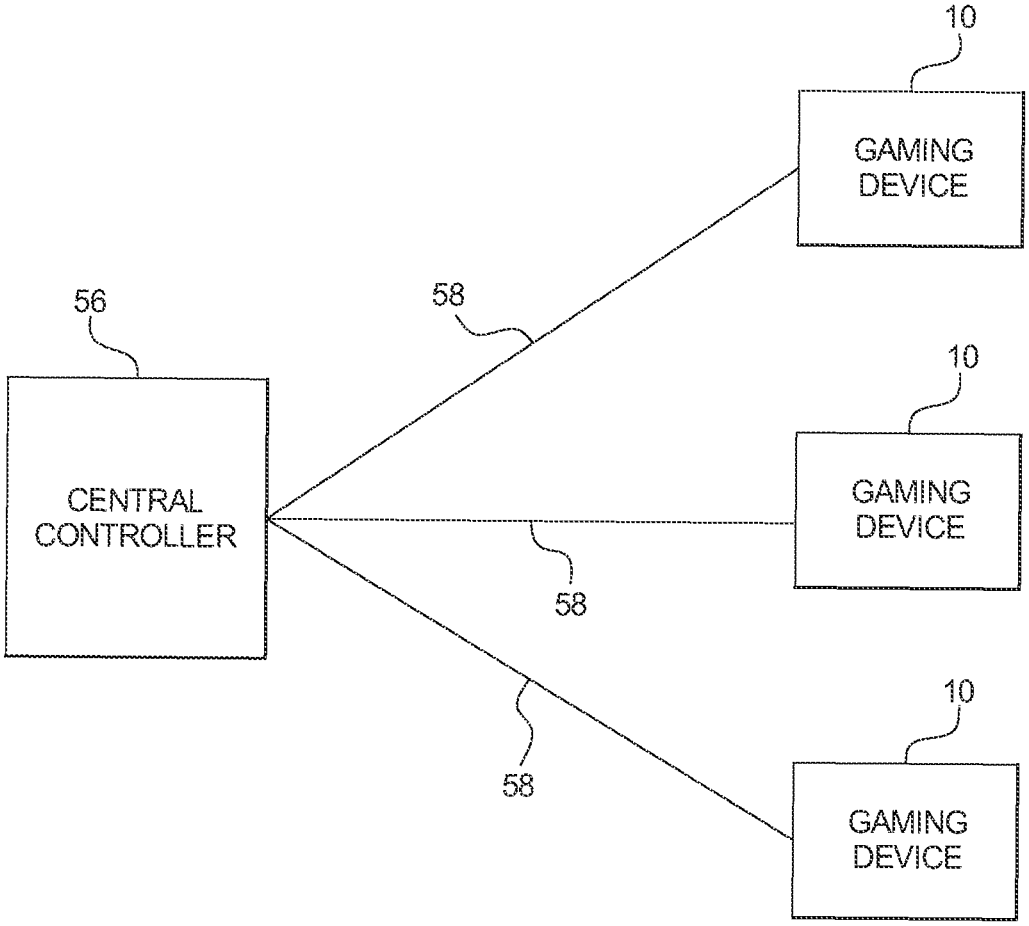
FIG. 2B is a schematic block diagram of one embodiment of a network configuration for a plurality of gaming devices disclosed herein.

In one embodiment, as illustrated in FIG. 2B, one or more of the gaming devices 10 are in communication with each other and/or at least one central controller 56 through a data network or remote communication link 58. In this embodiment, the central server, central controller or remote host is any suitable server or computing device which includes at least one processor and at least one memory or storage device. In different such embodiments, the central server is a progressive controller or a processor of one of the gaming devices in the gaming system. In these embodiments, the processor of each gaming device is designed to transmit and receive events, messages, commands, or any other suitable data or signal between the individual gaming device and the central server. The gaming device processor is operable to execute such communicated events, messages, or commands in conjunction with the operation of the gaming device. Moreover, the processor of the central server is designed to transmit and receive events, messages, commands, or any other suitable data or signal between the central server and each of the individual gaming devices. The central server processor is operable to execute such communicated events, messages, or commands in conjunction with the operation of the central server. It should be appreciated that one, more or each of the functions of the central controller, central server or remote host as disclosed herein may be performed by one or more gaming device processors. It should be further appreciated that one, more or each of the functions of one or more gaming device processors as disclosed herein may be performed by the central controller, central server or remote host.

In one embodiment, the game outcome provided to the player is determined by a central server or controller and provided to the player at the gaming device. In this embodiment, each of a plurality of such gaming devices are in communication with the central server or controller. Upon a player initiating game play at one of the gaming devices, the initiated gaming device communicates a game outcome request to the central server or controller.

In one embodiment, the central server or controller receives the game outcome request and randomly generates a game outcome for the primary game based on probability data. In another embodiment, the central server or controller randomly generates a game outcome for the secondary game based on probability data. In another embodiment, the central server or controller randomly generates a game outcome for both the primary game and the secondary game based on probability data. In this embodiment, the central server or controller is capable of storing and utilizing program code or other data similar to the processor and memory device of the gaming device.

In an alternative embodiment, the central server or controller maintains one or more predetermined pools or sets of predetermined game outcomes. In this embodiment, the central server or controller receives the game outcome request and independently selects a predetermined game outcome from a set or pool of game outcomes. The central server or controller flags or marks the selected game outcome as used. Once a game outcome is flagged as used, it is prevented from further selection from the set or pool and cannot be selected by the central controller or server upon another wager. The provided game outcome can include a primary game outcome, a secondary game outcome, primary and secondary game outcomes, or a series of game outcomes such as free games.

The central server or controller communicates the generated or selected game outcome to the initiated gaming device. The gaming device receives the generated or selected game outcome and provides the game outcome to the player. In an alternative embodiment, how the generated or selected game outcome is to be presented or displayed to the player, such as a reel symbol combination of a slot machine or a hand of cards dealt in a card game, is also determined by the central server or controller and communicated to the initiated gaming device to be presented or displayed to the player. Central production or control can assist a gaming establishment or other entity in maintaining appropriate records, controlling gaming, reducing and preventing cheating or electronic or other errors, reducing or eliminating win-loss volatility, and the like.

In another embodiment, a predetermined game outcome value is determined for each of a plurality of linked or networked gaming devices based on the results of a bingo, keno, or lottery game. In this embodiment, each individual gaming device utilizes one or more bingo, keno, or lottery games to determine the predetermined game outcome value provided to the player for the interactive game played at that gaming device. In one embodiment, the bingo, keno, or lottery game is displayed to the player. In another embodiment, the bingo, keno or lottery game is not displayed to the player, but the results of the bingo, keno, or lottery game determine the predetermined game outcome value for the primary or secondary game.

In the various bingo embodiments, as each gaming device is enrolled in the bingo game, such as upon an appropriate wager or engaging an input device, the enrolled gaming device is provided or associated with a different bingo card. Each bingo card consists of a matrix or array of elements, wherein each element is designated with a separate indicia, such as a number. It should be appreciated that each different bingo card includes a different combination of elements. For example, if four bingo cards are provided to four enrolled gaming devices, the same element may be present on all four of the bingo cards while another element may solely be present on one of the bingo cards.

In operation of these embodiments, upon providing or associating a different bingo card with each of a plurality of enrolled gaming devices, the central controller randomly selects or draws, one at a time, a plurality of the elements. As each element is selected, a determination is made for each gaming device as to whether the selected element is present on the bingo card provided to that enrolled gaming device. This determination can be made by the central controller, the gaming device, a combination of the two, or in any other suitable manner. If the selected element is present on the bingo card provided to that enrolled gaming device, that selected element on the provided bingo card is marked or flagged. This process of selecting elements and marking any selected elements on the provided bingo cards continues until one or more predetermined patterns are marked on one or more of the provided bingo cards. It should be appreciated that in one embodiment, the gaming device requires the player to engage a daub button (not shown) to initiate the process of the gaming device marking or flagging any selected elements.

After one or more predetermined patterns are marked on one or more of the provided bingo cards, a game outcome is determined for each of the enrolled gaming devices based, at least in part, on the selected elements on the provided bingo cards. As described above, the game outcome determined for each gaming device enrolled in the bingo game is utilized by that gaming device to determine the predetermined game outcome provided to the player. For example, a first gaming device to have selected elements marked in a predetermined pattern is provided a first outcome of win $10 which will be provided to a first player regardless of how the first player plays in a first game, and a second gaming device to have selected elements marked in a different predetermined pattern is provided a second outcome of win $2 which will be provided to a second player regardless of how the second player plays a second game. It should be appreciated that as the process of marking selected elements continues until one or more predetermined patterns are marked, this embodiment ensures that at least one bingo card will win the bingo game and thus at least one enrolled gaming device will provide a predetermined winning game outcome to a player. It should be appreciated that other suitable methods for selecting or determining one or more predetermined game outcomes may be employed.

In one example of the above-described embodiment, the predetermined game outcome may be based on a supplemental award in addition to any award provided for winning the bingo game as described above. In this embodiment, if one or more elements are marked in supplemental patterns within a designated number of drawn elements, a supplemental or intermittent award or value associated with the marked supplemental pattern is provided to the player as part of the predetermined game outcome. For example, if the four corners of a bingo card are marked within the first twenty selected elements, a supplemental award of $10 is provided to the player as part of the predetermined game outcome. It should be appreciated that in this embodiment, the player of a gaming device may be provided a supplemental or intermittent award regardless of whether the enrolled gaming device's provided bingo card wins or does not win the bingo game as described above.

In another embodiment, one or more of the gaming devices are in communication with a central server or controller for monitoring purposes only. That is, each individual gaming device randomly generates the game outcomes to be provided to the player and the central server or controller monitors the activities and events occurring on the plurality of gaming devices. In one embodiment, the gaming network includes a real-time or on-line accounting and gaming information system operably coupled to the central server or controller. The accounting and gaming information system of this embodiment includes a player database for storing player profiles, a player tracking module for tracking players and a credit system for providing automated casino transactions.

In one embodiment, the gaming device disclosed herein is associated with or otherwise integrated with one or more player tracking systems. Player tracking systems enable gaming establishments to recognize the value of customer loyalty through identifying frequent customers and rewarding them for their patronage. In one embodiment, the gaming device and/or player tracking system tracks any player's gaming activity at the gaming device. In one such embodiment, the gaming device includes at least one card reader 38 in communication with the processor. In this embodiment, a player is issued a player identification card which has an encoded player identification number that uniquely identifies the player. When a player inserts their playing tracking card into the card reader to begin a gaming session, the card reader reads the player identification number off the player tracking card to identify the player. The gaming device and/or associated player tracking system timely tracks any suitable information or data relating to the identified player's gaming session. Directly or via the central controller, the gaming device processor communicates such information to the player tracking system. The gaming device and/or associated player tracking system also timely tracks when a player removes their player tracking card when concluding play for that gaming session. In another embodiment, rather than requiring a player to insert a player tracking card, the gaming device utilizes one or more portable devices carried by a player, such as a cell phone, a radio frequency identification tag or any other suitable wireless device to track when a player begins and ends a gaming session. In another embodiment, the gaming device utilizes any suitable biometric technology or ticket technology to track when a player begins and ends a gaming session.

During one or more gaming sessions, the gaming device and/or player tracking system tracks any suitable information or data, such as any amounts wagered, average wager amounts, and/or the time at which these wagers are placed. In different embodiments, for one or more players, the player tracking system includes the player's account number, the player's card number, the player's first name, the player's surname, the player's preferred name, the player's player tracking ranking, any promotion status associated with the player's player tracking card, the player's address, the player's birthday, the player's anniversary, the player's recent gaming sessions, or any other suitable data. In one embodiment, such tracked information and/or any suitable feature associated with the player tracking system is displayed on a player tracking display 40. In another embodiment, such tracked information and/or any suitable feature associated with the player tracking system is displayed via one or more service windows (not shown) which are displayed on the central display device and/or the upper display device.

In one embodiment, a plurality of the gaming devices are capable of being connected together through a data network. In one embodiment, the data network is a local area network (LAN), in which one or more of the gaming devices are substantially proximate to each other and an on-site central server or controller as in, for example, a gaming establishment or a portion of a gaming establishment. In another embodiment, the data network is a wide area network (WAN) in which one or more of the gaming devices are in communication with at least one off-site central server or controller. In this embodiment, the plurality of gaming devices may be located in a different part of the gaming establishment or within a different gaming establishment than the off-site central server or controller. Thus, the WAN may include an off-site central server or controller and an off-site gaming device located within gaming establishments in the same geographic area, such as a city or state. The WAN gaming system may be substantially identical to the LAN gaming system described above, although the number of gaming devices in each system may vary relative to one another.

In another embodiment, the data network is an internet or intranet. In this embodiment, the operation of the gaming device can be viewed at the gaming device with at least one internet browser. In this embodiment, operation of the gaming device and accumulation of credits may be accomplished with only a connection to the central server or controller (the internet/intranet server) through a conventional phone or other data transmission line, digital subscriber line (DSL), T-1 line, coaxial cable, fiber optic cable, or other suitable connection. In this embodiment, players may access an internet game page from any location where an internet connection and computer or other internet facilitator is available. The expansion in the number of computers and number and speed of internet connections in recent years increases opportunities for players to play from an ever-increasing number of remote sites. It should be appreciated that the enhanced bandwidth of digital wireless communications may render such technology suitable for some or all communications, particularly if such communications are encrypted. Higher data transmission speeds may be useful for enhancing the sophistication and response of the display and interaction with the player.

As mentioned above, in one embodiment, the present disclosure may be employed in a server-based gaming system. In one such embodiment, as described above, one or more gaming devices are in communication with a central server or controller. The central server or controller may be any suitable server or computing device which includes at least one processor and a memory or storage device. In alternative embodiments, the central server is a progressive controller or another gaming machine in the gaming system. In one embodiment, the memory device of the central server stores different game programs and instructions, executable by a gaming device processor, to control the gaming device. Each executable game program represents a different game or type of game which may be played on one or more of the gaming devices in the gaming system. Such different games may include the same or substantially the same game play with different pay tables. In different embodiments, the executable game program is for a primary game, a secondary game or both. In another embodiment, the game program may be executable as a secondary game to be played simultaneous with the play of a primary game (which may be downloaded to or fixed on the gaming device) or vice versa.

In this embodiment, each gaming device at least includes one or more display devices and/or one or more input devices for interaction with a player. A local processor, such as the above-described gaming device processor or a processor of a local server, is operable with the display device(s) and/or the input device(s) of one or more of the gaming devices.

In operation, the central controller is operable to communicate one or more of the stored game programs to at least one local processor. In different embodiments, the stored game programs are communicated or delivered by embedding the communicated game program in a device or a component (e.g., a microchip to be inserted in a gaming device), writing the game program on a disc or other media, or downloading or streaming the game program over a dedicated data network, internet, or a telephone line. After the stored game programs are communicated from the central server, the local processor executes the communicated program to facilitate play of the communicated program by a player through the display device(s) and/or input device(s) of the gaming device. That is, when a game program is communicated to a local processor, the local processor changes the game or type of game played at the gaming device.

In another embodiment, a plurality of gaming devices at one or more gaming sites may be networked to the central server in a progressive configuration, as known in the art, wherein a portion of each wager to initiate a base or primary game may be allocated to one or more progressive awards. In one embodiment, a progressive gaming system host site computer is coupled to a plurality of the central servers at a variety of mutually remote gaming sites for providing a multi-site linked progressive automated gaming system. In one embodiment, a progressive gaming system host site computer may serve gaming devices distributed throughout a number of properties at different geographical locations including, for example, different locations within a city or different cities within a state.

In one embodiment, the progressive gaming system host site computer is maintained for the overall operation and control of the progressive gaming system. In this embodiment, a progressive gaming system host site computer oversees the entire progressive gaming system and is the master for computing all progressive jackpots. All participating gaming sites report to, and receive information from, the progressive gaming system host site computer. Each central server computer is responsible for all data communication between the gaming device hardware and software and the progressive gaming system host site computer. In one embodiment, an individual gaming machine may trigger a progressive award win. In another embodiment, a central server (or the progressive gaming system host site computer) determines when a progressive award win is triggered. In another embodiment, an individual gaming machine and a central controller (or progressive gaming system host site computer) work in conjunction with each other to determine when a progressive win is triggered, for example through an individual gaming machine meeting a predetermined requirement established by the central controller.

In one embodiment, a progressive award win is triggered based on one or more game play events, such as a symbol-driven trigger. In other embodiments, the progressive award triggering event or qualifying condition may be achieved by exceeding a certain amount of game play (such as number of games, number of credits, or amount of time), or reaching a specified number of points earned during game play. In another embodiment, a gaming device is randomly or apparently randomly selected to provide a player of that gaming device one or more progressive awards. In one such embodiment, the gaming device does not provide any apparent reasons to the player for winning a progressive award, wherein winning the progressive award is not triggered by an event in or based specifically on any of the plays of any primary game. That is, a player is provided a progressive award without any explanation or alternatively with simple explanations. In another embodiment, a player is provided a progressive award at least partially based on a game triggered or symbol triggered event, such as at least partially based on the play of a primary game.

In one embodiment, one or more of the progressive awards are each funded via a side bet or side wager. In this embodiment, a player must place or wager a side bet to be eligible to win the progressive award associated with the side bet. In one embodiment, the player must place the maximum bet and the side bet to be eligible to win one of the progressive awards. In another embodiment, if the player places or wagers the required side bet, the player may wager at any credit amount during the primary game (i.e., the player need not place the maximum bet and the side bet to be eligible to win one of the progressive awards). In one such embodiment, the greater the player's wager (in addition to the placed side bet), the greater the odds or probability that the player will win one of the progressive awards. It should be appreciated that one or more of the progressive awards may each be funded, at least in part, based on the wagers placed on the primary games of the gaming machines in the gaming system, via a gaming establishment or via any suitable manner.

In another embodiment, one or more of the progressive awards are partially funded via a side-bet or side-wager which the player may make (and which may be tracked via a side-bet meter). In one embodiment, one or more of the progressive awards are funded with only side-bets or side-wagers placed. In another embodiment, one or more of the progressive awards are funded based on player's wagers as described above as well as any side-bets or side-wagers placed.

In one alternative embodiment, a minimum wager level is required for a gaming device to qualify to be selected to obtain one of the progressive awards. In one embodiment, this minimum wager level is the maximum wager level for the primary game in the gaming machine. In another embodiment, no minimum wager level is required for a gaming machine to qualify to be selected to obtain one of the progressive awards.

In another embodiment, a plurality of players at a plurality of linked gaming devices in a gaming system participate in a group gaming environment. In one embodiment, a plurality of players at a plurality of linked gaming devices work in conjunction with one another, such as by playing together as a team or group, to win one or more awards. In one such embodiment, any award won by the group is shared, either equally or based on any suitable criteria, amongst the different players of the group. In another embodiment, a plurality of players at a plurality of linked gaming devices compete against one another for one or more awards. In one such embodiment, a plurality of players at a plurality of linked gaming devices participate in a gaming tournament for one or more awards. In another embodiment, a plurality of players at a plurality of linked gaming devices play for one or more awards wherein an outcome generated by one gaming device affects the outcomes generated by one or more linked gaming devices.

Reusing Discarded Cascading Symbols

In various embodiments, the gaming system disclosed herein includes a cascading symbol or tumbling reel game which retains, saves or stores zero, one or more of any symbols removed during the play of a primary cascading symbols game. In these embodiments, rather than discarding any symbols that are removed from any winning symbol combinations (as in certain known cascading symbol games), the gaming system of the present disclosure employs such removed symbols to provide the player one or more additional award opportunities in association with the single generation of such symbols.

Figure 3:
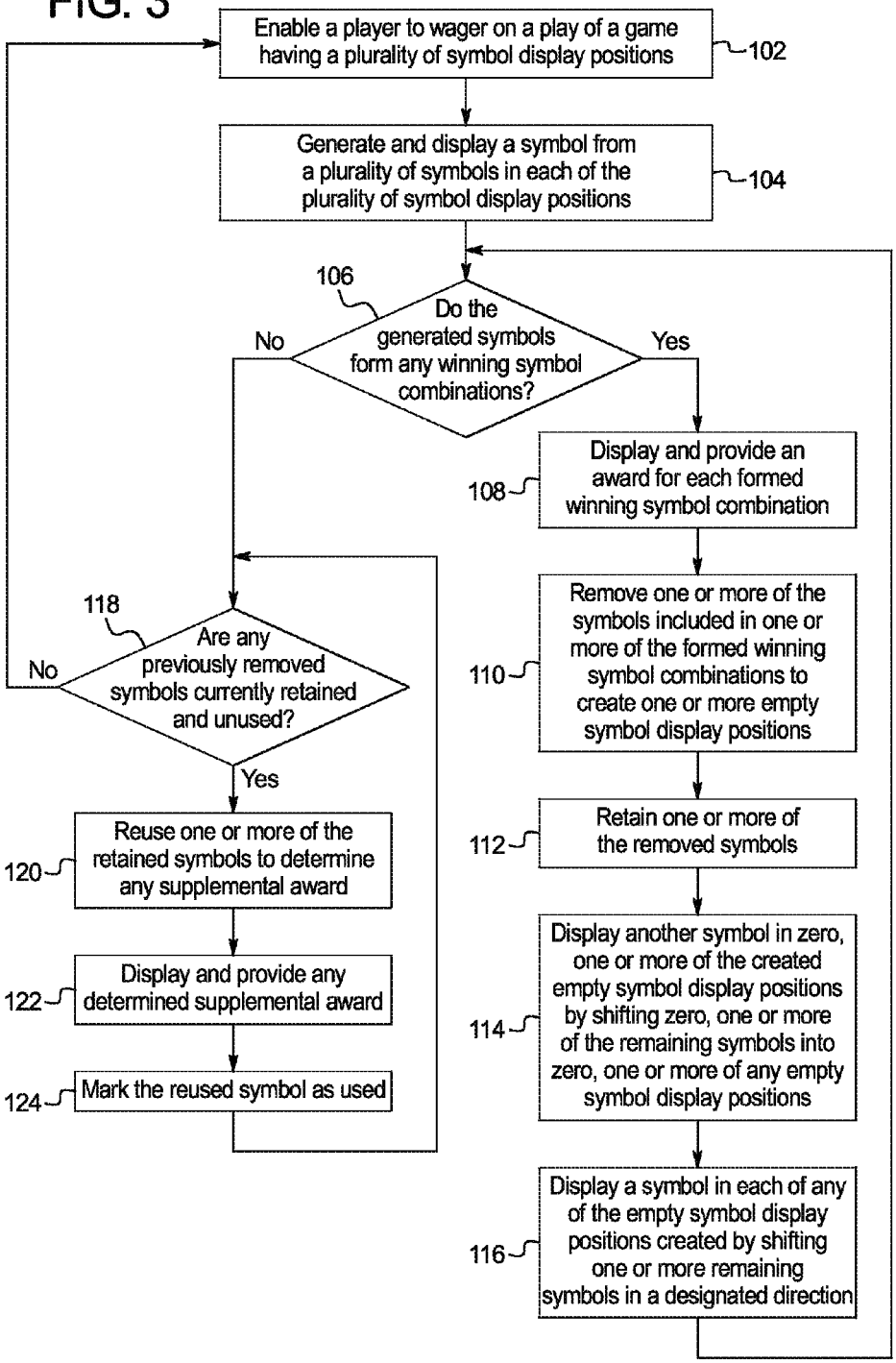
FIG. 3 is a flow chart an example process for operating a gaming system providing the cascading symbol game which reuses removed symbols.

Specifically, referring now to FIG. 3, a flowchart of an example embodiment of a process for operating a gaming system or a gaming device disclosed herein is illustrated. In one embodiment, this process is embodied in one or more software programs stored in one or more memories and executed by one or more processors or servers. Although this process is described with reference to the flowchart illustrated in FIG. 3, it should be appreciated that many other methods of performing the acts associated with this process may be used. For example, the order of certain steps described may be changed, or certain steps described may be optional.

In one embodiment, as indicated in block 102, the gaming system enables a player to wager on a play of a game having a plurality of symbol display positions. In one embodiment, the symbol display positions form a single symbol display position matrix or grid arranged in a plurality of rows and a plurality of columns.

In another embodiment, the symbol display positions form a plurality of symbol display position matrices or grids. In this embodiment, each symbol display position grid includes a plurality of symbol display positions arranged in a plurality of rows and a plurality of columns. Additionally, in this embodiment, each symbol display position grid also has a different depth. Thus, each symbol display position of each symbol display position grid is associated with a specific row, a specific column and a specific depth. Moreover, in each symbol display position grid of this embodiment, one or more symbol display positions are aligned with or otherwise correspond with one or more symbol display positions of one or more symbol display position grids of different depths. That is, one or more symbol display position grids are positioned (relative to the player's line of sight) behind one or more other symbol display position grids and thus one or more symbol display positions of one or more symbol display position grids are positioned (relative to the player's line of sight) behind one or more symbol display positions of one or more other symbol display position grids.

For a wagered on play of the game, the gaming system generates and displays a symbol from a plurality of symbols in each of the plurality of symbol display positions as indicated in block 104. In certain embodiments, the gaming system displays the generation of the symbols of a reel game as a cascading or falling symbol game.

Figure 4A:
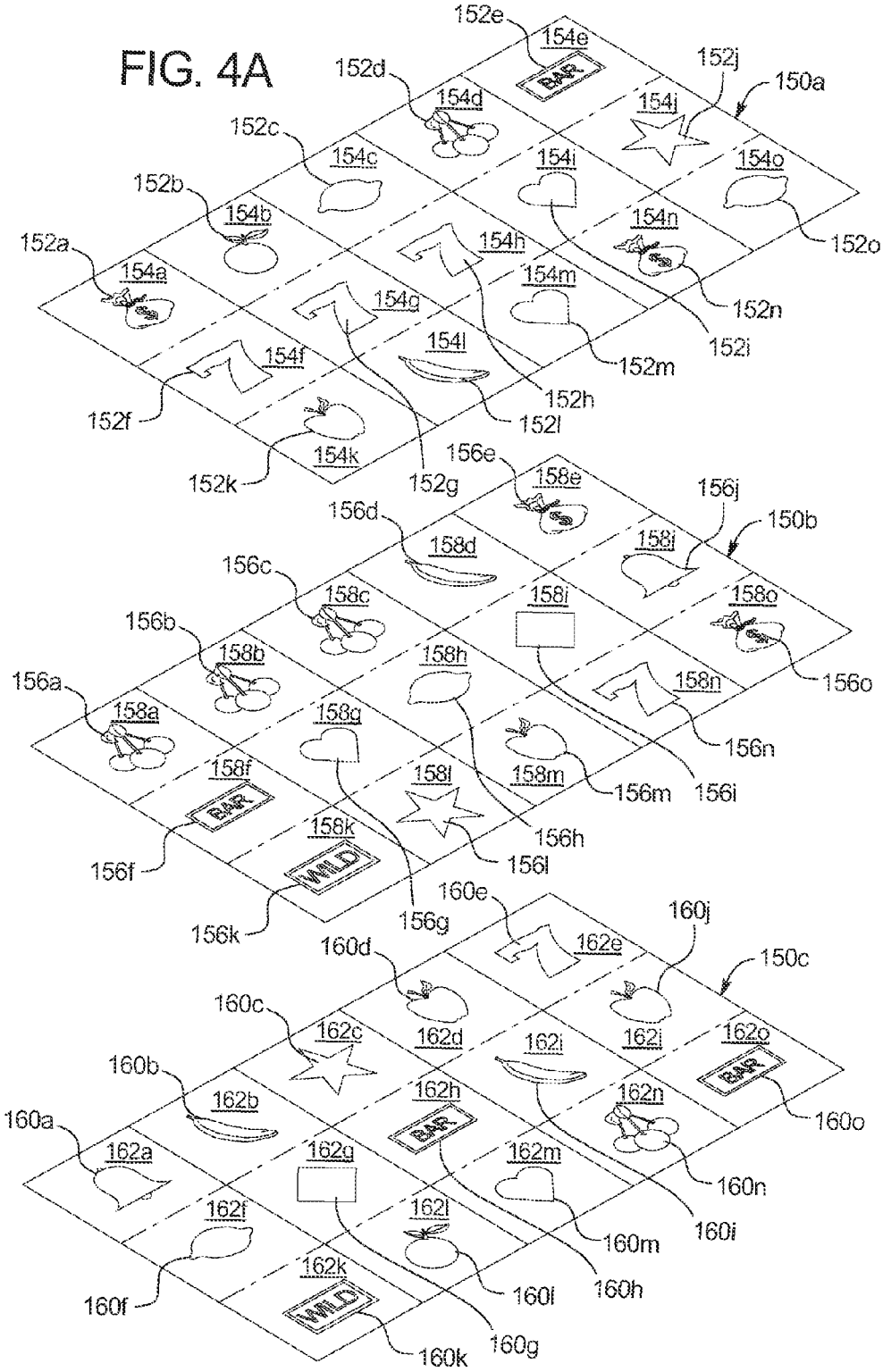
FIG. 4A is a front perspective view of one embodiment of the gaming system disclosed herein illustrating a plurality of symbols generated in a plurality of symbol display positions of a plurality of symbol display position grids at a plurality of different depths.

In one embodiment, one or more of the generated symbols include a length component and a width component, such as a two dimensional tile with a symbol displayed on the face of the tile. In one such embodiment which employs a single symbol display position grid, the gaming system generates and displays a symbol in each of the plurality of symbol display positions of the single symbol display position grid. In another such embodiment which employs a plurality of symbol display position grids of different depths, the gaming system generates and displays a symbol in each of the plurality of symbol display positions of each of the plurality of symbol display position grids. For example, as illustrated in FIG. 4A, the gaming system generates a plurality symbols at a plurality of symbol display positions at each of a plurality of symbol display position grids 150*a*, 150*b* and 150*c* of different depths. Specifically, the gaming system: (i) generates a plurality of symbols 152 at a plurality of symbol display positions 154 of symbol display position grid 150*a*, (ii) generates a plurality of symbols 156 at a plurality of symbol display positions 158 of symbol display position grid 150*b*, and (iii) generates a plurality of symbols 160 at a plurality of symbol display positions 162 of symbol display position grid 150*c*. In this example, because symbol display position grids 150*b* and 150*c* are positioned behind symbol display position grid 150*a*, depending on the view of the player, the symbols 156 and 160 generated at the plurality of symbol display positions 158 and 162 of symbol display position grids 150*b* and 150*c* may or may not be initially displayed to the player.

In another embodiment, one or more of the generated symbols are multiple dimension symbols including a length component, a width component and a depth component. For example, one or more multiple dimension symbols each include a six-sided or hexagonal shape with individually displayed symbols on each side or face of the multi-dimensional shape. In another example, one or more multiple dimension symbols each include a four-sided square or rectangular shape with individually displayed symbols on each side or face. In another example, one or more multiple dimension symbols each include a three-sided or triangular shape with individually displayed symbols on each side or face. In an alternative embodiment, one or more faces or sides of one or more multiple dimension symbols do not include an individually displayed symbol. It should be appreciated that such multiple dimension symbols can include any suitable number of sides and any suitable number of individually displayed symbols per side.

Figure 4B:
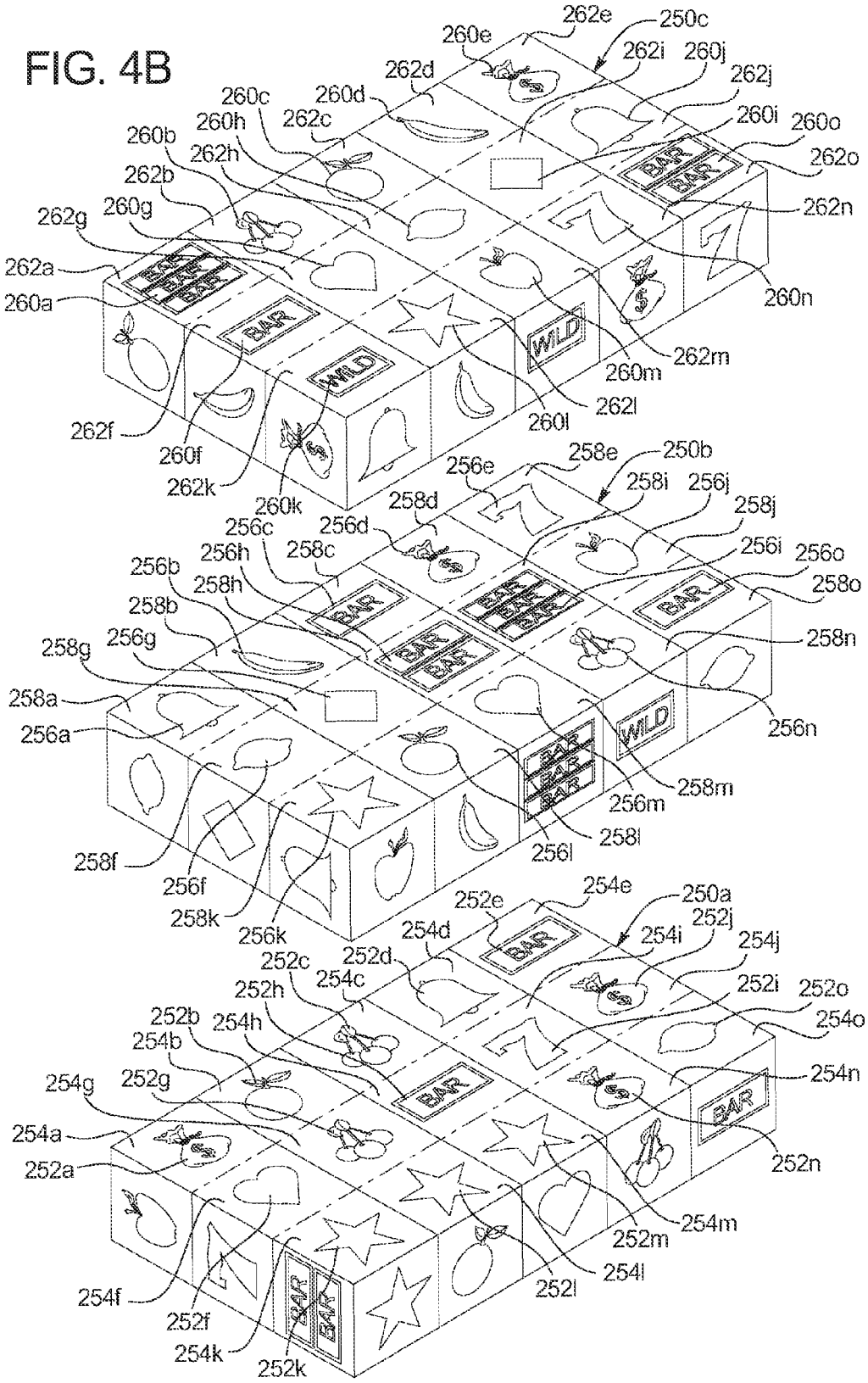
FIG. 4B is a front perspective view of one embodiment of the gaming system disclosed herein illustrating a plurality of multiple dimension symbols generated in a plurality of symbol display positions of a plurality of symbol display position grids at a plurality of different depths.

In one such embodiment which employs a single symbol display position grid and multiple dimension symbols, the gaming system generates and displays a multiple dimension symbol in each of the plurality of symbol display positions of the single symbol display position grid. In another such embodiment which employs a plurality of symbol display position grids of different depths and multiple dimension symbols, the gaming system generates and displays a multiple dimension symbol in each of the plurality of symbol display positions of each of the plurality of symbol display position grids. For example, as illustrated in FIG. 4B, the gaming system generates a plurality of multiple dimension symbols at a plurality of symbol display positions of each of a plurality of symbol display position grids 250*a*, 250*b* and 250*c* of different depths. Specifically, the gaming system: (i) generates a plurality of multiple dimension symbols 252 at a plurality of symbol display positions 254 of symbol display position grid 250*a*, (ii) generates a plurality of multiple dimension symbols 256 at a plurality of symbol display positions 258 of symbol display position grid 250*b*, and (iii) generates a plurality of multiple dimension symbols 260 at a plurality of symbol display positions 262 of symbol display position grid 250*c*. In this example, because symbol display position grids 250*b* and 250*c* are positioned behind symbol display position grid 250*a*, depending on the view of the player, the multiple dimension symbols 256 and 260 generated at the plurality of symbol display positions 258 and 262 of symbol display position grids 250*b* and 250*c* may or may not be initially displayed to the player. Moreover, in this example, the configuration of the multiple dimension symbols causes one or more of the faces or sides of certain multiple dimension symbols to be hidden from or otherwise not displayed to the player such that only one side or face of certain of the multiple dimension symbols generated in the plurality of symbol display positions 254 of symbol display position grid 250*a* to be initially displayed to the player.

Following the generation and display of the plurality of symbols in the plurality of symbol display positions, the gaming system determines whether the generated symbols form any winning symbol combinations as indicated in diamond 106 of FIG. 3.

In the embodiments which include a plurality of symbol display position grids and/or a plurality of multiple dimension symbols, one or more paylines of any suitable direction extend through a plurality of symbol display positions and/or one or more symbols displayed on one or more faces of one or more multiple dimension symbols of a symbol display position grid at one depth. In another embodiment, one or more paylines of any suitable direction extend through a plurality of symbol display positions and/or one or more symbols displayed on one or more faces of one or more multiple dimension symbols of a plurality of symbol display position grids at a plurality of different depths. In these embodiments, the gaming system determines whether the symbols generated along such paylines form any winning symbol combinations. In another embodiment, one or more ways to win are associated with a plurality of symbol display positions and/or one or more symbols displayed on one or more faces of one or more multiple dimension symbols of a symbol display position grid at one depth. In another embodiment, one or more ways to win are associated with a plurality of symbol display positions and/or one or more symbols displayed on one or more faces of one or more multiple dimension symbols of a plurality of symbol display position grids at a plurality of different depths. In these embodiments, the gaming system determines whether the symbols generated in a quantity of active symbol display positions form any winning symbol combinations.

If the generated symbols form one or more winning symbol combinations as indicated in block 108, the gaming system causes an award to be displayed and provided for each formed winning symbol combination. The gaming system then removes one or more of the symbols included in one or more of the formed winning symbol combinations to create one or more empty symbol display positions as indicated in block 110.

In one embodiment, the gaming system retains or saves such removed symbols as indicated in block 112. That is, rather than discarding the removed symbols (as in certain known cascading symbols games), this embodiment saves such removed symbols for subsequent use. More specifically, the gaming system stores data associated with a removed symbol and upon a subsequent occurrence of a stored symbol reuse triggering event (as described below), the gaming system accesses the stored data to regenerate the stored symbol.

It should be appreciated that in one embodiment which utilizes a plurality of symbol display position grids, the creation of one or more empty symbol display positions at one symbol display position grid causes the exposure of symbols generated in symbol display positions of another grid positioned at another depth. Put differently, the removal of symbols, shifting of symbols and creation of empty symbol display positions of one symbol display position grid results in the gaming system displaying previously hidden symbols from another symbol display position grid (which is positioned, relative to the player's line of sight, behind the grid with the removed symbols). In other words, unlike known two dimensional cascading reel games (which generate symbols from above the symbol display position matrix to fill in any holes created by the removal of certain symbol), the gaming system of this embodiment includes a three dimensional cascading reel game which accounts for any holes created by the removal of certain symbols from one symbol display position matrix by exposing symbols from another symbol display position matrix which is at a different depth.

It should be further appreciated that in one embodiment which utilizes a plurality of symbol display position grids and such multiple dimension symbols, when zero, one, or more empty symbol display positions are created in a symbol display position grid (due to the above-described removal of one or more symbols), not only is one side or face of the multiple dimension symbol of another symbol display position grid of a different depth exposed, but one or more sides or faces of one or more multiple dimension symbols of the same symbol display position grid of the removed symbol may be exposed. That is, the removal of a multiple dimension symbol from a symbol display position grid results in previously hidden sides of other multiple dimension symbols from the same symbol display position grid becoming exposed for award evaluation purposes.

Following the removal and saving of one or more symbols from one or more symbol display positions, the gaming system displays another symbol in zero, one or more of the created empty symbol display positions by shifting (according to applicable game rules) one or more of the remaining symbols into one or more of any empty symbol display positions as indicated in block 114. For example, under one set of applicable game rules wherein symbols are shifted downward to fill empty symbol display positions, if a winning symbol combination results in a displayed empty symbol display position along a bottom row of symbol display positions, the gaming system will shift at least one symbol in a symbol display position above the empty symbol display position downward to fill the empty symbol display position. It should be appreciated that in this example, under these applicable set of game rules, if a winning symbol combination results in a displayed empty symbol display position along a top row of symbol display positions, the gaming system will not shift any symbols to fill the empty symbol display position.

In one such embodiment, the gaming system shifts any remaining symbols as many symbol display positions as possible in a designated direction, while maintaining the position of each shifted symbol relative to one or more other symbols or coordinates. For instance, the gaming system in one embodiment moves each symbol positioned in a symbol display position adjacently above an empty symbol display position of a column of a symbol display position matrix (displayed as a reel) downward as far as possible to occupy one or more empty symbol display positions while maintaining the relative order of the symbols of that column of the symbol display position matrix from top to bottom. In this embodiment, shifting the non-removed symbols does not result in fewer empty symbol display positions. Rather, shifting the non-removed symbols results in a plurality of different empty symbol display positions wherein each empty symbol display position has a given relationship to any remaining symbols, the relationship based on the direction of shifting. In one embodiment, for each of a plurality of columns of a symbol display position matrix, displayed as a plurality of reels, each of empty symbol display positions on the displayed reel resulting form shifting one or more non-removed symbols is above each of any remaining displayed symbols on the displayed reel.

After shifting zero, one or more symbols, the gaming system displays a symbol in each of any of the empty symbol display positions created by shifting zero, one or more remaining symbols in a designated direction as indicated in block 116.

In one embodiment which utilizes a single symbol display position grid, the gaming system displays a symbol in each of any of the created empty symbol display positions by generating another symbol in that created empty symbol display position. In another embodiment which utilizes a plurality of symbol display position grids, the gaming system determines whether to generate a symbol in each of any of the created empty symbol display positions based on whether or not a generated symbol is displayed in a corresponding symbol display position of a different symbol display position grid. That is, the gaming system determines whether each created empty symbol display position reveals another symbol generated at another depth. In this embodiment, if a created empty symbol display position does not reveal another symbol generated at another depth, the gaming system generates a symbol for each created empty symbol display position without a generated symbol displayed in a corresponding symbol display position of a different symbol display position grid. On the other hand, if each created empty symbol display position reveals another symbol of another symbol display position of another symbol display position grid of a different depth, the gaming system displays this other symbol and does not generate any additional symbol for that created empty symbol display position.

Following the display of a symbol in each of the created empty symbol display positions, the gaming system then returns to diamond 106 and proceeds with determining whether the generated symbols (i.e., the non-removed symbols from a previous generation and display of at least one symbol and the newly displayed symbols) form any winning symbol combinations.

It should be appreciated that in one embodiment which utilizes a plurality of symbol display position grids, when determining if any awards are associated with the currently displayed symbols, the gaming system may evaluate symbols displayed at a plurality of symbol display positions of a plurality of symbol display position grids of a plurality of different depths. That is, since the gaming system of this embodiment only evaluates the symbols that are currently displayed to the player and different symbols positioned at different depths may be currently displayed to the player (due to the removal and/or shifting of symbols positioned in front of these symbols), the gaming system is configured to evaluate symbols displayed at different depths to determine any additional awards to provide to the player. Such a configuration provides the player with additional opportunities to win awards in association with a plurality of grids of symbol display positions.

It should be further appreciated that in one embodiment which utilizes a plurality of symbol display position grids and multiple dimension symbols, for one play of the game, the gaming system evaluates the symbols exposed on a plurality of faces or sides of a plurality of multiple dimension symbols. In this embodiment, when a plurality of multiple dimension symbols are generated in the symbol display positions of each of the plurality of symbol display position grids, zero, one or more of the multiple dimension symbols from the plurality of symbol display position grids form a plurality of multiple dimension symbol display position planes or surfaces. These multiple dimension symbol display position planes or surfaces each include one or more symbol display positions from one or more of the symbol display position grids at one or more depths. In this embodiment, for each plane or surface of the multiple dimension symbol display position grid displayed to the player, the gaming system evaluates the symbols displayed on the faces of the multiple dimension symbols associated with that plane or surface. For each displayed plane or surface of the multiple dimension symbol display position grid, the gaming system removes any multiple dimension symbols from any winning symbol combinations, saves such removed multiple dimension symbols and shifts any multiple dimension symbols to reveal generated multiple dimension symbols in different symbol display position grids at the same depth or at different depths. This process is repeated until no winning symbol or winning symbol combination is displayed to the player.

Returning to FIG. 3, if no winning symbol combinations are formed from the generated symbols (i.e., either from the initial generation of symbols or from a combination of the non-removed symbols from a previous generation and display of at least one symbol and the newly displayed symbols), the gaming system determines if any previously removed symbols are currently retained and unused as indicated in diamond 118. If no symbols are retained and unused, the gaming system ends the play of the game and returns to block 102 to enable the player to place another wager on another play of the game.

On the other hand, if at least one previously removed symbol is currently retained and unused, the gaming system reuses one or more of such retained symbols to determine any supplemental award as indicated in block 120. That is, the gaming system regenerates and redisplays one or more previously removed and saved symbols in association with a supplemental award determination. In one such embodiment, the gaming system reuses one or more of such retained symbols in response to a stored symbol reuse triggering event, such as an event which occurs based on at least one displayed event occurring in association with a play of a primary game (e.g., a designated symbol combination being generated) or an event which occurs independent of any displayed events in any plays of any of the primary games (e.g., a mystery event).

Following the utilization of one or more previously removed symbols to determine a supplemental award, the gaming system then displays and provides to the player any determined supplemental award and marks or flags such reused symbol as used as indicated in blocks 122 and 124. Following providing the player at least one additional award opportunity in association with at least one of the removed symbols, the gaming system returns to diamond 118 and proceeds with determining if any previously removed symbols are currently retained and unused. Thus, the gaming system disclosed herein provides the player at least one additional award opportunity which utilizes one or more of the symbols that are removed from the cascading symbols game. Put differently, rather than discarding any symbols that are removed from any winning symbol combinations (as in certain known cascading symbol games), the gaming system of the present disclosure employs such removed symbols to provide the player one or more additional award opportunities in association with the single generation of such symbols. Accordingly, the gaming system disclosed herein is configured to increase a level of excitement and enjoyment for players by introducing an aspect of reusing one or more symbols into a cascading symbol or tumbling reel game.

A. Reusing Removed Symbols to Form Additional Paylines

In various different embodiments, the gaming system reuses one or more removed symbols by providing the player an additional award opportunity which forms an additional, supplemental or bonus payline of the removed symbols. In this embodiment, the gaming system evaluates the removed symbols placed along the additional, supplemental or bonus payline to determine whether such removed symbols are associated with any winning outcomes. If the removed symbols placed along the additional payline are associated with a winning outcome, the gaming system provides the player the award associated with the winning outcome. In various embodiments, different awards are associated with different symbols transferred to the additional payline, such as relatively larger awards for relatively larger sequences of symbols and/or relatively larger awards for relatively larger clusters or groupings of the same symbol.

It should be appreciated that in these embodiments, the order in which the symbols are removed determines the order which the removed symbols are placed along the additional payline which determines whether the removed symbols are associated with any winning outcomes. For instance, if the gaming system adds or places any removed symbols to the additional payline in payline order (i.e., any removed symbols from a first payline are added to the additional payline and then any removed symbols from a second payline are added to the additional payline), then a first outcome associated with a first award would be formed. On the other hand, if the gaming system adds or places any removed symbols to the additional payline in win amount order (i.e., any removed symbols from a first winning symbol combination associated with a first award amount are added to the additional payline and then any removed symbols from a second winning symbol combination associated with a second award amount are added to the additional payline), then a second outcome associated with a second award would be formed.

Figure 5A:
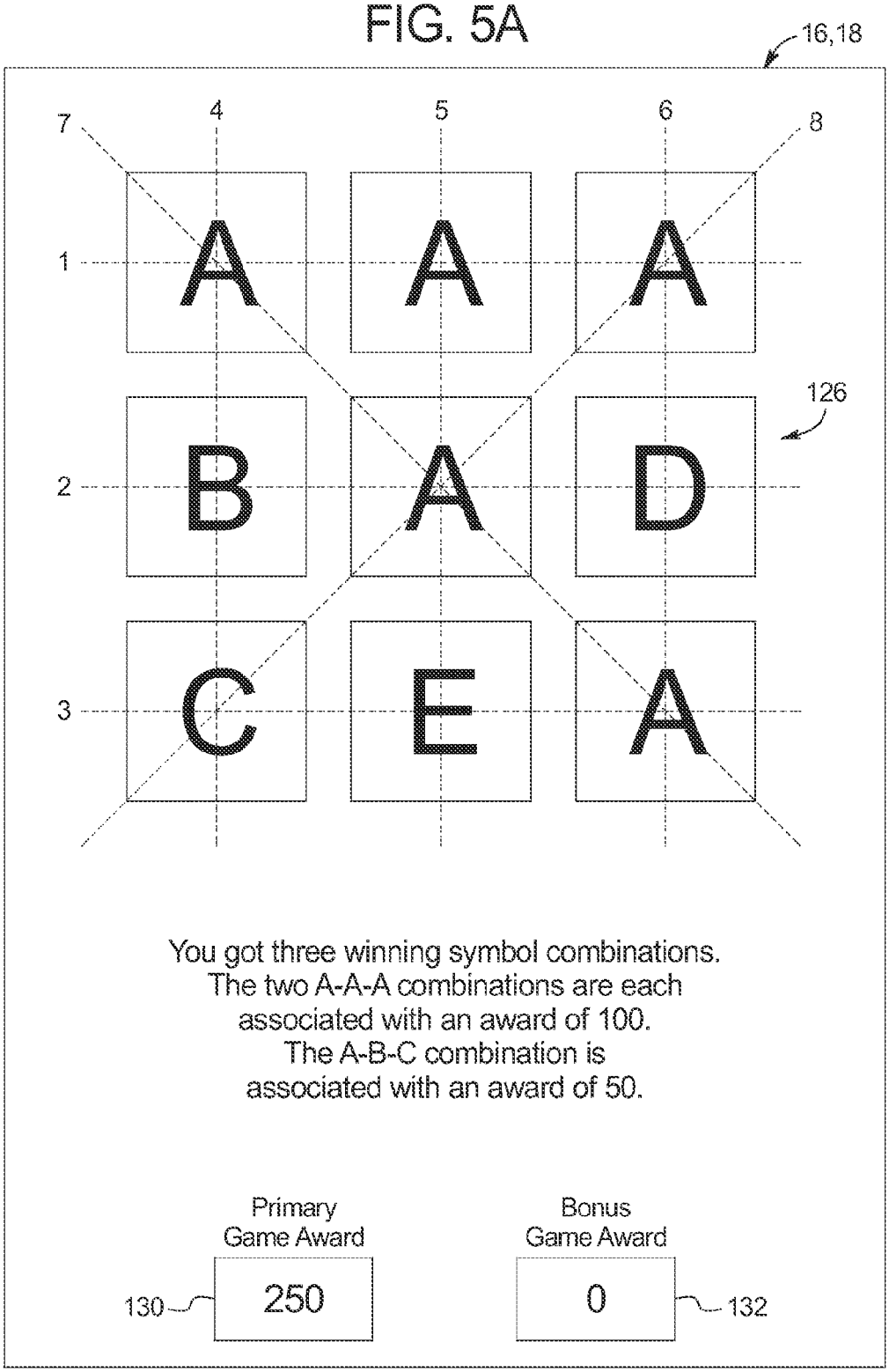
FIGS. 5A and 5B are front views of one embodiment of the gaming system disclosed herein illustrating a generation of a plurality of symbols, a removal of zero, one or more generated symbols and the shifting of zero, one or more remaining generated symbols.

In one illustrated example, as seen in FIG. 5A, upon the placement of a wager, the gaming system randomly generates a plurality of symbols at the plurality of symbol display positions of the plurality of reels. Put differently, the gaming system generates a plurality of symbols at the plurality of symbol display positions of a first symbol display position grid or matrix 126. After generating the plurality of symbols, the gaming system determines that the displayed symbol combinations of: (i) A symbol-A symbol-A symbol generated on payline one is a winning symbol combination associated with an award of one-hundred, (ii) A symbol-B symbol-C symbol generated on payline four is a winning symbol combination associated with an award of fifty, and (iii) A symbol-A symbol-A symbol generated on payline seven is a winning symbol combination associated with an award of one-hundred. Accordingly, the gaming system provides an award of two-hundred-fifty credits to the player (as indicated in primary game award meter 130) and provides appropriate messages such as "YOU GOT THREE WINNING SYMBOL COMBINATIONS", "THE TWO A-A-A COMBINATIONS ARE EACH ASSOCIATED WITH AN AWARD OF 100", and "THE A-B-C COMBINATION IS ASSOCIATED WITH AN AWARD OF 50" to the player visually, or through suitable audio or audiovisual displays.

Figure 5B:
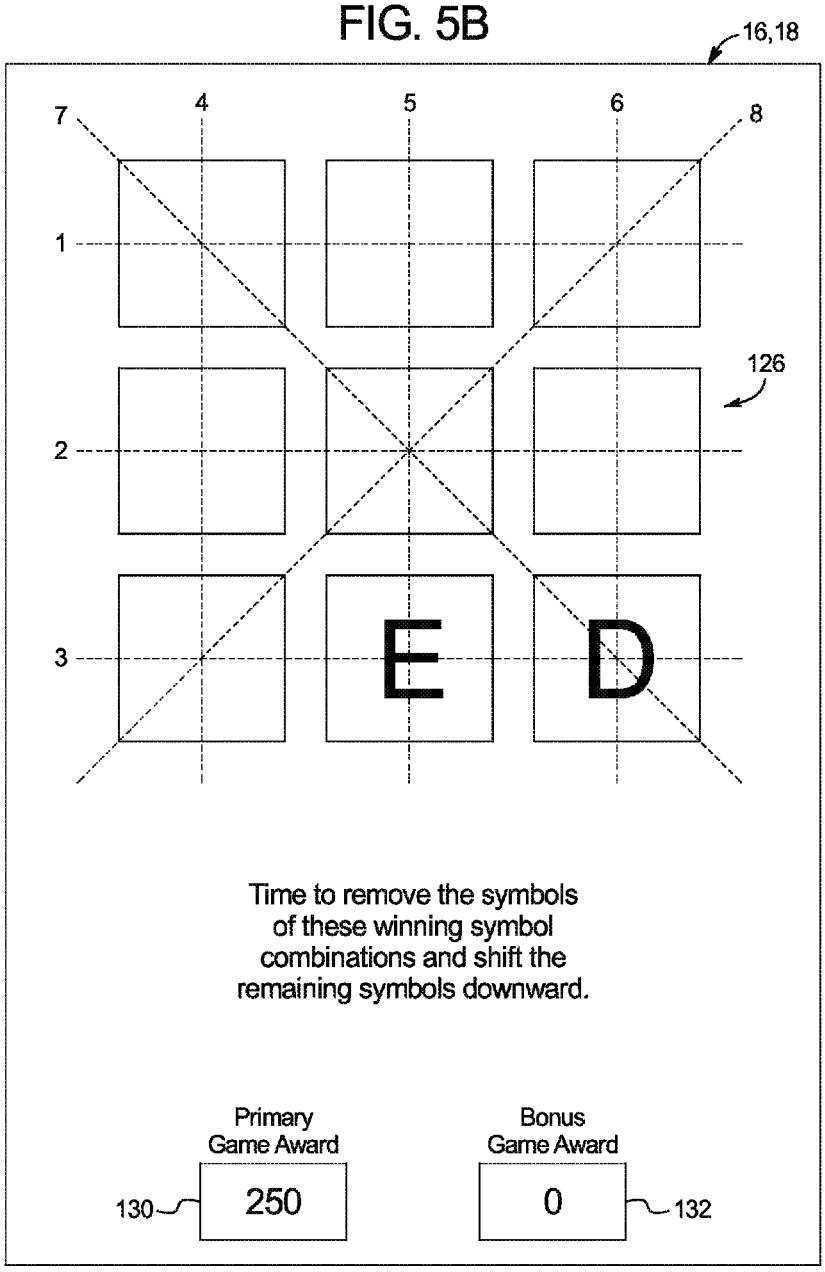

As seen in FIG. 5B, the gaming system then removes each of the symbols of the displayed winning symbol combinations to create a plurality of empty symbol display positions. Following this removal, the gaming system shifts one or more of the remaining symbols downward to fill one or more of the created empty symbol display positions. As seen in FIG. 5B, such shifting causes one or more different symbol display positions to become empty. In the illustrated example, shifting symbols downward causes the shifted symbols to remain on the same reel—that is, in the same column of the symbol display position matrix. Moreover, the gaming system shifts any displayed symbols downward as far as possible without changing the relative order of the symbols on a reel. In various embodiments, shifting symbols downward (or upward, or sideways or diagonally or any suitable direction) to fill one or more empty symbol display positions causes a cascading, tumbling, or falling appearance of the symbols in the gaming system, which increases player excitement and enjoyment. As seen in FIG. 5B, the gaming system provides appropriate messages such as "TIME TO REMOVE THE SYMBOLS OF THESE WINNING SYMBOL COMBINATIONS AND SHIFT THE REMAINING SYMBOLS DOWNWARD" to the player visually, or through suitable audio or audiovisual displays.

Figure 6:
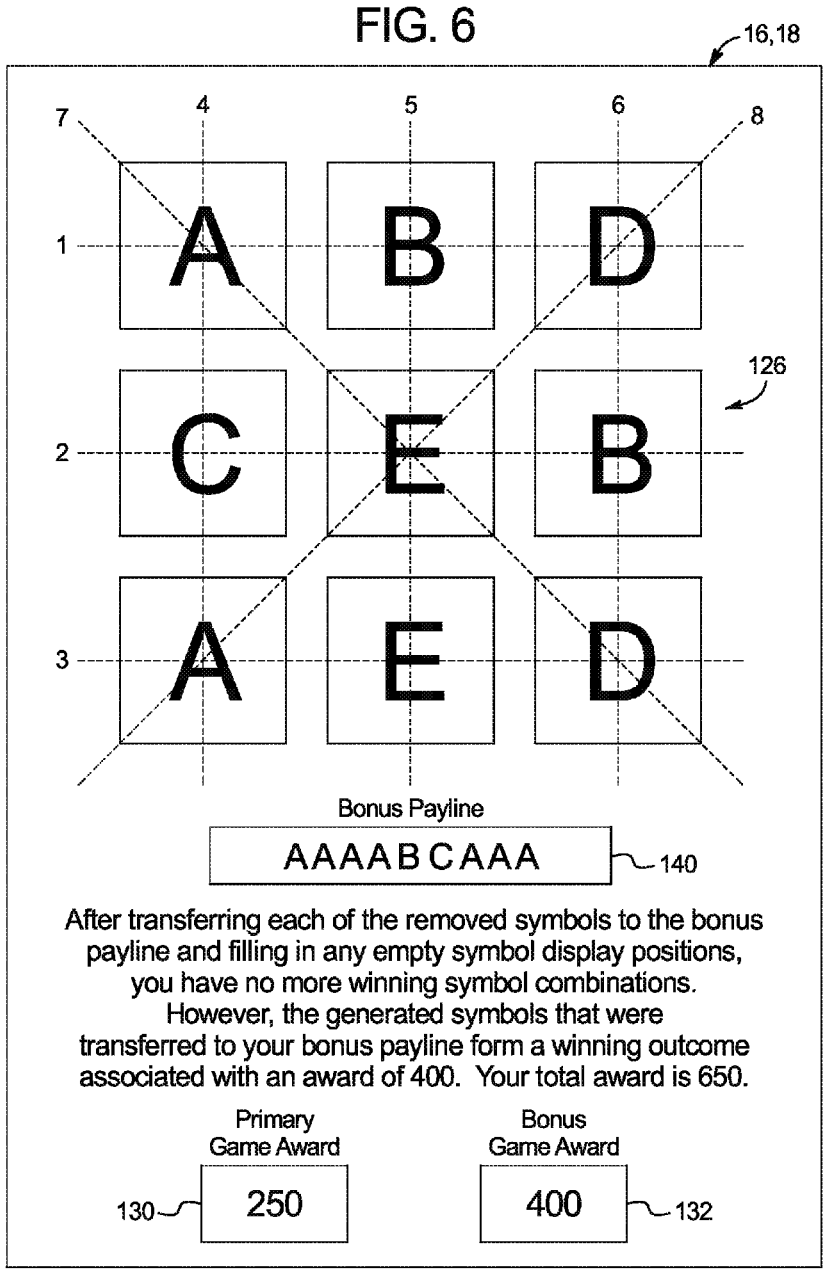
FIG. 6 is a front view of one embodiment of the gaming system disclosed herein illustrating a plurality of the removed symbols of FIGS. 5A and 5B transferred to a bonus payline.

As seen in FIG. 6, following such shifting of any symbols of FIG. 5B, the gaming system randomly generates a plurality of symbols at a plurality of the created empty symbol display positions of the plurality of reels. After generating these plurality of symbols, the gaming system determines that none of the displayed symbol combinations form any winning symbol combinations.

As further seen in FIG. 6, in addition to filling the empty symbol display positions with newly generated symbols, the gaming system also transfers each of the previously removed symbols to a bonus payline 140. In this embodiment, although certain symbols are part of multiple winning symbol combinations, the gaming system transfers each removed symbol of each winning symbol combination to the additional or bonus payline (i.e., the same symbol is added multiple times to the additional payline). As seen in FIG. 6, after determining that no additional winning symbol combinations are displayed to the player (i.e., after determining that no additionally removed symbols will be added to the bonus payline), the gaming symbol evaluates the symbols moved to the bonus payline and provides the player a bonus payline award of four-hundred (as indicated in bonus game award meter 132). The gaming system provides appropriate messages such as "AFTER TRANSFERRING EACH OF THE REMOVED SYMBOLS TO THE BONUS PAYLINE AND FILLING IN ANY EMPTY SYMBOL DISPLAY POSITIONS, YOU HAVE NO MORE WINNING SYMBOL COMBINATIONS", "HOWEVER, THE 9 REMOVED SYMBOLS THAT WERE TRANSFERRED TO YOUR BONUS PAYLINE FORM A WINNING OUTCOME ASSOCIATED WITH AN AWARD OF 400" and "YOUR TOTAL AWARD IS 650" to the player visually, or through suitable audio or audiovisual displays.

Figure 7:
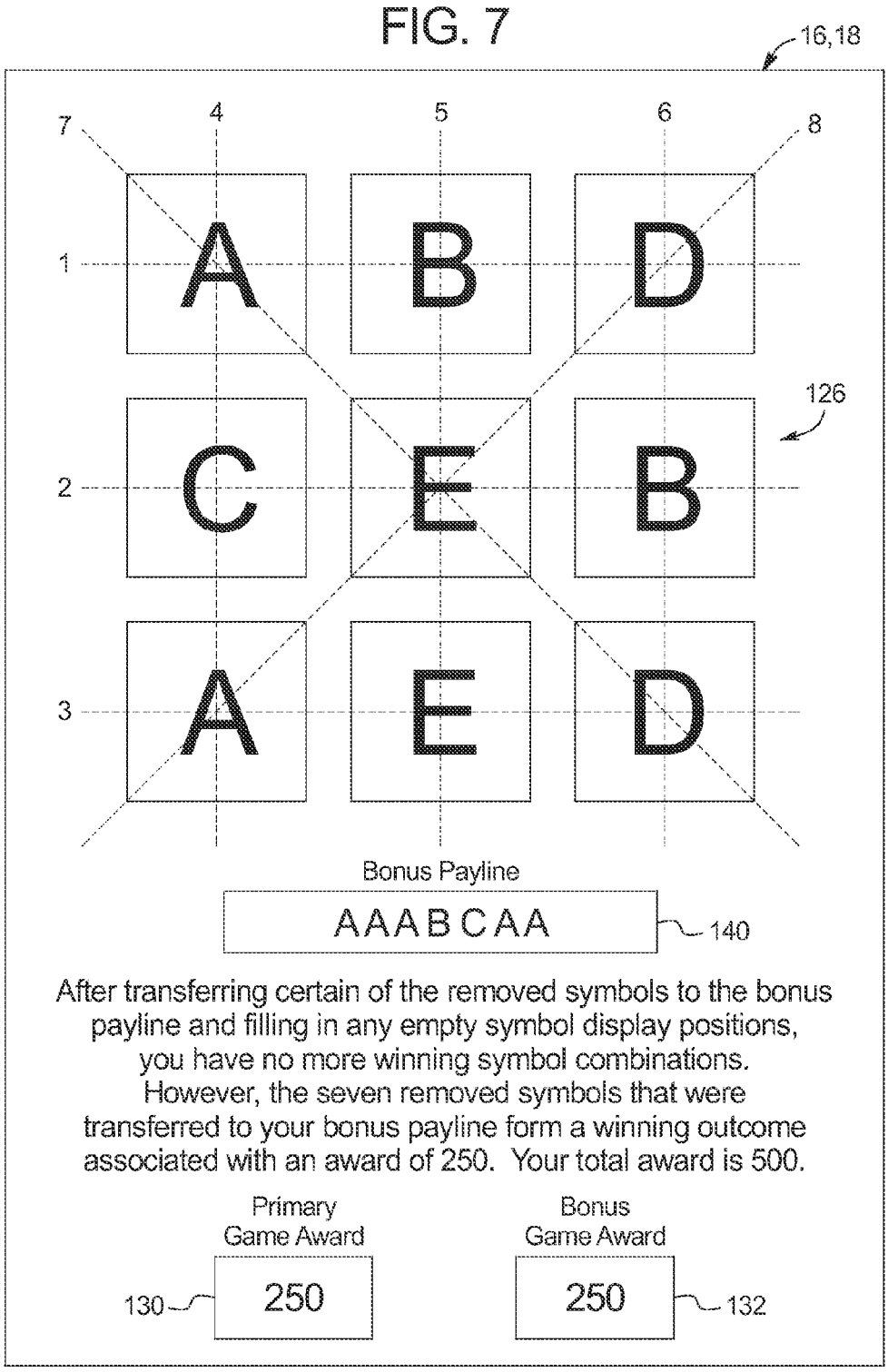
FIG. 7 is a front view of another embodiment of the gaming system disclosed herein illustrating a plurality of the removed symbols of FIGS. 5A and 5B transferred to a bonus payline.

In an alternative example, as seen in FIG. 7, following the shifting of any symbols of FIG. 5B, the gaming system randomly generates a plurality of symbols at a plurality of the created empty symbol display positions of the plurality of reels and determines that none of the displayed symbol combinations form any winning symbol combinations. As further seen in FIG. 7, in addition to filling the empty symbol display positions with newly generated symbols, the gaming system also transfers certain of the previously removed symbols to the bonus payline 140. In this embodiment, because certain symbols are part of multiple winning symbol combinations, the gaming system transfers each removed symbol to the additional or bonus payline one time regardless of how many winning symbol combinations that each removed symbol is part of (i.e., the same symbol is added one time to the additional payline). As seen in FIG. 7, after determining that no additional winning symbol combinations are displayed to the player (i.e., after determining that no additionally removed symbols will be added to the bonus payline), the gaming symbol evaluates the symbols moved to the bonus payline and provides the player a bonus payline award of two-hundred-fifty (as indicated in bonus game award meter 132). The gaming system provides appropriate messages such as "AFTER TRANSFERRING CERTAIN OF THE REMOVED SYMBOLS TO THE BONUS PAYLINE AND FILLING IN ANY EMPTY SYMBOL DISPLAY POSITIONS, YOU HAVE NO MORE WINNING SYMBOL COMBINATIONS", "HOWEVER, THE 7 REMOVED SYMBOLS THAT WERE TRANSFERRED TO YOUR BONUS PAYLINE FORM A WINNING OUTCOME ASSOCIATED WITH AN AWARD OF 250" and "YOUR TOTAL AWARD IS 500" to the player visually, or through suitable audio or audiovisual displays.

It should be appreciated that comparing the bonus payline awards of FIGS. 6 and 7, since one or more symbols may be part of multiple winning symbol combinations, different outcomes are generated along the additional payline based on if any removed symbols that are part of multiple winning symbol combinations are added multiple times to the additional payline or added one time to the additional payline.

In another example (not shown but utilizing the generated symbols of FIG. 5A), if the gaming system added the removed symbols to the additional payline in payline order sorted by win value, but without multiple additions for the same symbols participating in multiple wins, the additional payline outcome would be "AAAAABC" or "ABCAAAA", dependent of whether "ABC" or "AAA" paid more. In another example (not shown but utilizing the generated symbols of FIG. 5A), if the gaming system added the removed symbols to the additional payline in left to right, top to bottom order, the additional payline outcome would be "AAABACA". It should thus be appreciated that in these illustrated and non-illustrated embodiments, the bonus payline award provided to the player is based on one or more of: (i) which symbols are removed, (ii) the order of how such removed symbols are added to the bonus payline, and (iii) a determination of which removed symbols are added to the bonus payline.

In another embodiment, the gaming system removes the symbols from any winning symbol combinations from the additional payline and transfers these removed symbols to a second additional or bonus payline for a further award evaluation. For example, utilizing the bonus payline of FIG. 6, if the bonus payline outcome was "AAAABCAAA" and the gaming system provides awards for four or more of the same symbol on the bonus payline, then the first four A symbols transferred to the bonus payline would be removed and added to a second bonus payline. In this example, the gaming system evaluates the symbols transferred to the second bonus payline based on different rules (i.e., to avoid the evaluation and transfer process to continue indefinitely). The gaming system then repeats this process until there were no more wins (or until the gaming system provides the player a designated award, such as a triggering of a bonus round, if a designated number of bonus payline outcomes are evaluated).

In another embodiment which utilizes multiple dimension symbols and the above-described bonus payline, the transferring of one or more removed multiple dimension symbols to the bonus payline causes one or more symbols displayed on one or more faces of such removed multiple dimension symbols to become displayed to the player. In this embodiment, the gaming system analyzes such displayed symbols (including any symbols on any face of any removed multiple dimension symbol that were exposed to the player before the transfer to the bonus payline and any symbols on any face of any removed multiple dimension symbol that became exposed to the player due to the transfer to the bonus payline) to determine any awards to provide to the player. For example, when one or more removed multiple dimension symbols are added to the bonus payline, the configuration of the bonus payline provides that symbols on the front face and top face of the multiple dimension symbols are exposed to the player, wherein prior to this transfer, only the symbols on the front face of the multiple dimension symbol were exposed to the player.

B. Reusing Removed Symbols in a Second Cascading Symbols Game

In various different embodiments, the gaming system reuses one or more removed symbols by providing the player an additional award opportunity in a second cascading symbols game. In these embodiments, the gaming system transfers the removed symbols to a second symbol display position matrix or grid and evaluates such symbols to determine any additional awards to provide to the player.

Specifically, for each symbol removed from a symbol display position of the symbol display position matrix of the primary cascading symbols game, that removed symbol is transferred to the same corresponding symbol display position of a second symbol display position matrix. Following such a transfer of removed symbols in their respective symbol display positions, the gaming system causes each transferred symbol to shift in a designated direction to fill any empty symbol display positions as described above. Following the transfer and shifting of one or more removed symbols, the gaming system evaluates the transferred symbols to determine if any awards are associated with any formed symbol combinations. In one such embodiment, the gaming system evaluates the transferred symbols immediately after such symbols are added to the second symbol display position matrix or grid. In another such embodiment, the gaming system evaluates the transferred symbols upon the occurrence of a triggering event, such as a designated symbol combination occurring in the first symbol display position matrix. In another such embodiment, the gaming system evaluates the transferred symbols upon the occurrence of a second symbol display position matrix evaluation event, such as a determination that each of the symbol display positions of the second symbol display position grid are currently occupied with a removed symbol from one or more plays of the primary cascading symbols game. In this embodiment, once the second symbol display position matrix is full, any symbols of any winning symbol combinations are transferred to a third symbol display position matrix and this embodiments proceeds as described above.

Figure 8A:
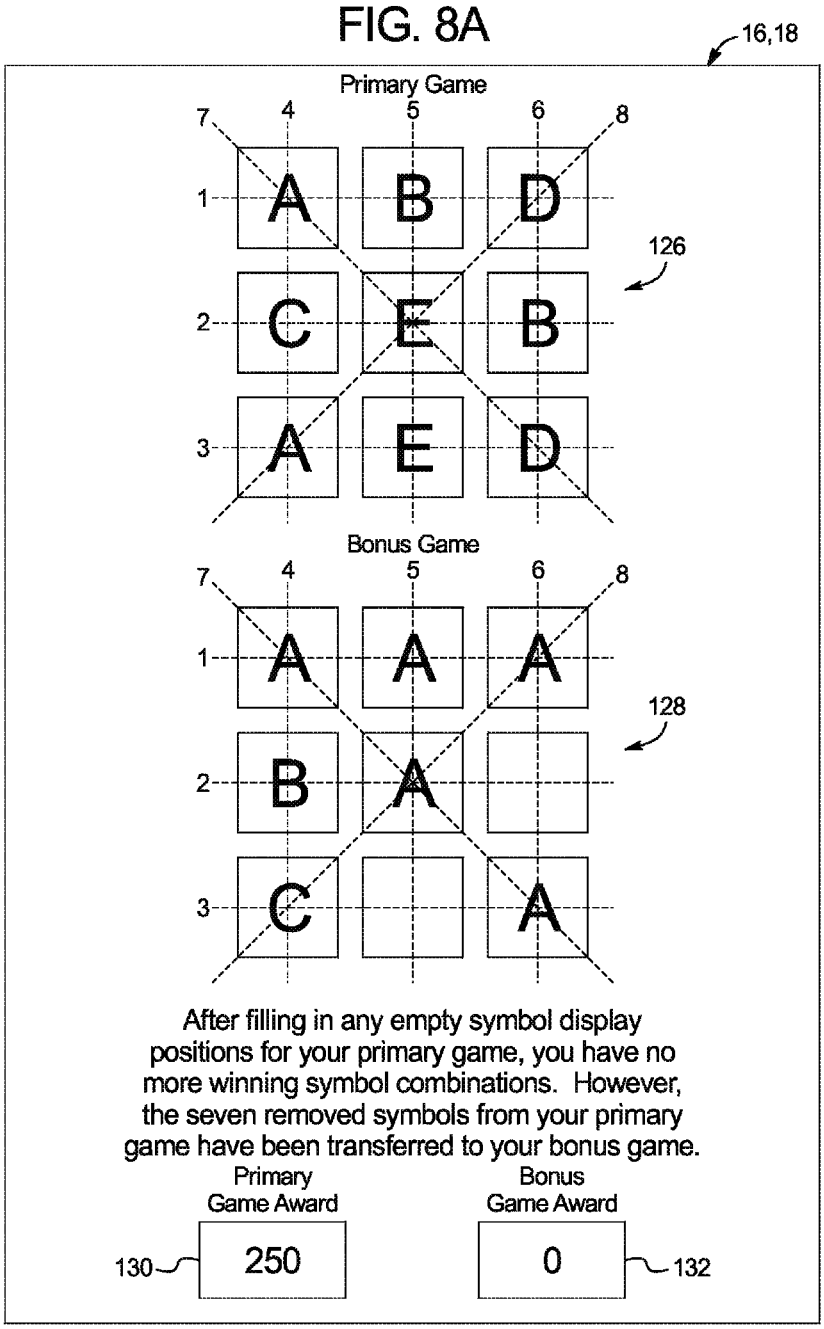
FIGS. 8A, 8B and 8C are front views of one embodiment of the gaming system disclosed herein illustrating a plurality of the removed symbols of FIGS. 5A and 5B transferred to a second or bonus symbol display position grid.

For example, following: (i) the generation of the plurality of symbols of FIG. 5A, (ii) the removal of a plurality of the generated symbols of FIG. 5B, and (iii) the shifting of one or more non-removed symbols of FIG. 5B, as seen in FIG. 8A, the gaming system randomly generates a plurality of symbols at a plurality of the created empty symbol display positions of the plurality of reels. After generating these plurality of symbols, the gaming system determines that none of the displayed symbol combinations form any winning symbol combinations. In this illustrated example, the gaming system provides appropriate messages such as "AFTER FILLING IN ANY EMPTY SYMBOL DISPLAY POSITIONS FOR YOUR PRIMARY GAME, YOU HAVE NO MORE WINNING SYMBOL COMBINATIONS" to the player visually, or through suitable audio or audiovisual displays.

As further seen in FIG. 8A, in addition to filling the empty symbol display positions with newly generated symbols, the gaming system also transfers the removed symbols from their respective symbol display positions of the first symbol display matrix 126 (as seen in FIG. 5A) to their respective symbol display positions of a second symbol display position matrix 128 (as seen in FIG. 8A). In this illustrated example, the gaming system provides appropriate messages such as "HOWEVER, THE SEVEN REMOVED SYMBOLS FROM YOUR PRIMARY GAME HAVE BEEN TRANSFERRED TO YOUR BONUS GAME" to the player visually, or through suitable audio or audiovisual displays.

Figure 8B:
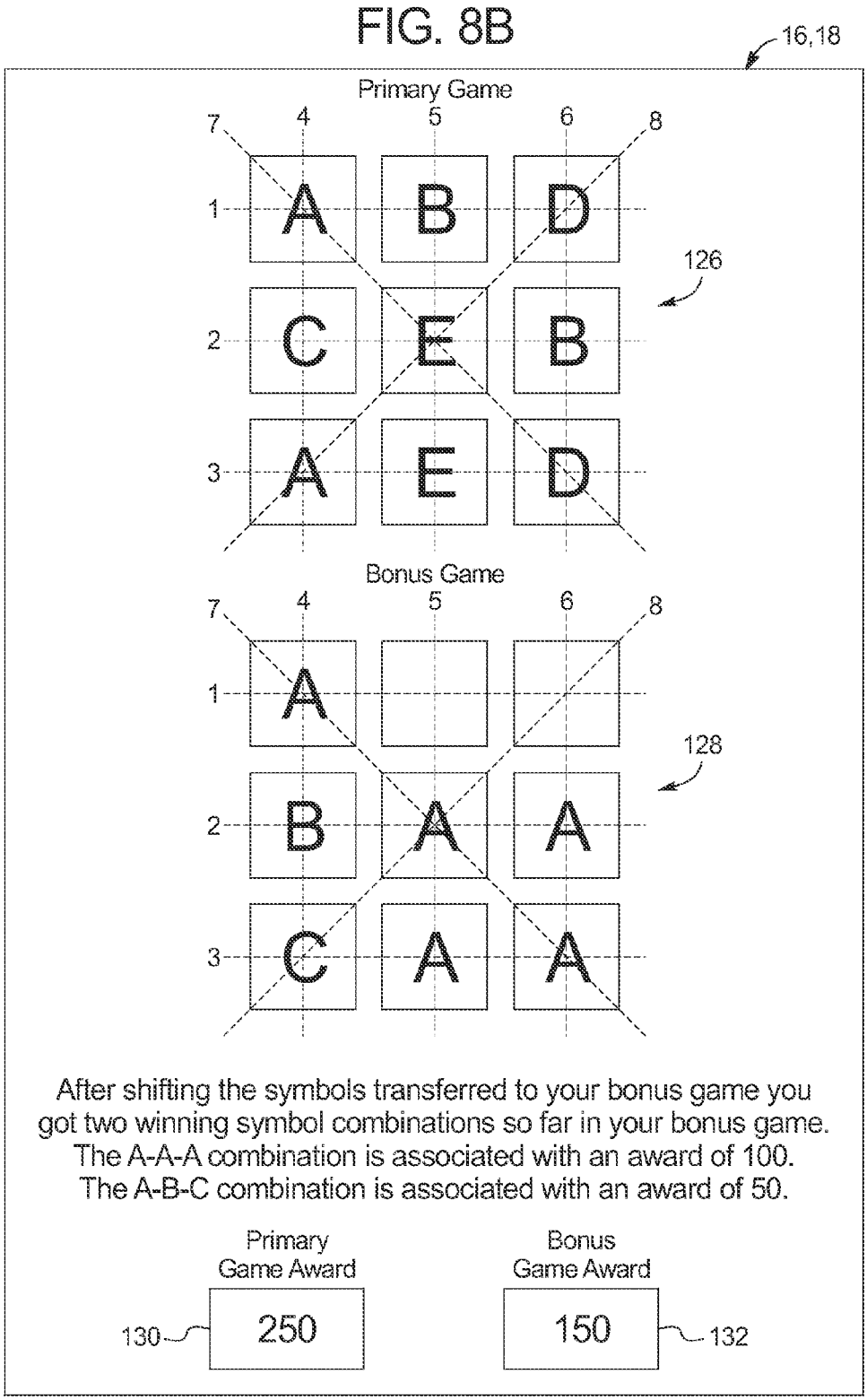

As seen in FIG. 8B, the gaming system then shifts one or more of the transferred symbols downward to fill one or more of the empty symbol display positions. Following such shifting, the gaming system determines that that the displayed symbol combinations of: (i) A symbol-B symbol-C symbol generated on payline four of the second symbol display position matrix is a winning symbol combination associated with an award of fifty, and (ii) A symbol-A symbol-A symbol generated on payline seven of the second symbol display position matrix is a winning symbol combination associated with an award of one-hundred. Accordingly, the gaming system provides a bonus award of one-hundred-fifty credits to the player (as indicated in bonus game award meter 132) and provides appropriate messages such as "YOU GOT TWO WINNING SYMBOL COMBINATIONS SO FAR IN YOUR BONUS GAME", "THE A-A-A COMBINATION IS ASSOCIATED WITH AN AWARD OF 100", and "THE A-B-C COMBINATION IS ASSOCIATED WITH AN AWARD OF 50" to the player visually, or through suitable audio or audiovisual displays.

Figure 8C:
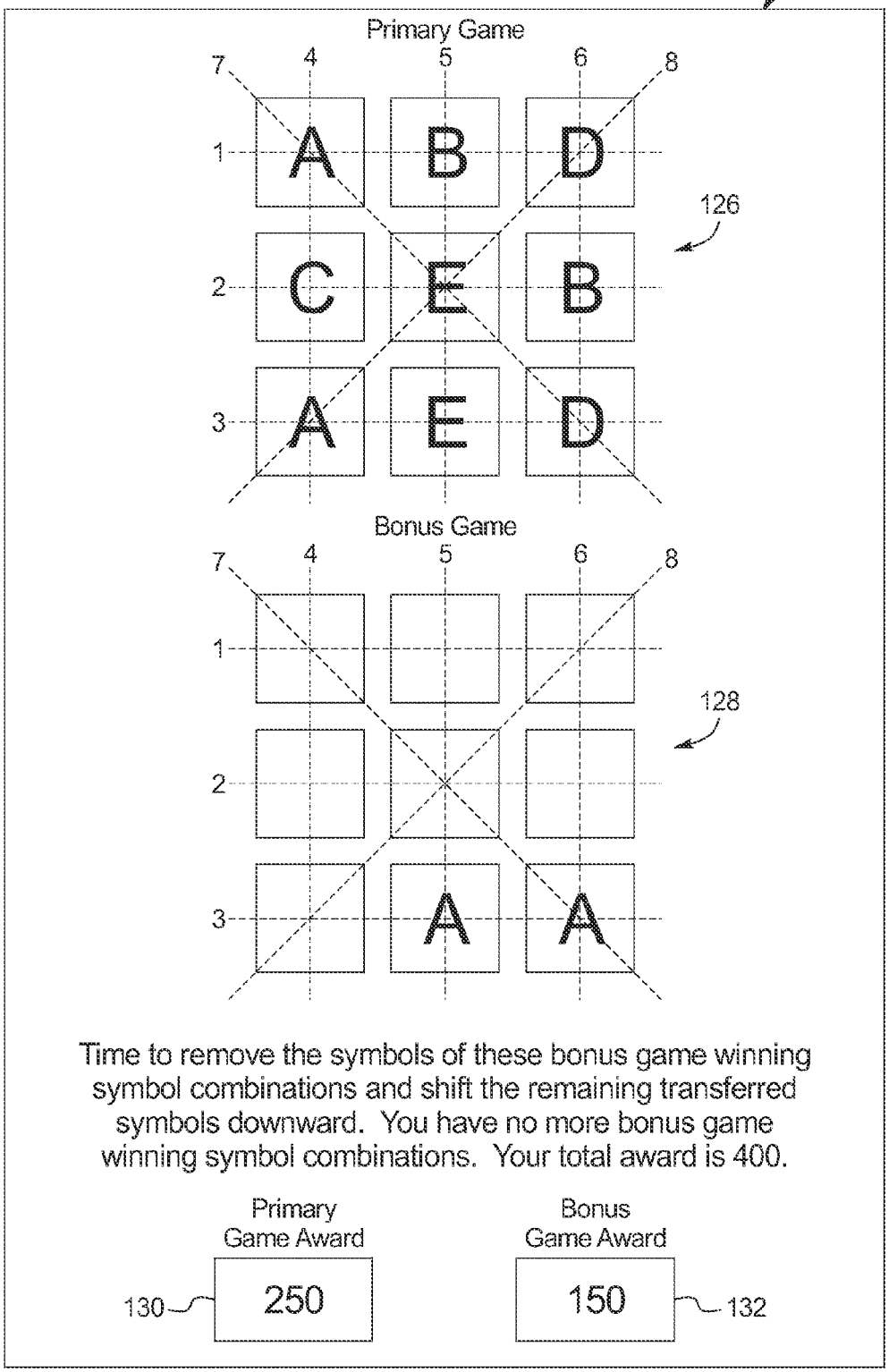

In this example, as seen in FIG. 8C, the gaming system then removes each of the symbols of the displayed winning symbol combinations from the second symbol display position matrix to create a plurality of additional empty symbol display positions of this second symbol display position matrix. Following this removal, the gaming system shifts one or more of the remaining transferred symbols downward to fill one or more of the created empty symbol display positions. The gaming system then determines that none of the displayed symbol combinations of the second symbol display position matrix form any winning symbol combinations and terminates the play of the bonus game. As seen in FIG. 8C, the gaming system provides appropriate messages such as "TIME TO REMOVE THE SYMBOLS OF THESE BONUS GAME WINNING SYMBOL COMBINATIONS AND SHIFT THE REMAINING TRANSFERRED SYMBOLS DOWNWARD", "YOU HAVE NO MORE WINNING SYMBOL COMBINATIONS", and "YOUR TOTAL AWARD IS 400" to the player visually, or through suitable audio or audiovisual displays.

It should be appreciated that one embodiment in which any symbols removed from the second symbol display position matrix are transferred to a third symbol display position matrix and so on, depending on how such removed symbols are transferred and evaluated, the same transferred symbols may continue to form winning symbol combinations indefinitely. For example, if the A symbol-B symbol-C symbol generated on payline four of the second symbol display position matrix are removed from the second symbol display position matrix and transferred, in their respective symbol display positions, to a third symbol display position matrix, this symbol combination will form a winning symbol combination on the third symbol display position matrix (and any subsequent transferred symbol display position matrices). Accordingly, to avoid such a situation, one or more symbols that are removed from one symbol display position matrix and transferred to another symbol display matrix are evaluated according to different sets of evaluation rules. For example, if the same winning symbol combination is generated in the same symbol display positions of two different symbol display position matrices, the gaming system terminates the play of the bonus game.

C. Reusing Removed Symbols to Form Target Patterns

In various different embodiments, the gaming system reuses one or more symbols by providing the player an additional award opportunity which employs one or more target or designated patterns of symbols. In these embodiments, the gaming system transfers certain of the generated symbols to a second symbol display position matrix or grid. Following the transfer of any symbols to the second symbol display position matrix (either in association with a single play of a game or in association with a plurality of transfers from a plurality of plays of a game), the gaming system evaluates whether such transferred symbols form one or more target or designated patterns of symbols. If a target or designated pattern or symbols is formed in the second symbol display position matrix, the gaming system provides the player an additional award.

In one such embodiment, for each symbol removed from a symbol display position of the symbol display position matrix of the primary cascading symbols game (i.e., a symbol which is part of a winning symbol combination) that corresponds to a symbol of a target pattern of symbols, that removed symbol is transferred to the same corresponding symbol display position of a second symbol display position matrix. For example, as seen in FIG. 9A, if only winning symbols are saved towards matching the target pattern, then, assuming three letter symbols in order and three of the same letter symbols are both winning symbol combinations, then based on the symbols generated in the first symbol display position matrix of the primary cascading symbols game 126, and the symbols of the target pattern 170, some, but not all, of the symbols of the winning symbol combinations would form the bonus game pattern and be transferred to the secondary symbol display position matrix 172.

In another such embodiment, for each symbol generated at a symbol display position of the symbol display position matrix of the primary cascading symbols game (i.e., a symbol which may or may not be part of a winning symbol combination) that corresponds to a symbol of a target pattern of symbols, that generated symbol is transferred to the same corresponding symbol display position of a second symbol display position matrix. For example, as seen in FIG. 9B, if any symbols generated in an appropriate symbol display position are transferred, then based on the symbols generated in the first symbol display position matrix of the primary cascading symbols game 126, and the symbols of the target pattern 170, each of the symbols generated in a corresponding symbol display position that matches a symbol associated with a symbol display position of the target pattern would form the bonus game pattern and be transferred to the secondary symbol display position matrix 172. As seen in FIGS. 9A and 9B, the gaming system provides appropriate messages such as "LET'S SEE HOW YOUR REMOVED SYMBOLS MATCH UP WITH THE TARGET PATTERN" to the player visually, or through suitable audio or audiovisual displays.

Figure 9A:
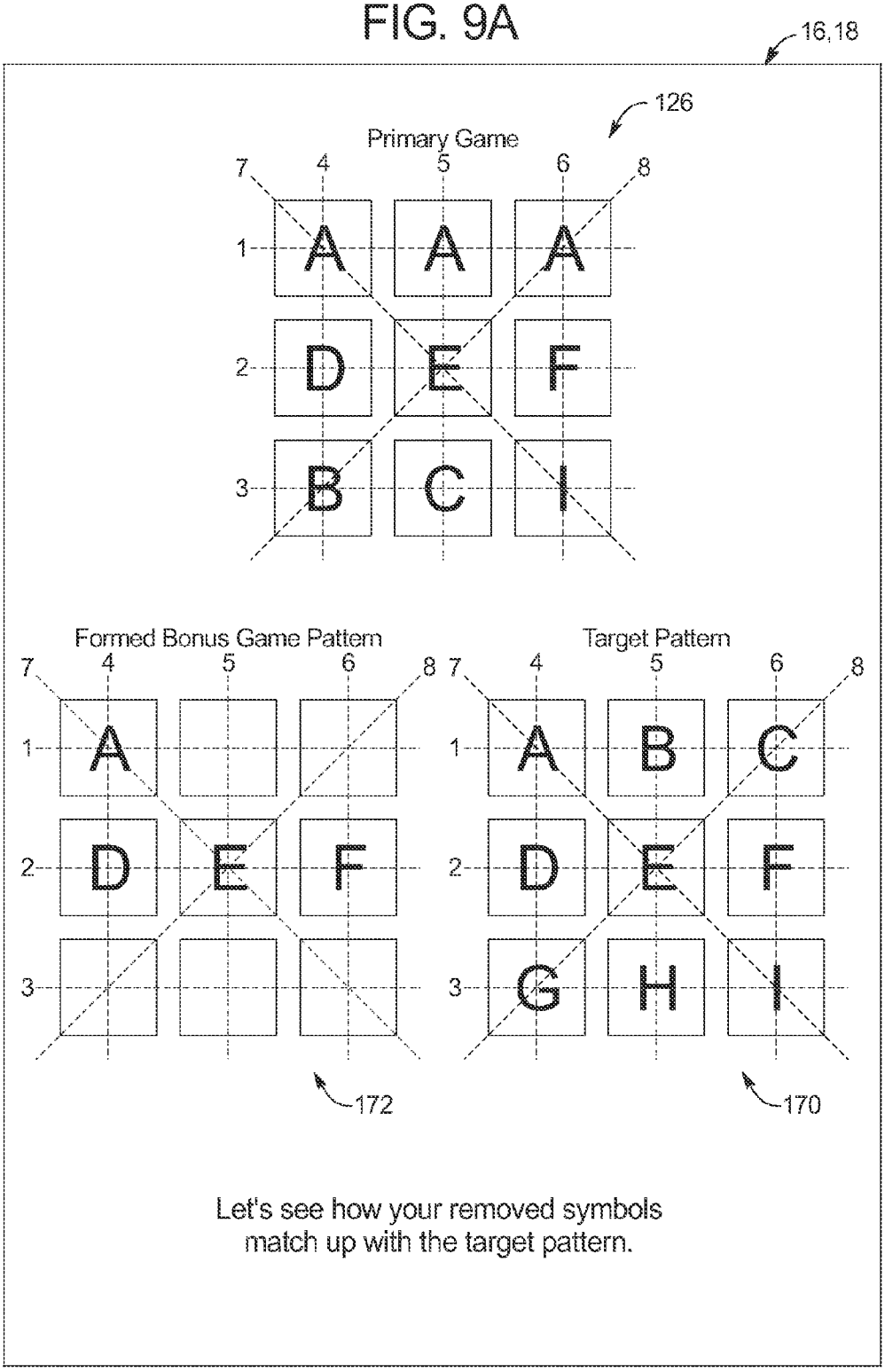
FIGS. 9A and 9B are front views of different embodiments of the gaming system disclosed herein illustrating different pluralities of the removed symbols of FIGS. 5A and 5B transferred to a second or bonus symbol display position grid and compared to a target symbol pattern.
Figure 9B:
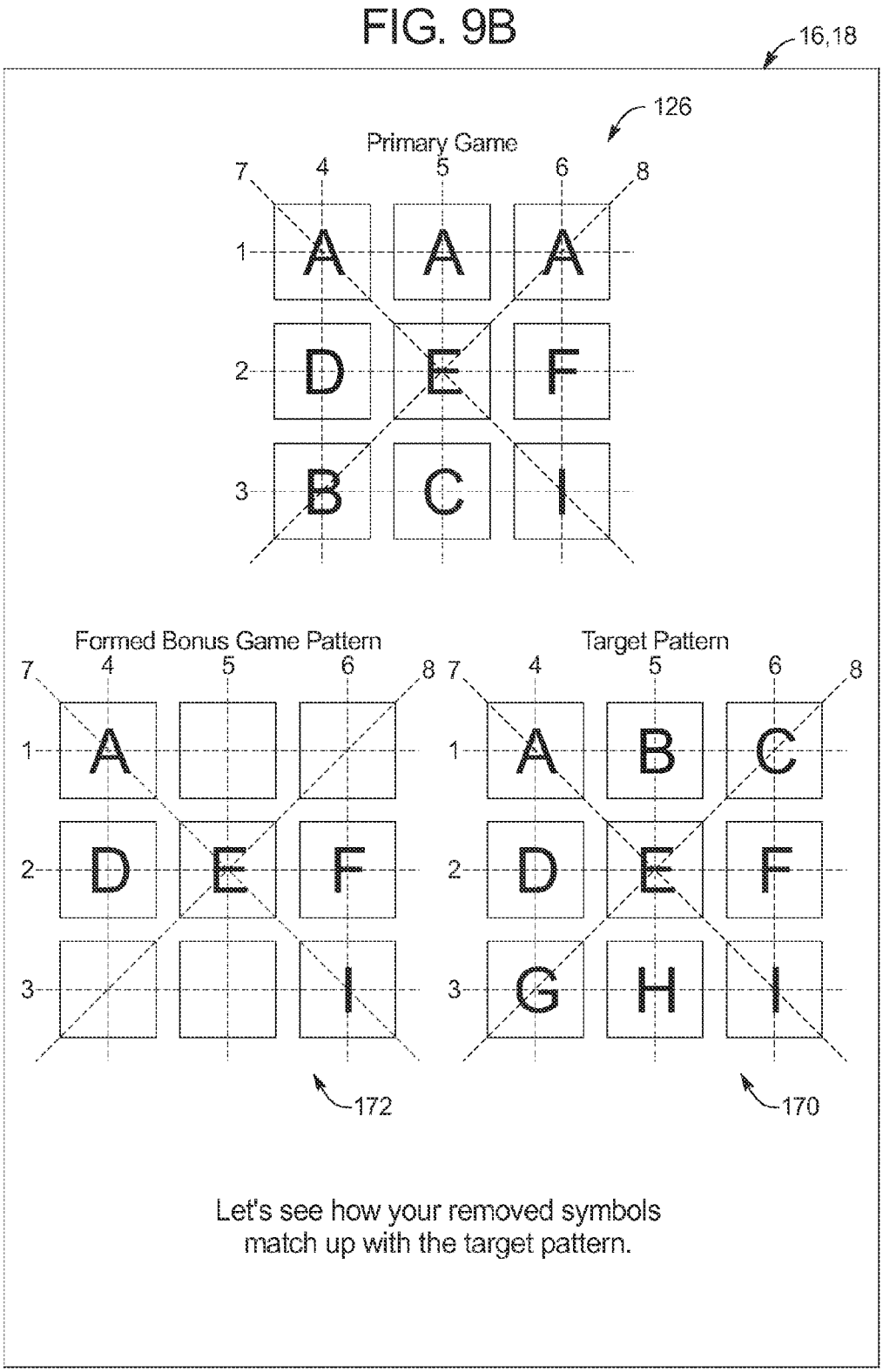

In one embodiment, as seen in FIGS. 9A and 9B, the removed symbols from one play of a game are transferred to the secondary symbol display position matrix. In another embodiment, the removed symbols from a plurality of plays of a game are transferred to the secondary symbol display position matrix. In this embodiment, the gaming system enables the player to accumulate symbols in the secondary symbol display position matrix over time (i.e., over a plurality of plays of a game) wherein when the target pattern is achieved, the gaming system provides the player an award (or triggers a bonus game). In different embodiments, the amount of this award is based on how many games were played to achieve the target pattern.

D. Reusing Removed Symbols Back into Same Symbol Display Position Matrix

Figure 10A:
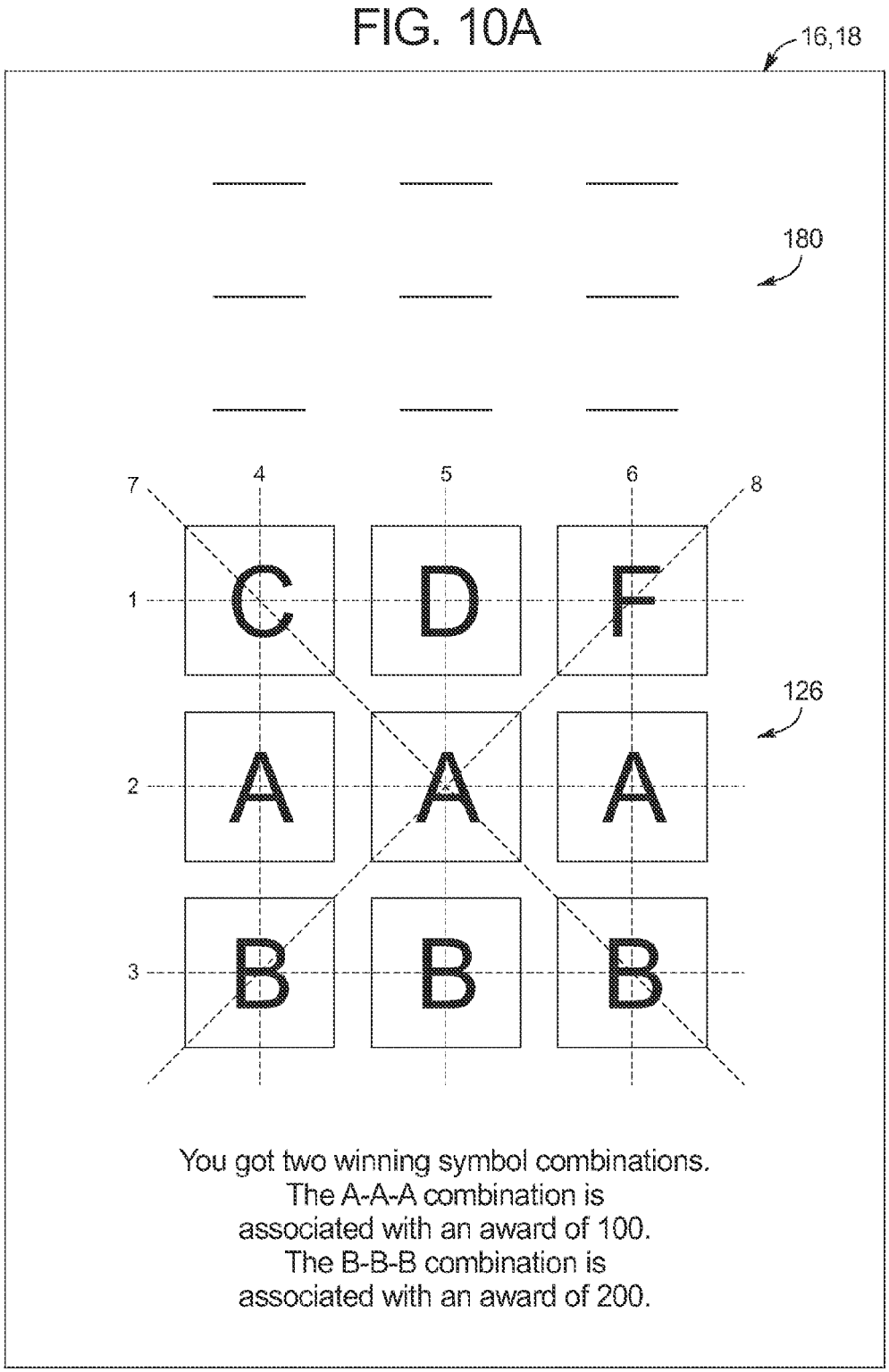
FIGS. 10A and 10B are front views of one embodiment of the gaming system disclosed herein illustrating a plurality of generated symbols removed from a symbol display position grid and saved for a subsequent regeneration in the same symbol display position grid.
Figure 10B:
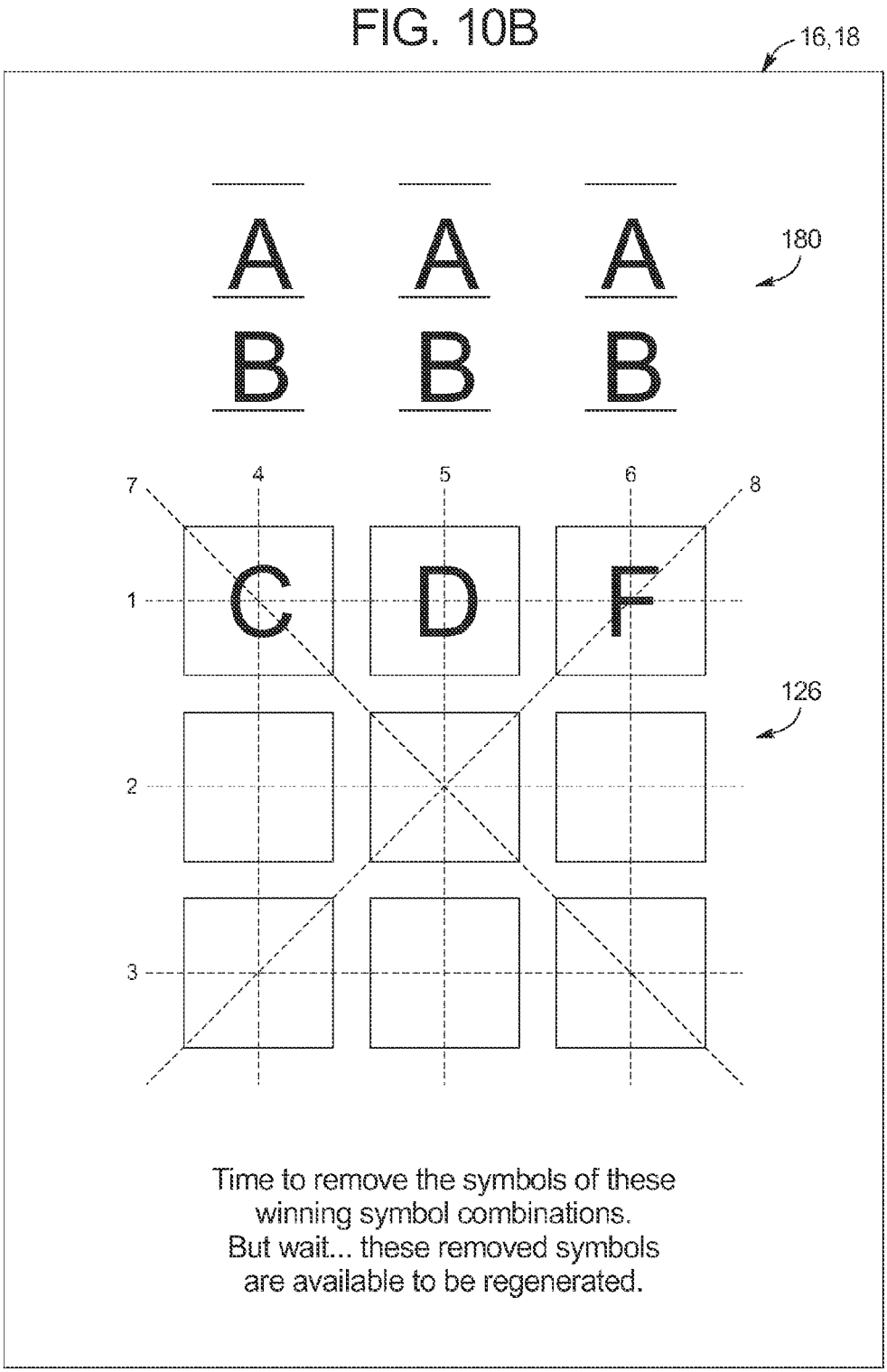

In various different embodiments, the gaming system reuses one or more symbols by providing the player an additional award opportunity which employ utilizing the removed symbols in the same symbol display position matrix which such symbols were initially removed from. For example, as seen in FIGS. 10A and 10B, each symbol removed from a winning symbol combination is transferred to and saved in a designated holding area 180. In this example, such symbols saved in the designated holding area are available for a subsequent generation at one or more of the symbol display positions which these symbols were initially removed from. As seen in FIGS. 10A and 10B, the gaming system provides appropriate messages such as "YOU GOT TWO WINNING SYMBOL COMBINATIONS", "THE A-A-A COMBINATION IS ASSOCIATED WITH AN AWARD OF 100", "THE B-B-B COMBINATION IS ASSOCIATED WITH AN AWARD OF 200", "TIME TO REMOVE THE SYMBOLS OF THESE WINNING SYMBOL COMBINATIONS" and "BUT WAIT . . . THESE REMOVED SYMBOLS ARE AVAILABLE TO BE REGENERATED" to the player visually, or through suitable audio or audiovisual displays.

In one embodiment, each removed symbol is stored in a removed symbols pool which is utilized to repopulate any empty symbol display positions. In one such embodiment, the gaming system utilizes one removed symbols pool for each symbol display position. In another such embodiment, the gaming system utilizes individual removed symbols pools for each symbol display position (i.e., each symbol display position is associated with an individual pool of symbols removed from that symbol display position which can subsequently be reintroduced or regenerated at that symbol display position). In one embodiment, as soon as a symbol is removed from a symbol display position, that removed symbol becomes available to be regenerated in another symbol display position. In another embodiment, an occurrence of a reuse symbol triggering event causes any removed symbols to become available to be reintroduced or regenerated in any empty symbol displays positions (either one at a time or a plurality at a time). It should be appreciated that the regeneration of such removed symbols operates similar to the utilization of any designated wild symbols as described in U.S. Published Patent Application No. 2010/0004050.

In another embodiment, each removed symbol is associated with an indicated quantity, indicated as a numeral in parentheses next to the that removed symbol. In this embodiment, each symbol may be removed the indicated quantity of time before that symbol may no longer be regenerated in one of the symbol display positions. In operation, each time a symbol is removed from a symbol display position, the indicated quantity of that removed symbol is modified. If the modified quantity is greater than a predefined quantity, such as zero, that removed symbol is available to be regenerated in a symbol display position as described above. On the other hand, if the modified quantity of the removed symbol is equal to or less than the predefined quantity, then that removed symbol is unavailable to be regenerated in a symbol display position. It should be appreciated that the utilization of indicated quantities of such removed symbols operates similar to the utilization of the wild symbols useable for a designated quantity of symbol generations as described in U.S. Published Patent Application No. 2010/0022297.

E. Alternative Embodiments of Reusing Removed Symbols

In various different embodiments which employ multiple dimension symbols, the gaming system reuses one or more removed multiple dimension symbols by providing the player an additional award opportunity which utilizes the removed multiple dimension symbols to form or build a shape of removed multiple dimension symbols. In these embodiments, the gaming system transfers different removed multiple dimension symbols from a first symbol display position grid to different depths of a second symbol display position grid. Following one or more of such transfers, the gaming system analyzes the shape or shapes formed by these transferred multiple dimension symbols to determine whether such a formed shape is associated with any awards. For example, the multiple dimension symbols of a first winning symbol combination of a first symbol display position grid are removed and placed at a first depth level of a second symbol display position grid. In this example, the multiple dimension symbols of a second winning symbol combination of the first symbol display position grid are removed and placed at a second depth level of the second symbol display position grid. This example process continues until no more winning symbol combinations are formed, at which point the gaming system determines whether the shape built by the transferred multiple dimension symbols forms a winning shape. If any winning shapes are formed, the gaming system provides the player any award associated with such formed winning shapes.

In one embodiment, the removed symbols from one play of a game are transferred to the second symbol display position grid. In another embodiment, the removed symbols from a plurality of plays of a game are transferred to the second symbol display position grid. In this embodiment, the gaming system enables the player to accumulate symbols in the second symbol display position grid over time (i.e., over a plurality of plays of a game) wherein when a designated shape of multiple dimension symbols is formed, the gaming system provides the player an award (or triggers a bonus game). In different embodiments, the amount of this award is based on how many games were played to build the designated shape of multiple dimension symbols.

In various different embodiments which employ multiple dimension symbols, the gaming system reuses one or more removed multiple dimension symbols by providing the player an additional award opportunity which utilizes the removed multiple dimension symbols by rotating such individual multiple dimension symbols in the symbol display position grid. In these embodiments, since multiple faces of such multiple dimension symbols include symbols, one or more multiple dimension symbols that are part of one or more winning symbol combinations are removed and then reused in the same symbol display position grid by rotating such individual multiple dimension symbols. Such rotations reveal one or more hidden symbols displayed on one or more previously hidden sides of the multiple dimension symbol. In different embodiments, these rotations occur with the multiple dimension symbol in its initial or original symbol display position of the symbol display position grid or when such multiple dimension symbols are added to the symbol display position grid as described above.

In various different embodiments which employ multiple dimension symbols, the gaming system reuses one or more removed multiple dimension symbols by providing the player an additional award opportunity which utilizes the removed multiple dimension symbols by rotating one or more sections of the symbol display position grid. In one such embodiment, any sections of the symbol display position grid that includes any multiple dimension symbols that are part of one or more winning symbol combinations are rotated to remove such symbols and reuse such symbols in a different section of the symbol display position grid. For instance, with a three by three by three cube of multiple dimension symbols (with three planes or sides shown in perspective), if the gaming system determines that a three symbol winning combination occurred along one of the faces, the gaming system causes the slice of the displayed cube containing those symbols to rotate together to another plane.

It should be appreciated that any of the embodiments disclosed herein may be implemented in a non-tumbling reels configuration. That is, after removing zero, one or more generated symbols and reusing such removed symbols in association with an additional award determination, the gaming system does not proceed to shift zero, one or more symbols to fill zero, one or more empty symbol displays and/or generate zero, one or more symbols in any created empty symbol display position. Rather, in one embodiment, after removing zero, one or more generated symbols and reusing such removed symbols in association with an additional award determination, the gaming system terminates that portion of the game and proceed with the additional award determination utilizing the removed symbols. In another embodiments, after removing zero, one or more generated symbols and reusing such removed symbols in association with an additional award determination, the gaming system determines if any additional awards are associated with the generated symbols.

Layering Symbol Display Position Grids

In various embodiments, the gaming system disclosed herein includes a cascading symbol or tumbling reel game which sequentially layers a plurality of adjacent symbol display position grids at different depths.

Figure 11:
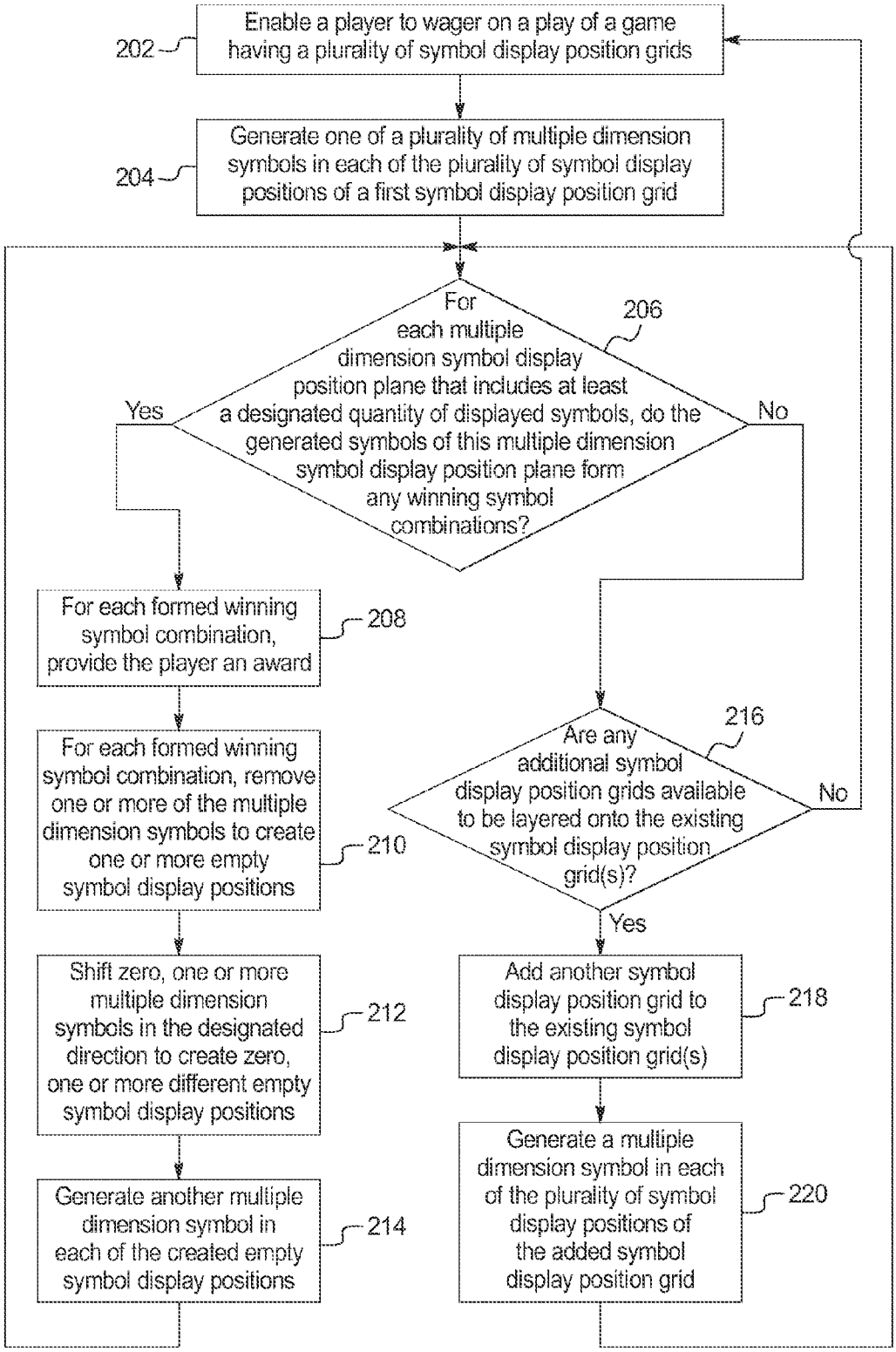
FIG. 11 is a flow chart an example process for operating a gaming system providing the cascading symbol game which sequentially layers a plurality of symbol display position grids.

Specifically, referring now to FIG. 11, a flowchart of an example embodiment of a process for operating a gaming system or a gaming device disclosed herein is illustrated. In one embodiment, this process is embodied in one or more software programs stored in one or more memories and executed by one or more processors or servers. Although this process is described with reference to the flowchart illustrated in FIG. 11, it should be appreciated that many other methods of performing the acts associated with this process may be used. For example, the order of certain steps described may be changed, or certain steps described may be optional.

In one embodiment, as indicated in block 202, the gaming system enables a player to wager on a play of a game having a plurality of symbol display position matrices or grids. In this embodiment, as described above, each symbol display position grid includes a plurality of symbol display positions wherein each symbol display position of each symbol display position grid is associated with a specific row, a specific column and a specific depth.

For a wagered on play of the game, the gaming system generates and displays a multiple dimension symbol from a plurality of multiple dimension symbols in each of the plurality of symbol display positions of a first symbol display position grid as indicated in block 204. In certain embodiments, the gaming system displays the generation of the multiple dimension symbols of a reel game as a cascading or falling symbol game.

Figure 12A:
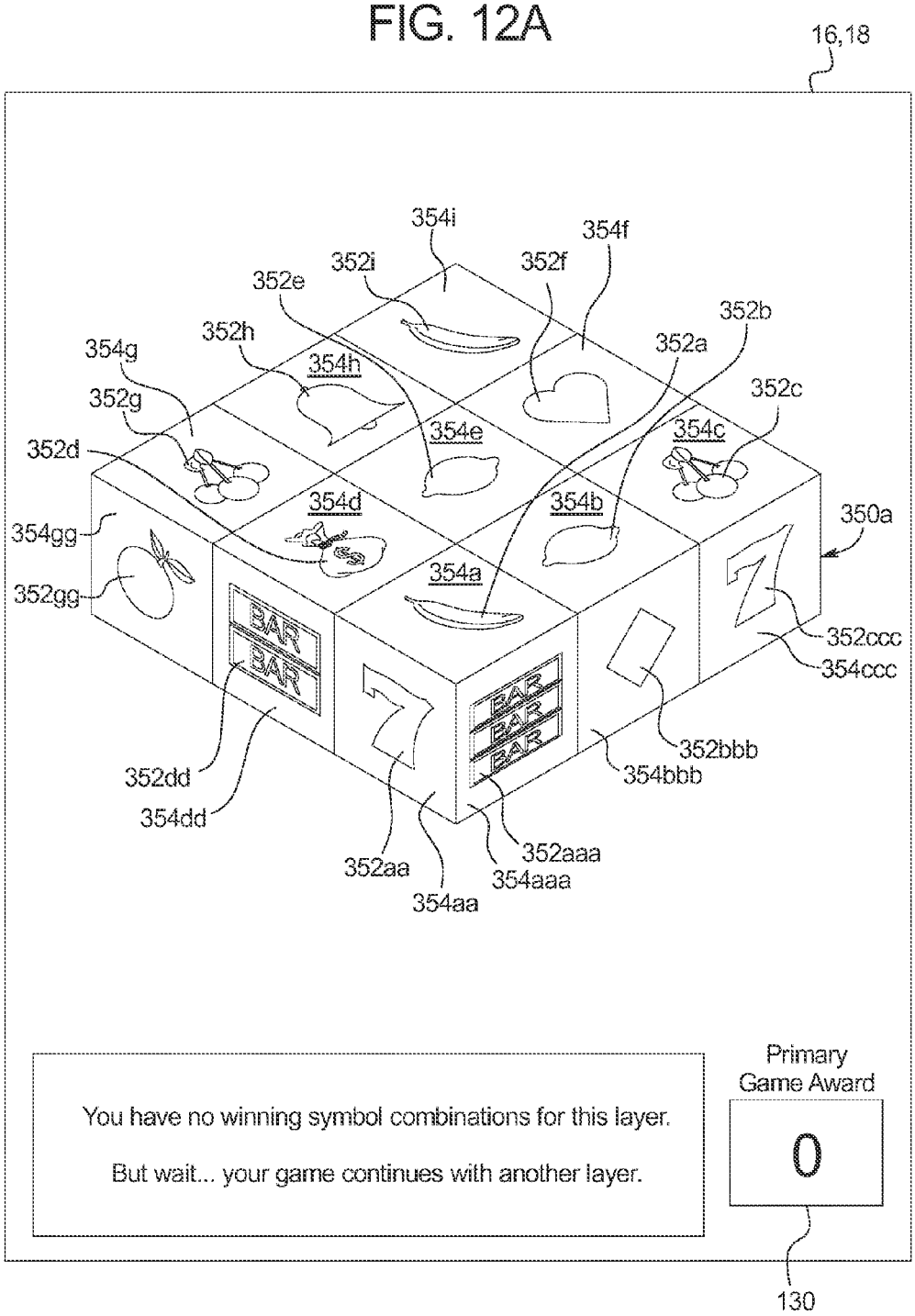
FIGS. 12A, 12B, 12C, 12D and 12E are isometric views of one embodiment of the gaming system disclosed herein illustrating the gaming system sequentially layering a plurality of symbol display position grids and sequentially evaluating the symbols exposed on a plurality of faces or sides of a plurality of multiple dimension symbols included in the layered symbol display position grids.

For example, as illustrated in the isometric view of FIG. 12A, the gaming system generates a plurality multiple dimension symbols 352 at a plurality of symbol display positions 354 of the first symbol display position grid 350*a* of a first depth. As seen in FIG. 12A, the specific static view that this play of the game is displayed to the player causes one or more sides of a plurality of the multiple dimension symbols 352 to be initially displayed to the player and further causes one or more sides of a plurality of the multiple dimension symbols 352 to be initially not displayed to the player. For example, for one of the multiple dimension symbols of the first symbol display position grid, the gaming system displays: (i) the banana symbol 352*a* generated at symbol display position 354*a* on the displayed top side of this multiple dimension symbol, (ii) the seven symbol 352*aa* generated at symbol display position 354*aa* on the displayed left side of this multiple dimension symbol, and (iii) the triple bar symbol 352*aaa* generated at symbol display position 354*aaa* on the displayed right side on this multiple dimension symbol. For another one of the multiple dimension symbols of the first symbol display position grid, the gaming system displays: (i) the lemon symbol 352*b* generated at symbol display position 354*b* on the displayed top side of this multiple dimension symbol, and (ii) the diamond symbol 352*bbb* generated at symbol display position 354*bbb* on the displayed right side of this multiple dimension symbol. For another one of the multiple dimension symbols of the first symbol display position grid, the gaming system displays only the hearth symbol 352*f* generated at symbol display position 354*f* on the displayed top side of this multiple dimension symbol.

After generating a plurality of multiple dimension symbols, for each multiple dimension symbol display position plane or surface that includes at least a designated quantity of displayed symbols, the gaming system evaluates the symbols of that multiple dimension symbol display position plane to determine whether the generated symbols form any winning symbol combinations as indicated in diamond 206 of FIG. 11. As described above, the gaming system evaluates the generated symbols along one or more paylines (or which form one or more ways to win) to determine whether such symbols form any winning symbol combinations. For example, as seen in FIG. 12A, if the designated quantity of displayed symbols is nine displayed symbols (i.e., enough symbols to form a 3×3 grid of symbols), the gaming system evaluates the symbols at the symbol display positions on the displayed top sides of the generated multiple dimension symbols of the first symbol display position grid.

If the generated symbols (of a symbol display position plane that includes at least the designated quantity of displayed symbols) form one or more winning symbol combinations as indicated in block 208 of FIG. 11, for each formed winning symbol combination, the gaming system provides the player an award associated with the formed winning symbol combination. The gaming system then removes one or more of the multiple dimension symbols included in one or more of the formed winning symbol combinations to create one or more empty symbol display positions as indicated in block 210.

Following the removal of one or more multiple dimension symbols from one or more symbol display positions, the gaming system shifts zero, one or more multiple dimension symbols in the designated direction to generate zero, one or more different empty symbol display positions and generates another multiple dimension symbol in each of the created empty symbol display positions as indicated in blocks 212 and 214. After such generation, the gaming system returns to diamond 206 and proceeds with determining whether the generated symbols (i.e., the non-removed multiple dimension symbols from a previous generation of at least one multiple dimension symbol and the newly generated multiple dimension symbols) of each symbol display position plane that includes at least the designated quantity of displayed symbols) form any winning symbol combinations.

On the other hand, if the generated symbols (of a symbol display position plane that includes at least the designated quantity of displayed symbols) do not form one or more winning symbol combinations, as indicated in diamond 216, the gaming system determines if any additional symbol display position grids remain available to be layered onto the existing symbol display position grid(s).

If no symbol display position grids remain, the gaming system ends the play of the game and returns to block 202 to enable the player to place another wager on another play of the game. That is, if, as described below, each of the plurality of symbol display position grids have been layered upon each other, the gaming system ends the play of the game.

On the other hand, if at least one symbol display position grid remains available, the gaming system adds or layers another symbol display position grid to the existing symbol display position grid and generates a multiple dimension symbol from a plurality of multiple dimension symbols in each of the plurality of symbol display positions of the added symbol display position grid as indicated in blocks 218 and 220. It should be appreciated that each added or layered symbol display position grid of this embodiment include one or more symbol display positions that are aligned with or otherwise correspond with one or more symbol display positions of one or more other symbol display position grids of different depths. That is, one or more of the layered symbol display position grids are positioned (relative to the player's line of sight) adjacent to one or more existing symbol display position grids. Such a configuration provides that one or more symbol display positions of one or more of the symbol display position grids are positioned (relative to the player's line of sight) to block one or more symbol display positions of one or more other symbol display position grids. Accordingly, the symbols of one or more symbol display position planes may be displayed and analyzed for one award evaluation and subsequently blocked and not analyzed for another award evaluation.

Figure 12B:
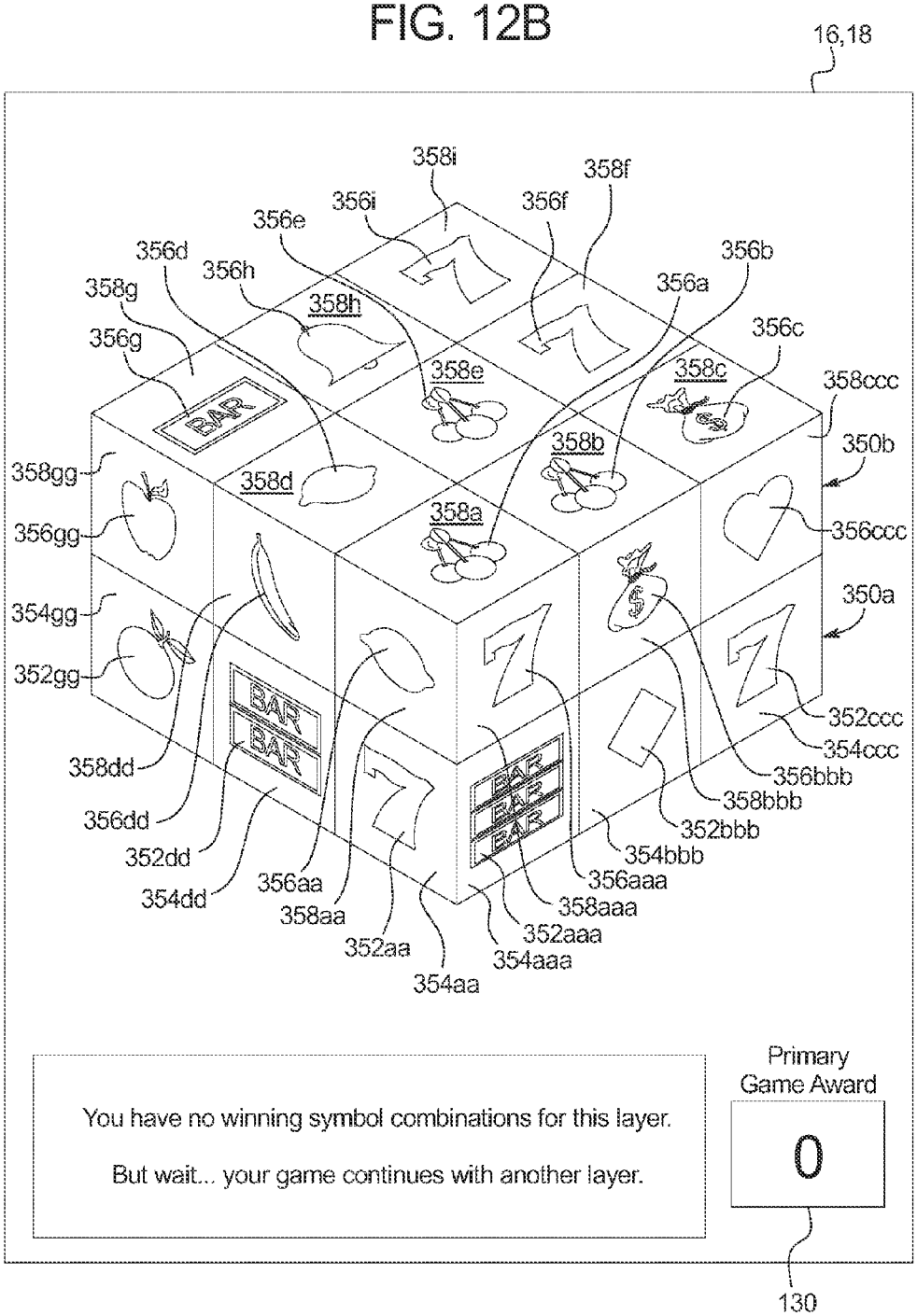

For example, as illustrated in FIG. 12B, after determining that no winning symbol combinations were formed in the first symbol display position grid 350*a*, the gaming system generates a plurality of multiple dimension symbols 356 at a plurality of symbol display positions 358 of the second symbol display position grid 350*b*. In this example, the addition of the plurality of the multiple dimension symbols 356 of the second symbol display position grid 350*b* blocked the player's view of each of the top sides of each of the multiple dimension symbols 352 of symbol display position grid 350*a*. That is, because symbol display position grid 350*b* is positioned on top of symbol display position grid 350*a*, one or more sides of one or more of the multiple dimension symbols 352 generated at the plurality of symbol display positions 354 of symbol display position grid 350*a* become blocked and are no longer displayed to the player.

Following the generation and display of the plurality of multiple dimension symbols in the plurality of symbol display positions of another symbol display position grid, the gaming system returns to diamond 206 of FIG. 11 and proceeds as described above until no more winning symbol combinations are formed and no more symbol display position grids remain available to be added.

Figure 12C:
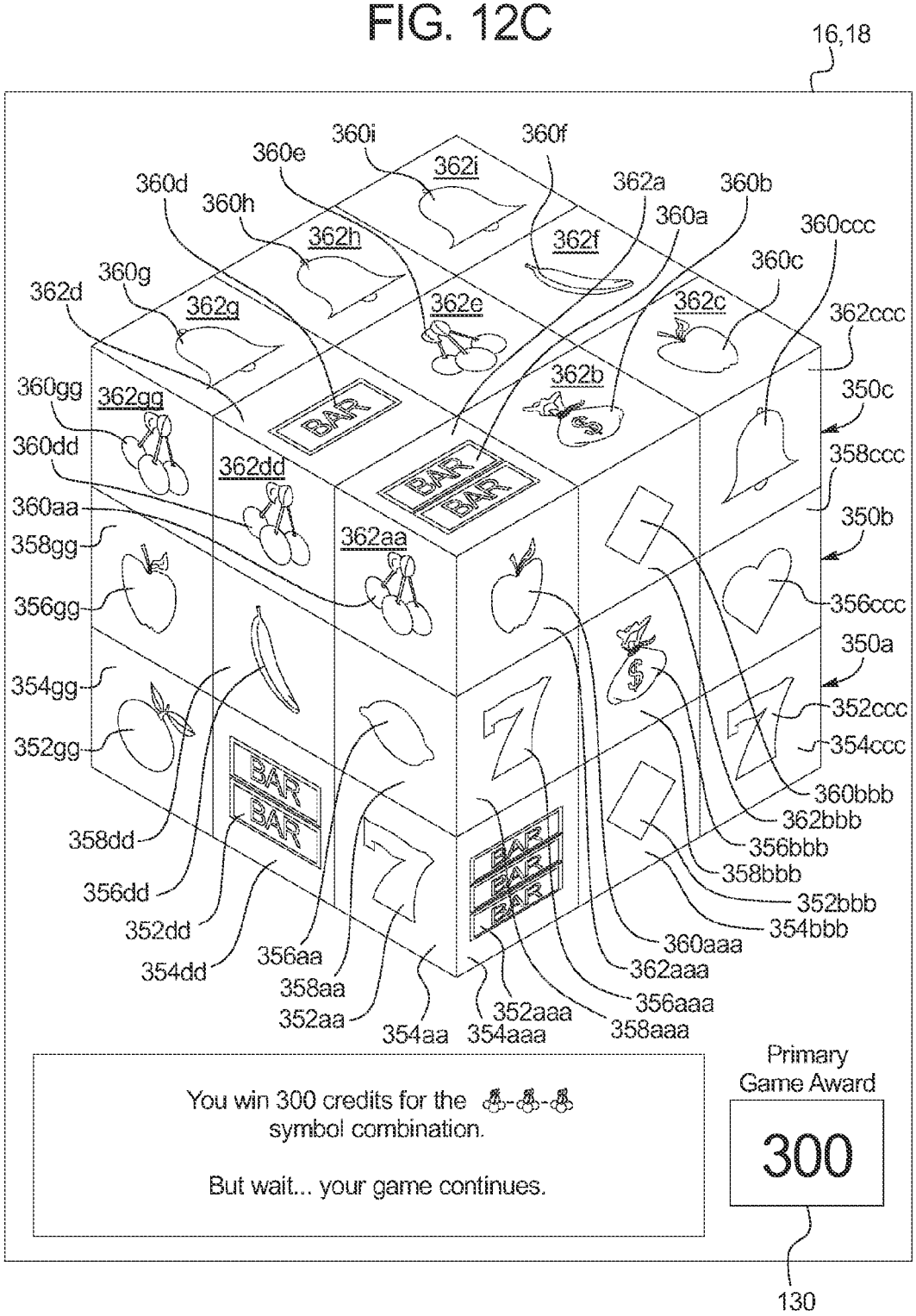

In certain embodiments, after a designated quantity of symbol display position grids are layered upon each other, for one play of the game, the gaming system evaluates the symbols exposed on a plurality of faces or sides of a plurality of multiple dimension symbols. For example, as seen in FIG. 12C, if the designated quantity of symbols in each symbol display position plane is nine symbols (i.e., a symbol display position plane must include nine symbols before the symbols of that symbol display position plane are evaluated for any winning symbol combinations), once the third symbol display position grid 350*c* is added, each symbol display position plane includes nine symbols and thus the gaming system evaluates each of the displayed symbols of each symbol display position plane for any winning symbol combinations. Such a configuration provides the player with additional opportunities to win awards in association with a plurality of grids of symbol display positions. In another embodiment, the gaming system evaluates the symbols exposed on a plurality of faces or sides of a plurality of multiple dimension symbols regardless of the quantity of symbols displayed in that symbol display position plane.

Continuing with the illustrated example, as seen in FIG. 12C, after determining that no winning symbol combinations were formed in any evaluated symbol display position planes, the gaming system added the third and final symbol display position grid 350*c* to the two existing symbol display position grids and generated a plurality of symbols 360 at a plurality of symbol display positions 362 of the third and final symbol display position grid 350*a*. In this illustrated example, because symbol display position grid 350*c* is positioned on top of symbol display position grid 350*b* (which is positioned on top of symbol display position grid 350*a*), one or more sides of one or more of the multiple dimension symbols 356 generated at the plurality of symbol display positions 358 of symbol display position grid 350*b* are blocked and no longer displayed to the player.

After generating a plurality of multiple dimension symbols for the additional symbol display position grid, as described above, for each multiple dimension symbol display position planes or surfaces with the designated quantity of symbols, the gaming system evaluates the symbols currently displayed to the player to determine if any awards are associated with any currently displayed symbol combinations. Specifically, as seen in FIG. 12C, the gaming system evaluates each of the displayed sides or faces of the displayed multiple dimension symbols which form the top multiple dimension symbol display position plane, the left multiple dimension symbol display position plane and the right multiple dimension symbol display position plane. In this example, starting with the left multiple dimension symbol display position plane, the gaming system determines that the displayed combination of cherry symbol-cherry symbol-cherry symbol of this left multiple dimension symbol display position plane is a winning symbol combination. In this example, the gaming system provides an award of three-hundred credits to the player and provides appropriate messages such as "YOU WIN 300 CREDITS FOR THE CHERRY-CHERRY-CHERRY SYMBOL COMBINATION" and "BUT WAIT . . . YOUR GAME CONTINUES" to the player visually, or through suitable audio or audiovisual displays.

Figure 12D:
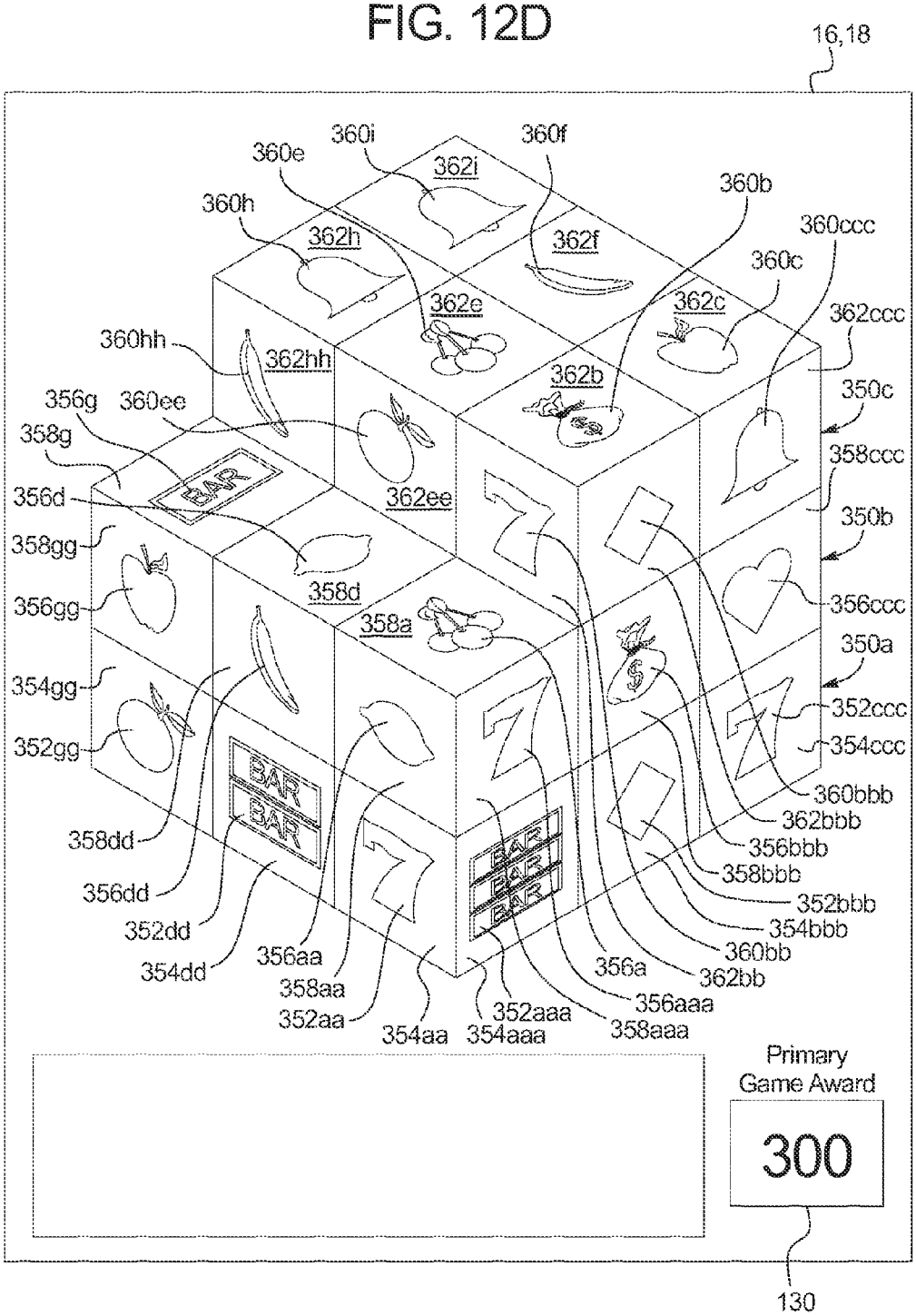

As seen in FIG. 12D, after determining any displayed winning symbol combination, the gaming system then removes each of the multiple dimension symbols of the displayed winning symbol combination of cherry symbol-cherry symbol-cherry symbol. In this example, as seen in FIG. 12D, the removal of these multiple dimension symbols from the left multiple dimension symbol display position plane causes a plurality of empty symbol display positions in symbol display position grid 350*c* to be created.

When one, or more empty symbol display positions are created in a symbol display position grid (due to the above-described removal of one or more multiple dimension symbols), one or more sides or faces of one or more multiple dimension symbols of the same symbol display position grid of the removed multiple dimension symbol may be exposed. That is, the removal of a multiple dimension symbol from a symbol display position grid results in previously hidden sides of other multiple dimension symbols from the same symbol display position grid becoming exposed for award evaluation purposes. In this embodiment, the created empty symbol display positions causes a plurality of the faces or sides of a plurality of multiple dimension symbols to be displayed to the player. For example, as seen in FIG. 12D, the removal of the multiple dimension symbol with the cherry symbol 360*aa* causes both: (i) the cherry symbol 356*a* of one side of the multiple dimension symbol generated at symbol display position 358*a* and (ii) the seven symbol 360*bb* of one side of the multiple dimension symbol generated at symbol display position 362*bb*, to be displayed to the player. Thus, the creation of one or more empty symbol display positions in one or more symbol display position grids causes zero, one or more previously hidden faces or sides of one or more multiple dimension symbols at one or more corresponding symbol display positions in one or more symbol display position grids to become displayed to the player.

Figure 12E:
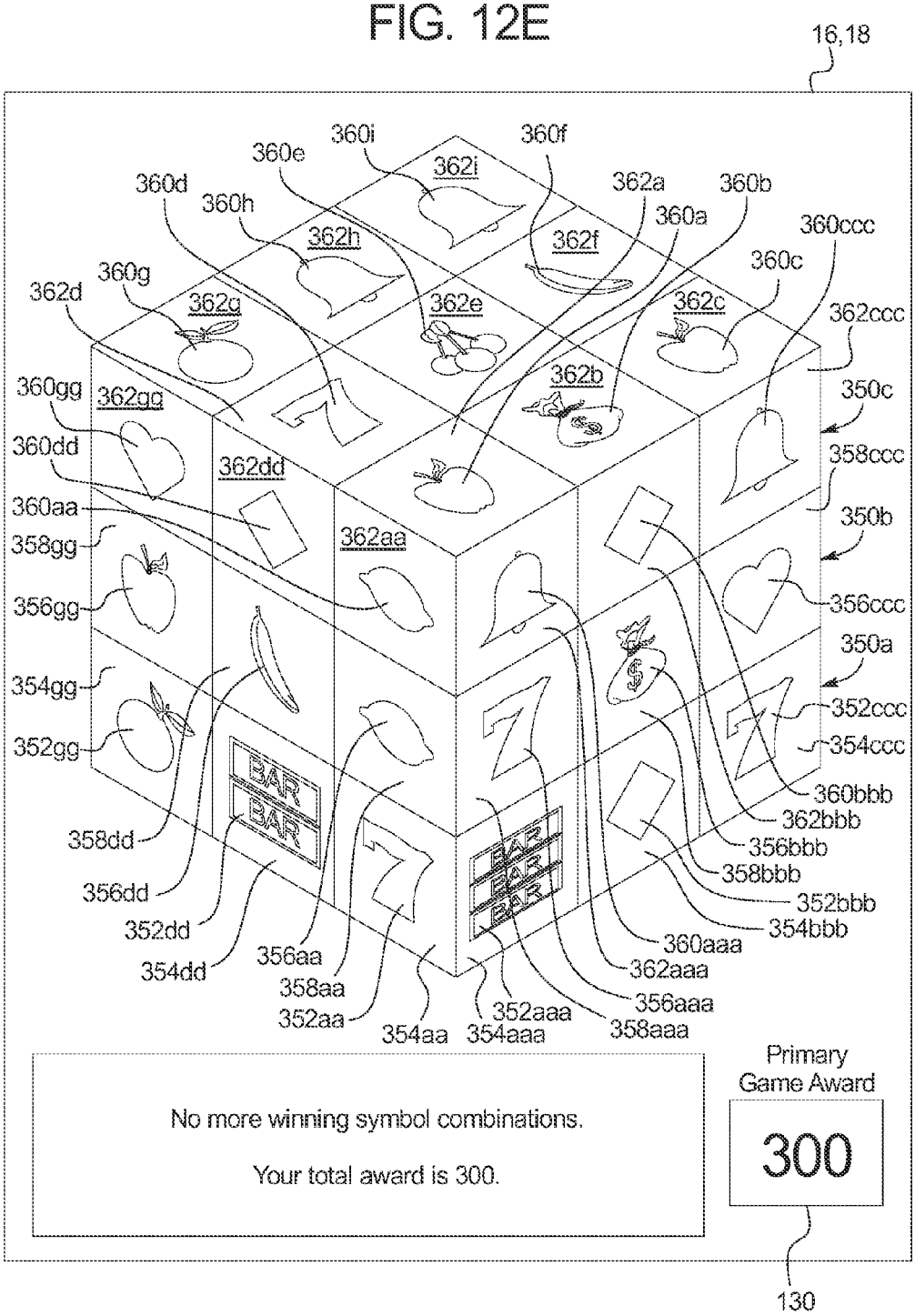

After removing any multiple dimension symbols which include any symbol sides which form part of any winning symbol combination, the gaming system generates a new symbol for each empty symbol display position. Specifically, as seen in FIG. 12E, the gaming system generates: (A) one multiple dimension symbol which includes: (i) the apple symbol 360*a* generated at symbol display position 362*a* on the displayed top side of this multiple dimension symbol, (ii) the lemon symbol 360*aa* generated at symbol display position 362*aa* on the displayed left side of this multiple dimension symbol, and (iii) the bell symbol 360*aaa* generated at symbol display position 362*aaa* on the displayed right side on this multiple dimension symbol; (B) one multiple dimension symbol which includes: (i) the seven symbol 360*d* generated at symbol display position 362*d* on the displayed top side of this multiple dimension symbol, and (ii) the diamond symbol 360*dd* generated at symbol display position 362*dd* on the displayed left side of this multiple dimension symbol, and (C) one multiple dimension symbol which includes: (i) the orange symbol 360*g* generated at symbol display position 362*g* on the displayed top side of this multiple dimension symbol, and (ii) the heart symbol 360*gg* generated at symbol display position 362*gg* on the displayed left side of this multiple dimension symbol.

After such multiple dimension symbol generation, the gaming system again evaluates the symbols displayed on the left multiple dimension symbol display position plane. In this example, after determining that no winning symbol combinations are formed from the symbol sides displayed on the left multiple dimension symbol display position plane, the gaming system proceeds to any remaining unevaluated multiple dimension symbol display position planes to determine if any winning symbol combinations are formed.

As seen in FIG. 12E, in this example, after determining that the left multiple dimension symbol display position plane includes no winning symbol combinations, the gaming system proceeds to evaluate the right multiple dimension symbol display position plane. After determining that the right multiple dimension symbol display position plane includes no winning symbol combinations, the gaming system proceeds to evaluate the top multiple dimension symbol display position plane. After determining that the top multiple dimension symbol display position plane includes no winning symbol combinations, the gaming system determines that no multiple dimension symbol display position planes remain unevaluated and ends the play of the game. Accordingly, as seen in FIG. 12E, the gaming system provides appropriate messages such as "NO MORE WINNING SYMBOL COMBINATIONS" and "YOUR TOTAL AWARD IS 300" to the player visually, or through suitable audio or audiovisual displays.

In one embodiment, as described above, the gaming system evaluates the symbol sides of a multiple dimension symbol display position plane, removes any multiple dimension symbols with any symbol sides included in a winning symbol combination, shifts and/or generates one or more additional multiple dimension symbols and reevaluates the symbol sides of this multiple dimension symbol display position plane before proceeding to the next multiple dimension symbol display position plane. In this embodiment, the removal of one or more multiple dimension symbols associated with one multiple dimension symbol display position plane may affect the symbols displayed in another multiple dimension symbol display position plane. In one such embodiment, the removal of one or more multiple dimension symbols associated with one multiple dimension symbol display position plane may cause a non-winning symbol combination to be replaced with a winning symbol combination. In another such embodiment, the removal of one or more multiple dimension symbols associated with one multiple dimension symbol display position plane may cause a winning symbol combination to be replaced with a non-winning symbol combination. For example, as seen in FIG. 12C to 12E, the removal of the cherry symbol-cherry symbol-cherry symbol winning symbol combination of the left multiple dimension symbol display position plane also caused a removal of the bell symbol 360*g* generated in symbol display position 362*g*. In this example, the removal of this bell symbol caused the previously displayed bell symbol-bell symbol-bell symbol winning combination to be replaced with the currently displayed non-winning orange symbol-bell symbol-bell symbol winning combination.

In another embodiment, the gaming system evaluates the symbol sides of the multiple dimension symbols which form a multiple dimension symbol display position plane, and proceeds to the next multiple dimension symbol display position plane before removing any symbols from any winning symbol combination. For example, if this embodiment were implemented with the multiple dimension symbols generated in FIG. 12C, the gaming system would provide the player the award associated with the cherry symbol-cherry symbol-cherry symbol winning symbol combination of the left multiple dimension symbol display position plane and then, before removing any of these symbols, provide the player the award associated with the bell symbol-bell symbol-bell symbol winning combination of the top multiple dimension symbol display position plane.

It should be appreciated that by sequentially layering a plurality of symbol display position grids together, after a designated quantity of symbol display position grids are layered upon each other, when determining if any awards are associated with the currently displayed symbols, the gaming system evaluates the multiple dimension symbols displayed at a plurality of symbol display positions of a plurality of symbol display position grids of a plurality of different depths. That is, since the gaming system of this embodiment only evaluates the symbols that are currently displayed to the player and different symbols positioned at different depths may be currently displayed to the player (due to addition of one or more symbol display position grids), the gaming system is configured to evaluate symbols displayed at different depths to determine any additional awards to provide to the player. For example, as seen in FIG. 12C, the symbols which form the evaluated left multiple dimension symbol display position plane include symbols from the first symbol display position grid 350*a* of the first depth, the second, layered symbol display position grid 350*b* of the second depth and the third, layered symbol display position grid 350*c* of the third depth.

In another embodiment, the gaming system evaluates one or more symbols displayed to a player and one or more symbols hidden from the player. For example, when a second symbol display position grid is layered onto a first symbol display position grid (thus hiding one or more symbols of the first symbol display position grid), the gaming system evaluates the symbols in the hidden first symbol display position grid with the symbols of the second symbol display position grid to determine any awards.

In one embodiment, as described above, each of the symbol display position grids include the same quantity of symbol display positions in the same configuration, such as the 3×3×1 configuration illustrated in FIGS. 12A to 12E. In another embodiment, a plurality of the symbol display position grids include different quantities of symbol display positions. For example, a first symbol display position grid includes nine symbol display positions while a second, additional symbol display position grid includes six symbol display positions. In another embodiment, a plurality of the symbol display position grids include different configurations of the same quantity of symbol display positions. For example, a first symbol display position grid includes six symbol display positions in a 2×3×1 configuration while a second, additional symbol display position grid includes six symbol display positions in a 3×2×1 configuration. In another embodiment, a plurality of the symbol display position grids include different quantities of symbol display positions in different configurations. For example, a first symbol display position grid includes symbol display positions in a 4×4×1 configuration while a second, additional symbol display position grid includes symbol display positions in a 2×2×2 configuration.

In another embodiment, the gaming system enables a player to purchase one or more additional symbol display position grids. In this embodiment, the gaming system provides the player different betting options to choose how many layers they want to play. In one such embodiment, each symbol display position grid is associated with additional award opportunities or larger payouts such that the symbol display position grids become increasingly more expensive to purchase. For example, a first symbol display position grid layer includes wild symbols with 1× multipliers, the second symbol display position grid layer includes wild symbols with 2× multipliers and the third symbol display position grid layer includes wild symbols with 3× multipliers. In different embodiments, these layers of purchased symbol display position grids could be layered or stacked all at once or layered over time.

In another embodiment, rather than layering additional symbol display position grids when the gaming system determines that no winning symbol combinations exist for an existing symbol display position grid (or an existing combination of layered symbol display position grids), the gaming system adds additional multiple dimension symbols at different depths based on one or more winning symbol combinations being generated. For example, if a winning symbol combination is determined for a first symbol display position grid, the gaming system causes additional multiple dimension symbols to be generated at one or more of the symbol display positions of a second symbol display position grid of a second depth. In this example, the gaming system generates the additional multiple dimension symbols at the symbol display positions of the second symbol display position grid that correspond or are otherwise associated with the symbol display positions which included the winning symbols of the first symbol display position grid. This process of adding multiple dimension symbols at different depths (in response to winning symbol combination being generated) continues until no more winning symbol combinations are generated. At that point, the gaming system evaluates the structure of multiple dimension symbols built and determines whether to provide any additional award to the player based on the built structure or shape. For example, the gaming system provides the player an award for a built shape including a three symbol win on the lowest level covered by a two symbol win at the second level, covered by a one symbol win at the third level.

In another embodiment, one or more outcomes associated with one symbol display position grid influence one or more outcomes at another layered symbol display position grid. For example, a first symbol display position grid includes wild symbols with countdown indicators which specify how many additional symbol display position grid layers they influence. In this example, after the gaming system evaluates the symbols of the first symbol display position grid, the symbol display positions with countdown wilds increase by one level, and their countdown index decrements. Following this increase, the gaming system layers the second symbol display position grid onto the first symbol display position grid wherein the second symbol display position grid includes zero, one or more holes to accommodate the wild symbols protruding from the first symbol display position grid. This process continues for zero, one or more additional symbol display position grids.

In another embodiment (not shown), the gaming system causes the plurality of symbol display position grids to rotate to enable the player to view each of the sides of each of the generated multiple dimension symbols for a single play of the game.

It should be appreciated that in different embodiments, one or more of:

i. a quantity of symbol display position grids;
ii. a quantity of symbol display positions in each symbol display position grid;
iii. a shape or configuration of each symbol display position grid;
iv. a quantity of rows in each symbol display position grid;
v. a quantity of columns in each symbol display position grid;
vi. which displayed symbols are evaluated to determine any awards;
vii. which displayed sides or faces of which multiple dimension symbols are evaluated to determine any awards;
viii. which symbols are shifted;
ix. which symbol retain their original positioning;
x. which symbols are removed from which symbol display position grids;
xi. which removed symbols are saved;
xii. a quantity of symbols removed from any symbol display position grids;
xiii. a quantity of removed symbols that are saved;
xiv. a quantity of games played that one or more removed symbols are saved for;
xv. the direction of any shifting of any symbols;
xvi. which symbols are available to be generated in each symbol display position grid;
xvii. an order of evaluating the plurality of multiple dimension symbol display position planes;
xviii. an order of transferring any removed symbols to a bonus payline;
xix. a quantity of removed symbols available to be transferred to a bonus payline;
xx. a quantity of times a removed symbol is available to be transferred to a bonus payline;
xxi. which symbols form a target pattern of symbols;
xxii. a quantity of symbols included in a target pattern of symbols;
xxiii. a configuration of symbols which form a target pattern of symbols;
xxiv. a quantity of times a removed symbol is available to be regenerated;
xxv. a quantity of displayed symbols in the designated quantity needed to evaluate the symbols of symbol display position plane;
xxvi. a wager amount required to purchase one or more additional symbol display position grids;
xxvii. a duration of time a designated symbol will remain at one of the symbol display positions of one of the symbol display position grids;
xxviii. a quantity of winning symbols combinations which a designated symbol will remain at one of the symbol display positions of one of the symbol display position grids;
xxix. a quantity of symbol shifts a designated symbol will remain at one of the symbol display positions of one of the symbol display position grids;
xxx. a quantity of games played a designated symbol will remain at one of the symbol display positions of one of the symbol display position grids;
xxxi. any determination disclosed herein;

is/are predetermined, randomly determined, determined based on a generated symbol or symbol combination, determined based on a random determination by the central controller, determined based on a random determination at the gaming system, determined based on a player's selection, determined based on one or more side wagers placed, determined based on the player's primary game wager, determined based on time (such as the time of day), determined based on an amount of coin-in accumulated in one or more pools, determined based on a status of the player (i.e., a player tracking status), or determined based on any other suitable method or criteria.

It should be understood that various changes and modifications to the presently preferred embodiments described herein will be apparent to those skilled in the art. Such changes and modifications can be made without departing from the spirit and scope of the present subject matter and without diminishing its intended advantages. It is therefore intended that such changes and modifications be covered by the appended claims.

The invention is claimed as follows:

1. A gaming system comprising:

at least one input device;

at least one display device;

at least one processor; and at least one memory device which stores a plurality of instructions, which when executed by the at least one processor, causes the at least one processor to operate with the at least one input device and the at least one display device to:

(a) generate one of a plurality of different multiple dimension symbols at each of a plurality of symbol display positions of a symbol display position grid, wherein:

(i) the symbol display position grid is associated with a depth, (ii) each multiple dimension symbol includes a plurality of symbol sides, (b) display a plurality of the symbol sides of a plurality of the generated multiple dimension symbols, wherein:

(i) at least one of the symbol sides of a plurality of the multiple dimension symbols generated at a plurality of the symbol display positions are initially displayed, and (ii) at least one of the symbol sides of a plurality of the multiple dimension symbols generated at a plurality of the symbol display positions are not initially displayed at said symbol display positions, (c) determine if any of the displayed symbol sides of any displayed multiple dimension symbols form any winning symbol combinations, (d) if a plurality of the displayed symbol sides of any displayed multiple dimension symbols of the symbol display position grid form at least one winning symbol combination:

(i) display an award for each displayed winning symbol combination, (ii) remove at least one displayed multiple dimension symbol from at least one displayed winning symbol combination to create at least one empty symbol display position of the symbol display position grid of the removed multiple dimension symbol, (iii) for each created empty symbol display position, display at least one of the symbol sides of at least one multiple dimension symbol, (iv) repeat (c) to (d) until no displayed symbol sides of any displayed multiple dimension symbols of the symbol display position grid form any winning symbol combinations, and (e) repeat (a) to (d) for at least one additional and different symbol display position grid, wherein:

(i) a plurality of the symbol display positions of different symbol display position grids associated with different depths correspond with each other, and (ii) for at least one created empty symbol display position, at least one of the displayed symbol sides of at least one multiple dimension symbol generated at at least one of the symbol display positions of one of the symbol display position grids is from a different one of the symbol display position grids than the symbol display position grid of the removed multiple dimension symbol.

2. The gaming system of claim 1, wherein when executed by the at least one processor, the plurality of instructions cause the at least one processor to display at least one of the symbol sides of each displayed multiple dimension symbol and not display at least one of the symbol sides of each displayed multiple dimension symbol.

3. The gaming system of claim 1, wherein when executed by the at least one processor, the plurality of instructions cause the at least one processor to, for each empty symbol display position created after a plurality of the multiple dimension symbols are generated at the symbol display positions of a plurality of the display position grids: (i) display one of the symbol sides of one of the multiple dimension symbols generated at one of the symbol display positions of one of the symbol display position grids different than the symbol display position grid of the created empty symbol display position, and (ii) display at least one of the symbol sides of at least one of the multiple dimension symbols generated at one of the symbol display positions of the symbol display position grid of the created empty symbol display position.

4. The gaming system of claim 1, wherein at least two of the symbol display position grids each include a different quantity of symbol display positions.

5. The gaming system of claim 1, wherein when executed by the at least one processor, the plurality of instructions cause the at least one processor to: (i) generate the plurality of multiple dimension symbols at each of the plurality of symbol display positions of different symbol display position grids from different pluralities of multiple dimension symbols.

6. The gaming system of claim 1, wherein when executed by the at least one processor, the plurality of instructions cause the at least one processor to generate one of the plurality of multiple dimension symbols for at least one of the created empty symbol display positions if no multiple dimension symbols remain at any symbol display positions corresponding to the at least one created empty symbol display position.

7. The gaming system of claim 1, wherein when executed by the at least one processor, the plurality of instructions cause the at least one processor to remove a plurality of displayed multiple dimension symbols from each displayed winning symbol combination.

8. The gaming system of claim 1, wherein each of the symbol sides of each of the multiple dimension symbols generated at each of the symbol display positions of at least one of the symbol display position grids are not initially displayed at said symbol display positions.

9. A gaming system comprising:

at least one input device;

at least one display device;

at least one processor; and at least one memory device which stores a plurality of instructions, which when executed by the at least one processor, causes the at least one processor to operate with the at least one input device and the at least one display device to:

(a) generate one of a plurality of different multiple dimension symbols at each of a plurality of symbol display positions of a first symbol display position grid, wherein:

(i) the first symbol display position grid is associated with a first depth, (ii) the plurality of symbol display positions of the first symbol display position grid form at least three columns and at least three rows including a first row, a second row positioned adjacent to the first row and a third row positioned adjacent to the second row, and (iii) each multiple dimension symbol includes a plurality of symbol sides, (b) display a plurality of the symbol sides of a plurality of the generated multiple dimension symbols, wherein:

(i) at least one of the symbol sides of a plurality of the multiple dimension symbols generated at a plurality of the symbol display positions are initially displayed, and (ii) at least one of the symbol sides of a plurality of the multiple dimension symbols generated at a plurality of the symbol display positions are not initially displayed at said symbol display positions, (c) determine if any of the displayed symbol sides of any displayed multiple dimension symbols form any winning symbol combinations, (d) if a plurality of the displayed symbol sides of any displayed multiple dimension symbols of the first symbol display position grid form at least one winning symbol combination:

(i) display an award for each displayed winning symbol combination, (ii) remove at least one displayed multiple dimension symbol from at least one displayed winning symbol combination, (iii) for each of any multiple dimension symbols removed from the first row of the symbol display positions of any of the symbol display position grids, reposition at least one of the displayed multiple dimension symbols to another one of the symbol display positions of the symbol display position grid of the removed multiple dimension symbol to create at least one empty symbol display position of the symbol display position grid of the removed multiple dimension symbol, (iv) for each of any multiple dimension symbols removed from the second row of the symbol display positions of any of the symbol display position grids, reposition at least one of the displayed multiple dimension symbols to another one of the symbol display positions of the symbol display position grid of the removed multiple dimension symbol to create at least one empty symbol display position of the symbol display position grid of the removed multiple dimension symbol, (v) for each created empty symbol display position, display at least one of the symbol sides of at least one multiple dimension symbol, (vi) repeat (c) to (d) until no displayed symbol sides of any displayed multiple dimension symbols of the first symbol display position grid form any winning symbol combinations, and (e) when no displayed symbol sides of any displayed multiple dimension symbols of the first symbol display position grid form any winning symbol combinations:

(i) generate one of the plurality of different multiple dimension symbols at each of a plurality of symbol display positions of a second symbol display position grid, wherein:

(A) the second symbol display position grid is associated with a second, different depth, (B) the plurality of symbol display positions of the second symbol display position grid form at least three columns and at least three rows including a first row, a second row positioned adjacent to the first row and a third row positioned adjacent to the second row, and (C) a plurality of the symbol display positions of the first symbol display position grid associated with the first depth correspond to a plurality of the symbol display positions of the second symbol display position grid associated with the second, different depth, and (ii) display a plurality of the symbol sides of a plurality of the generated multiple dimension symbols, wherein:

(A) at least one of the symbol sides of a plurality of the multiple dimension symbols generated at a plurality of the symbol display positions of at least one of the symbol display position grids are initially displayed, and (B) at least one of the symbol sides of a plurality of the multiple dimension symbols generated at a plurality of the symbol display positions of at least one of the symbol display position grids are not initially displayed at said symbol display positions;

(iii) determine if any of the displayed symbol sides of any displayed multiple dimension symbols form any winning symbol combinations;

(iv) if a plurality of the displayed symbol sides of any displayed multiple dimension symbols form at least one winning symbol combination:

(A) display an award for each displayed winning symbol combination, (B) remove at least one displayed multiple dimension symbol from at least one displayed winning symbol combination, (C) for each of any multiple dimension symbols removed from the first row of the symbol display positions of any of the symbol display position grids, reposition at least one of the displayed multiple dimension symbols to another one of the symbol display positions of the symbol display position grid of the removed multiple dimension symbol to create at least one empty symbol display position of the symbol display position grid of the removed multiple dimension symbol, (D) for each of any multiple dimension symbols removed from the second row of the symbol display positions of any of the symbol display position grids, reposition at least one of the displayed multiple dimension symbols to another one of the symbol display positions of the symbol display position grid of the removed multiple dimension symbol to create at least one empty symbol display position of the symbol display position grid of the removed multiple dimension symbol, (E) for each created empty symbol display position, display at least one of the symbol sides of at least one multiple dimension symbols generated at at least one of the symbol display positions of one of the symbol display position grids different than the symbol display position grid of the removed multiple dimension symbol, wherein said multiple dimension symbol is generated at one of the symbol display positions corresponding to the symbol display position of the removed multiple dimension symbol, and (F) repeat (e)(iii) to (e)(iv) at least once.

10. The gaming system of claim 9, wherein when executed by the at least one processor, the plurality of instructions cause the at least one processor to display at least one of the symbol sides of each displayed multiple dimension symbol and not display at least one of the symbol sides of each displayed multiple dimension symbol.

11. The gaming system of claim 9, wherein when executed by the at least one processor, the plurality of instructions cause the at least one processor to, for each empty symbol display position created after a plurality of the multiple dimension symbols are generated at the symbol display positions of the second symbol display position grid: (i) display one of the symbol sides of one of the multiple dimension symbols generated at one of the symbol display positions of one of the symbol display position grids different than the symbol display position grid of the created empty symbol display position, and (ii) display at least one of the symbol sides of at least one of the multiple dimension symbols generated at one of the symbol display positions of the symbol display position grid of the created empty symbol display position.

12. The gaming system of claim 9, wherein the first symbol display position grid and the second symbol display position grid each include a different quantity of symbol display positions.

13. The gaming system of claim 9, wherein when executed by the at least one processor, the plurality of instructions cause the at least one processor to: (i) generate the plurality of multiple dimension symbols at each of the plurality of symbol display positions of the first symbol display position grid from a first plurality of multiple dimension symbols, and (ii) generate the plurality of multiple dimension symbols at each of the plurality of symbol display positions of the second symbol display position grid from a second, different plurality of multiple dimension symbols.

14. The gaming system of claim 9, wherein when executed by the at least one processor, the plurality of instructions cause the at least one processor to generate one of the plurality of multiple dimension symbols for at least one of the created empty symbol display positions if no multiple dimension symbols remain at any symbol display positions corresponding to the at least one created empty symbol display position.

15. The gaming system of claim 9, wherein when executed by the at least one processor, the plurality of instructions cause the at least one processor to remove a plurality of displayed multiple dimension symbols from each displayed winning symbol combination.

16. The gaming system of claim 9, wherein each of the symbol sides of each of the multiple dimension symbols generated at each of the symbol display positions of at least one of the symbol display position grids are not initially displayed at said symbol display positions.

17. A method of operating a gaming system, said method comprising:

(a) causing at least one processor to execute a plurality of instructions to generate one of a plurality of different multiple dimension symbols at each of a plurality of symbol display positions of a symbol display position grid, wherein:
  (i) the symbol display position grid is associated with a depth,
  (ii) each multiple dimension symbol includes a plurality of symbol sides, (b) causing at least one display device to display a plurality of the symbol sides of a plurality of the generated multiple dimension symbols, wherein:
  (i) at least one of the symbol sides of a plurality of the multiple dimension symbols generated at a plurality of the symbol display positions are initially displayed, and
  (ii) at least one of the symbol sides of a plurality of the multiple dimension symbols generated at a plurality of the symbol display positions are not initially displayed at said symbol display positions, (c) causing the at least one processor to execute the plurality of instructions to determine if any of the displayed symbol sides of any displayed multiple dimension symbols form any winning symbol combinations, (d) if a plurality of the displayed symbol sides of any displayed multiple dimension symbols of the symbol display position grid form at least one winning symbol combination:
  (i) causing the at least one display device to display an award for each displayed winning symbol combination,
  (ii) causing the at least one processor to execute the plurality of instructions to remove at least one displayed multiple dimension symbol from at least one displayed winning symbol combination to create at least one empty symbol display position of the symbol display position grid of the removed multiple dimension symbol,
  (iii) for each created empty symbol display position, causing the at least one display device to display at least one of the symbol sides of at least one multiple dimension symbol,
  (iv) repeating (c) to (d) until no displayed symbol sides of any displayed multiple dimension symbols of the symbol display position grid form any winning symbol combinations, and (e) repeating (a) to (d) for at least one additional and different symbol display position grid, wherein:
  (i) a plurality of the symbol display positions of different symbol display position grids associated with different depths correspond with each other, and
  (ii) for at least one created empty symbol display position, at least one of the displayed symbol sides of at least one multiple dimension symbol generated at at least one of the symbol display positions of one of the symbol display position grids is from a different one of the symbol display position grids than the symbol display position grid of the removed multiple dimension symbol.

18. The method of claim 17, which includes causing the at least one display device to display at least one of the symbol sides of each displayed multiple dimension symbol and not display at least one of the symbol sides of each displayed multiple dimension symbol.

19. The method of claim 17, which includes, for each empty symbol display position created after a plurality of the multiple dimension symbols are generated at the symbol display positions of a plurality of the display position grids:
  (i) causing the at least one display device to display one of the symbol sides of one of the multiple dimension symbols generated at one of the symbol display positions of one of the symbol display position grids different than the symbol display position grid of the created empty symbol display position, and
  (ii) causing the at least one display device to display at least one of the symbol sides of at least one of the multiple dimension symbols generated at one of the symbol display positions of the symbol display position grid of the created empty symbol display position.

20. The method of claim 17, wherein at least two of the symbol display position grids each include a different quantity of symbol display positions.

21. The method of claim 17, which includes causing the at least one processor to execute the plurality of instructions to generate the plurality of multiple dimension symbols at each of the plurality of symbol display positions of different symbol display position grids from different pluralities of multiple dimension symbols.

22. The method of claim 17, which includes causing the at least one processor to execute the plurality of instructions to generate one of the plurality of multiple dimension symbols for at least one of the created empty symbol display positions if no multiple dimension symbols remain at any symbol display positions corresponding to the at least one created empty symbol display position.

23. The method of claim 17, which includes causing the at least one processor to execute the plurality of instructions to remove a plurality of displayed multiple dimension symbols from each displayed winning symbol combination.

24. The method of claim 17, wherein each of the symbol sides of each of the multiple dimension symbols generated at each of the symbol display positions of at least one of the symbol display position grids are not initially displayed at said symbol display positions.

25. The method of claim 17, which is executed through a data network.

26. The method of claim 25, wherein the data network is an internet.

27. A method of operating a gaming system, said method comprising:

(a) causing at least one processor to execute a plurality of instructions to generate one of a plurality of different multiple dimension symbols at each of a plurality of symbol display positions of a first symbol display position grid, wherein:

(i) the first symbol display position grid is associated with a first depth, (ii) the plurality of symbol display positions of the first symbol display position grid form at least three columns and at least three rows including a first row, a second row positioned adjacent to the first row and a third row positioned adjacent to the second row, and (iii) each multiple dimension symbol includes a plurality of symbol sides, (b) causing at least one display device to display a plurality of the symbol sides of a plurality of the generated multiple dimension symbols, wherein:

at least one of the symbol sides of a plurality of the multiple dimension symbols generated at a plurality of the symbol display positions are initially displayed, and (ii) at least one of the symbol sides of a plurality of the multiple dimension symbols generated at a plurality of the symbol display positions are not initially displayed at said symbol display positions, (c) causing the at least one processor to execute the plurality of instructions to determine if any of the displayed symbol sides of any displayed multiple dimension symbols form any winning symbol combinations, (d) if a plurality of the displayed symbol sides of any displayed multiple dimension symbols of the first symbol display position grid form at least one winning symbol combination:

causing the at least one display device to display an award for each displayed winning symbol combination, (ii) causing the at least one processor to execute the plurality of instructions to remove at least one displayed multiple dimension symbol from at least one displayed winning symbol combination, (iii) for each of any multiple dimension symbols removed from the first row of the symbol display positions of any of the symbol display position grids, causing the at least one processor to execute the plurality of instructions to reposition at least one of the displayed multiple dimension symbols to another one of the symbol display positions of the symbol display position grid of the removed multiple dimension symbol to create at least one empty symbol display position of the symbol display position grid of the removed multiple dimension symbol, (iv) for each of any multiple dimension symbols removed from the second row of the symbol display positions of any of the symbol display position grids, causing the at least one processor to execute the plurality of instructions to reposition at least one of the displayed multiple dimension symbols to another one of the symbol display positions of the symbol display position grid of the removed multiple dimension symbol to create at least one empty symbol display position of the symbol display position grid of the removed multiple dimension symbol, (v) for each created empty symbol display position, causing the at least one display device to display at least one of the symbol sides of at least one multiple dimension symbol, (vi) repeating (c) to (d) until no displayed symbol sides of any displayed multiple dimension symbols of the first symbol display position grid form any winning symbol combinations, and (e) when no displayed symbol sides of any displayed multiple dimension symbols of the first symbol display position grid form any winning symbol combinations:

(i) causing the at least one processor to execute the plurality of instructions to generate one of the plurality of different multiple dimension symbols at each of a plurality of symbol display positions of a second symbol display position grid, wherein:

(A) the second symbol display position grid is associated with a second, different depth, (B) the plurality of symbol display positions of the second symbol display position grid form at least three columns and at least three rows including a first row, a second row positioned adjacent to the first row and a third row positioned adjacent to the second row, and (C) a plurality of the symbol display positions of the first symbol display position grid associated with the first depth correspond to a plurality of the symbol display positions of the second symbol display position grid associated with the second, different depth, and (ii) causing the at least one display device to display a plurality of the symbol sides of a plurality of the generated multiple dimension symbols, wherein:

(A) at least one of the symbol sides of a plurality of the multiple dimension symbols generated at a plurality of the symbol display positions of at least one of the symbol display position grids are initially displayed, and (B) at least one of the symbol sides of a plurality of the multiple dimension symbols generated at a plurality of the symbol display positions of at least one of the symbol display position grids are not initially displayed at said symbol display positions;

(iii) causing the at least one processor to execute the plurality of instructions to determine if any of the displayed symbol sides of any displayed multiple dimension symbols form any winning symbol combinations;

(iv) if a plurality of the displayed symbol sides of any displayed multiple dimension symbols form at least one winning symbol combination:

(A) causing the at least one display device to display an award for each displayed winning symbol combination, (B) causing the at least one processor to execute the plurality of instructions to remove at least one displayed multiple dimension symbol from at least one displayed winning symbol combination, (C) for each of any multiple dimension symbols removed from the first row of the symbol display positions of any of the symbol display position grids, causing the at least one processor to execute the plurality of instructions to reposition at least one of the displayed multiple dimension symbols to another one of the symbol display positions of the symbol display position grid of the removed multiple dimension symbol to create at least one empty symbol display position of the symbol display position grid of the removed multiple dimension symbol, (D) for each of any multiple dimension symbols removed from the second row of the symbol display positions of any of the symbol display position grids, causing the at least one processor to execute the plurality of instructions to reposition at least one of the displayed multiple dimension symbols to another one of the symbol display positions of the symbol display position grid of the removed multiple dimension symbol to create at least one empty symbol display position of the symbol display position grid of the removed multiple dimension symbol, (E) for each created empty symbol display position, causing the at least one display device to display at least one of the symbol sides of at least one multiple dimension symbols generated at at least one of the symbol display positions of one of the symbol display position grids different than the symbol display position grid of the removed multiple dimension symbol, wherein said multiple dimension symbol is generated at one of the symbol display positions corresponding to the symbol display position of the removed multiple dimension symbol, and (F) repeating (e)(iii) to (e)(iv) at least once.

28. The method of claim 27, which includes causing the at least one display device to display at least one of the symbol sides of each displayed multiple dimension symbol and not display at least one of the symbol sides of each displayed multiple dimension symbol.

29. The method of claim 27, which includes, for each empty symbol display position created after a plurality of the multiple dimension symbols are generated at the symbol display positions of the second symbol display position grid:

(i) causing the at least one display device to display one of the symbol sides of one of the multiple dimension symbols generated at one of the symbol display positions of one of the symbol display position grids different than the symbol display position grid of the created empty symbol display position, and (ii) causing the at least one display device to display at least one of the symbol sides of at least one of the multiple dimension symbols generated at one of the symbol display positions of the symbol display position grid of the created empty symbol display position.

30. The method of claim 27, wherein the first symbol display position grid and the second symbol display position grid each include a different quantity of symbol display positions.

31. The method of claim 27, which includes:

(i) causing the at least one processor to execute the plurality of instructions to generate the plurality of multiple dimension symbols at each of the plurality of symbol display positions of the first symbol display position grid from a first plurality of multiple dimension symbols, and (ii) causing the at least one processor to execute the plurality of instructions to generate the plurality of multiple dimension symbols at each of the plurality of symbol display positions of the second symbol display position grid from a second, different plurality of multiple dimension symbols.

32. The method of claim 27, which includes causing the at least one processor to execute the plurality of instructions to generate one of the plurality of multiple dimension symbols for at least one of the created empty symbol display positions if no multiple dimension symbols remain at any symbol display positions corresponding to the at least one created empty symbol display position.

33. The method of claim 27, which includes causing the at least one processor to execute the plurality of instructions to remove a plurality of displayed multiple dimension symbols from each displayed winning symbol combination.

34. The method of claim 27, wherein each of the symbol sides of each of the multiple dimension symbols generated at each of the symbol display positions of at least one of the symbol display position grids are not initially displayed at said symbol display positions.

35. The method of claim 27, which is executed through a data network.

36. The method of claim 35, wherein the data network is an internet.

* * * * *